US010520862B2

(12) United States Patent
Hasegawa et al.

(10) Patent No.: US 10,520,862 B2
(45) Date of Patent: Dec. 31, 2019

(54) IMAGE HEATING APPARATUS HAVING AN OPENING AND CLOSING MECHANISM THAT OPENS AND CLOSES AN AIR BLOWING PORT USING A PLURALITY OF SHUTTER MEMBERS

(71) Applicant: CANON KABUSHIKI KAISHA, Tokyo (JP)

(72) Inventors: Takuya Hasegawa, Tokyo (JP); Masahiro Takahashi, Kashiwa (JP); Satoshi Ishikawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/189,095

(22) Filed: Nov. 13, 2018

(65) Prior Publication Data

US 2019/0155195 A1 May 23, 2019

(30) Foreign Application Priority Data

Nov. 21, 2017 (JP) ..... 2017-223305

(51) Int. Cl.
*G03G 15/20* (2006.01)
*G03G 21/20* (2006.01)

(52) U.S. Cl.
CPC ..... *G03G 15/2017* (2013.01); *G03G 15/2042* (2013.01); *G03G 15/2064* (2013.01); *G03G 21/206* (2013.01); *G03G 2221/1639* (2013.01); *G03G 2221/1645* (2013.01)

(58) Field of Classification Search
CPC ..... G03G 15/2017; G03G 15/2064; G03G 21/206; G03G 2221/1645; G03G 2221/1639
See application file for complete search history.

(56) References Cited

U.S. PATENT DOCUMENTS

| | | | | |
|---|---|---|---|---|
| 7,536,145 | B2 | 5/2009 | Tomine et al. | |
| 7,764,895 | B2 | 7/2010 | Tomine et al. | |
| 8,725,025 | B2 | 5/2014 | Murasaki | |
| 9,025,989 | B2 | 5/2015 | Murasaki | |
| 9,268,269 | B2 | 2/2016 | Sekiya | |
| 10,031,476 | B2 * | 7/2018 | Minagawa ..... | G03G 15/2017 |
| 2007/0059012 | A1 | 3/2007 | Tomine et al. | |

(Continued)

FOREIGN PATENT DOCUMENTS

JP 2015-158600 A 9/2015

OTHER PUBLICATIONS

Extended European Search Report dated Jun. 18, 2019, issued in European Patent Application No. 18205336.3.

*Primary Examiner* — Susan S Lee
(74) *Attorney, Agent, or Firm* — Venable LLP

(57) ABSTRACT

An image heating apparatus includes a first rotatable member and a second rotatable member, which are configured to form a nip in which a toner image is fixed on a recording material, an air blowing mechanism, and a duct configured to guide air from the air blowing mechanism toward an end portion of the first rotatable member with respect to a longitudinal direction of the first rotatable member. The image heating apparatus also includes an opening and closing mechanism configured to open and to close an air blowing port of the duct. The opening and closing mechanism includes a plurality of shutter members configured to close the air blowing port in cooperation with each other.

12 Claims, 42 Drawing Sheets

(56) References Cited

U.S. PATENT DOCUMENTS

| | | | | |
|---|---|---|---|---|
| 2012/0051806 | A1 | 3/2012 | Takahashi | |
| 2012/0282002 | A1 | 11/2012 | Murasaki | |
| 2013/0236202 | A1* | 9/2013 | Akiya | G03G 21/206 399/69 |
| 2015/0241824 | A1 | 8/2015 | Sekiya | |

* cited by examiner (a)ALL CLOSE (b)ALL OPEN

PARTIALLY ENLARGED VIEW

IMAGE HEATING APPARATUS HAVING AN OPENING AND CLOSING MECHANISM THAT OPENS AND CLOSES AN AIR BLOWING PORT USING A PLURALITY OF SHUTTER MEMBERS

This application claims the benefit of Japanese Patent Application No. 2017-223305 filed on Nov. 21, 2017, which is hereby incorporated by reference herein in its entirety.

FIELD OF THE INVENTION AND RELATED ART

The present invention relates to an image heating apparatus for heating a toner image on a recording material. This image heating apparatus is capable of being used in an image forming apparatus, such as a copying machine, a printer, a facsimile machine, or a multi-function machine having a plurality of functions of these machines.

Conventionally, in the image forming apparatus, a fixing device (image heating apparatus) for fixing the toner image formed on the recording material (sheet) under application of heat and pressure is mounted.

In such a fixing device, it has been known that when an image is formed on a sheet narrower in width than a maximum width sheet capable being introduced in the fixing device (hereafter, this sheet is referred to as small-size paper), a temperature of a region (longitudinal end regions in which a rotatable member used for heating the fixing device is non-contact with the sheet), which is a part of the rotatable member, excessively rise.

For that reason, in a fixing device disclosed in Japanese Laid-Open Patent Application No. 2015-158600, a constitution in which longitudinal end regions of a rotatable member, which are likely to increase in temperature, are cooled by air blowing is employed. Specifically, in each of the regions on one end side and the other end side with respect to a longitudinal direction of the rotatable member, a fan, a duct, and a shutter member are provided (a shutter member constitution with a single shutter member on one side).

In the constitution disclosed in Japanese Laid-Open Patent Application No. 2015-158600, recent market demands, i.e., compatibility with various width sizes, cannot be sufficiently met.

SUMMARY OF THE INVENTION

According to one aspect, the present invention provides an image heating apparatus comprising a first rotatable member and a second rotatable member, which are configured to form a nip in which a toner image is fixed on a recording material, an air blowing mechanism, a duct configured to guide air from the air blowing mechanism toward an end portion of the first rotatable member with respect to a longitudinal direction of the first rotatable member, and an opening and closing mechanism configured to open and to close an air blowing port of the duct, wherein the opening and closing mechanism includes a plurality of shutter members configured to close the air blowing port in cooperation with each other.

According to another aspect, the present invention provides an image heating apparatus comprising a first rotatable member and a second rotatable member, which are configured to form a nip in which a toner image is fixed on a recording material, an air blowing mechanism, a first duct configured to guide air from the air blowing mechanism toward an end portion of the first rotatable member with respect to a longitudinal direction of the first rotatable member, a first opening and closing mechanism configured to open and to close a first air blowing port of the first duct, wherein the opening and closing mechanism includes a plurality of shutter members configured to close the air blowing port in cooperation with each other, a second duct configured to guide air from the air blowing mechanism toward the other end portion of the first rotatable member with respect to a longitudinal direction of the first rotatable member, and a second opening and closing mechanism configured to open and to close a second air blowing port of the second duct, wherein the third opening and closing mechanism includes a plurality of shutter members configured to close the air blowing port in cooperation with each other.

Further features of the present invention will become apparent from the following description of exemplary embodiments with reference to the attached drawings.

BRIEF DESCRIPTION OF THE DRAWINGS

Parts (a) and (b) of FIG. 1 are schematic views showing an all-close state and an all-open state, respectively, of a shutter member structure with two shutter members on each side.

Figure 15:
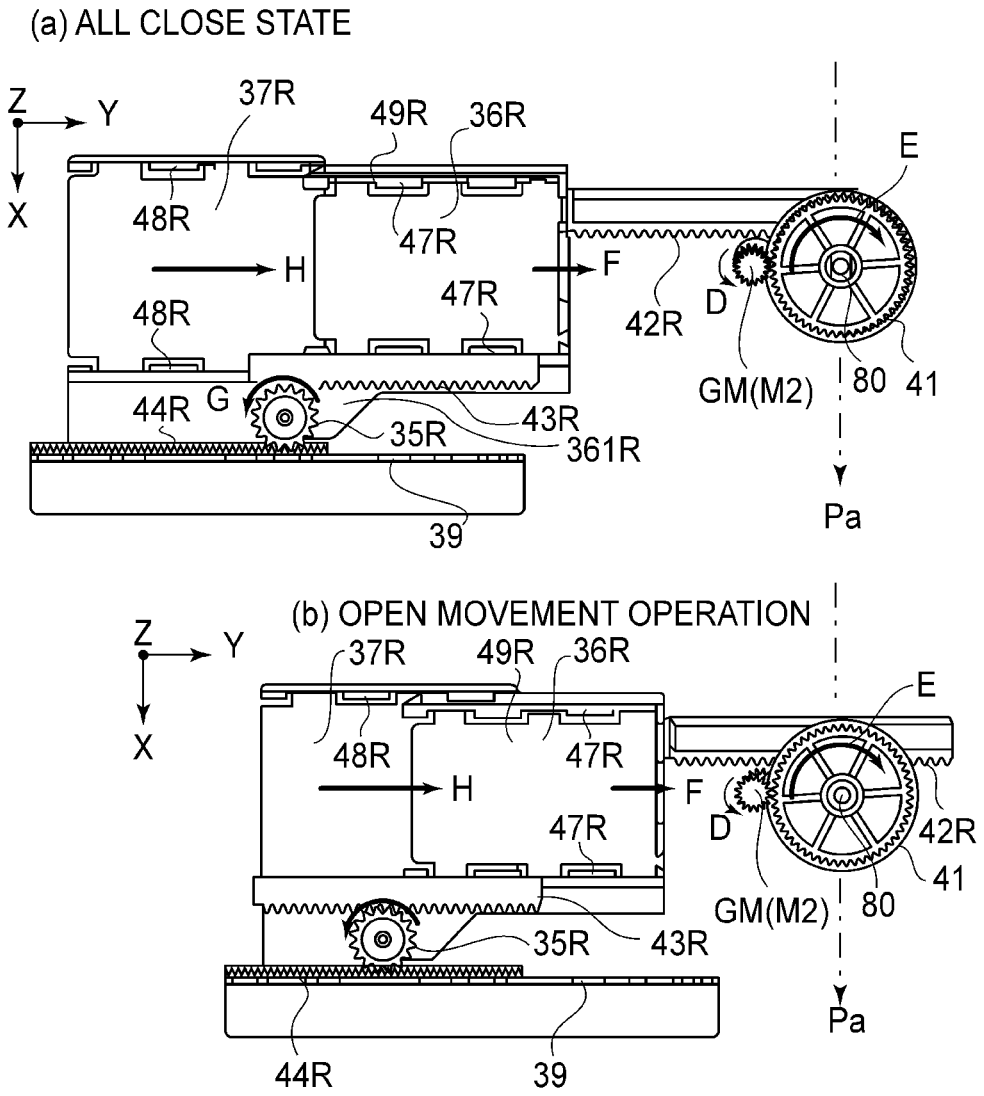

Parts (a) and (b) of FIG. 15 are schematic views of the shutter mechanism in an all-close state and during an open movement operation, respectively, as seen from the inlet port side (an inside of the shutter mechanism).

Figure 16:
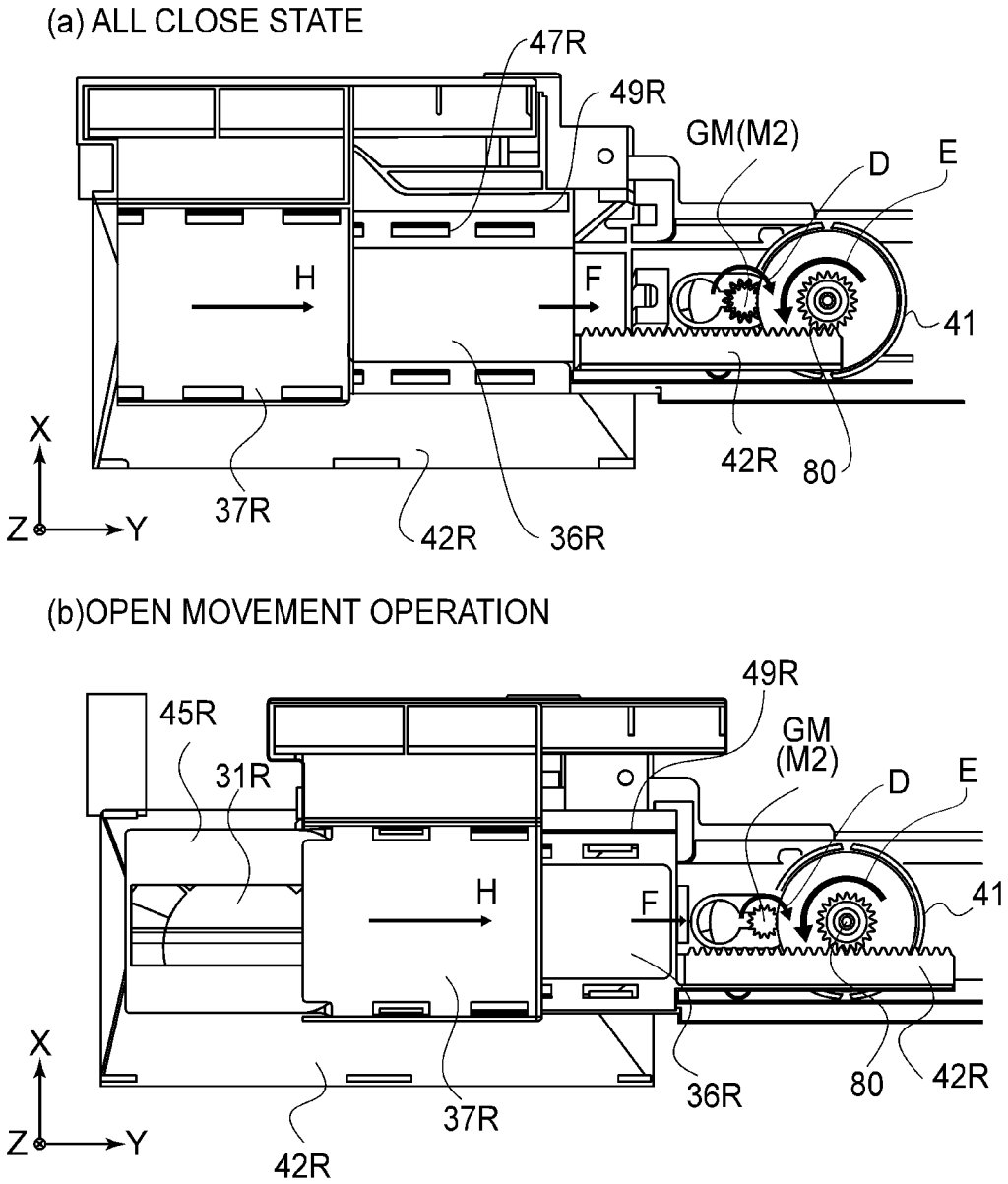

Parts (a) and (b) of FIG. 16 are schematic views of the shutter mechanism in the all-close state and during the open movement operation, respectively, as seen from the air blowing port side (an outside of the shutter mechanism).

Figure 17:
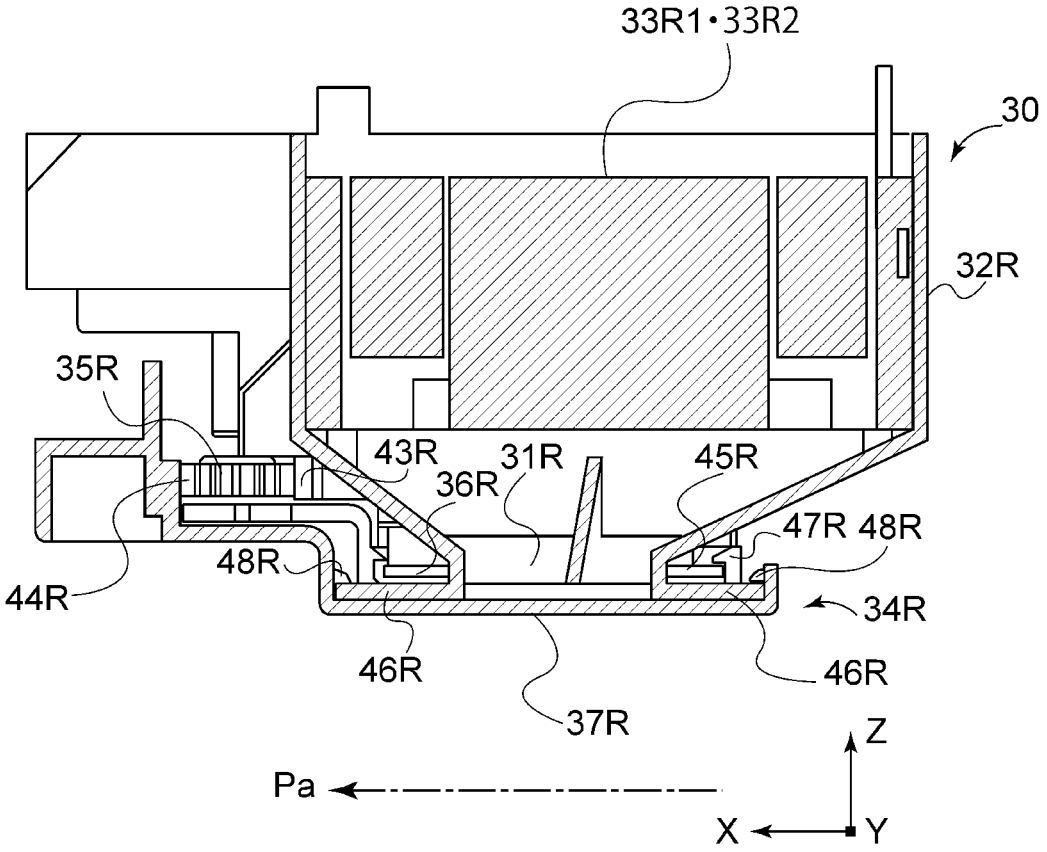

FIG. 17 is a schematic view showing a relationship among an inner shutter member, an outer shutter member and a duct.

Figure 18:
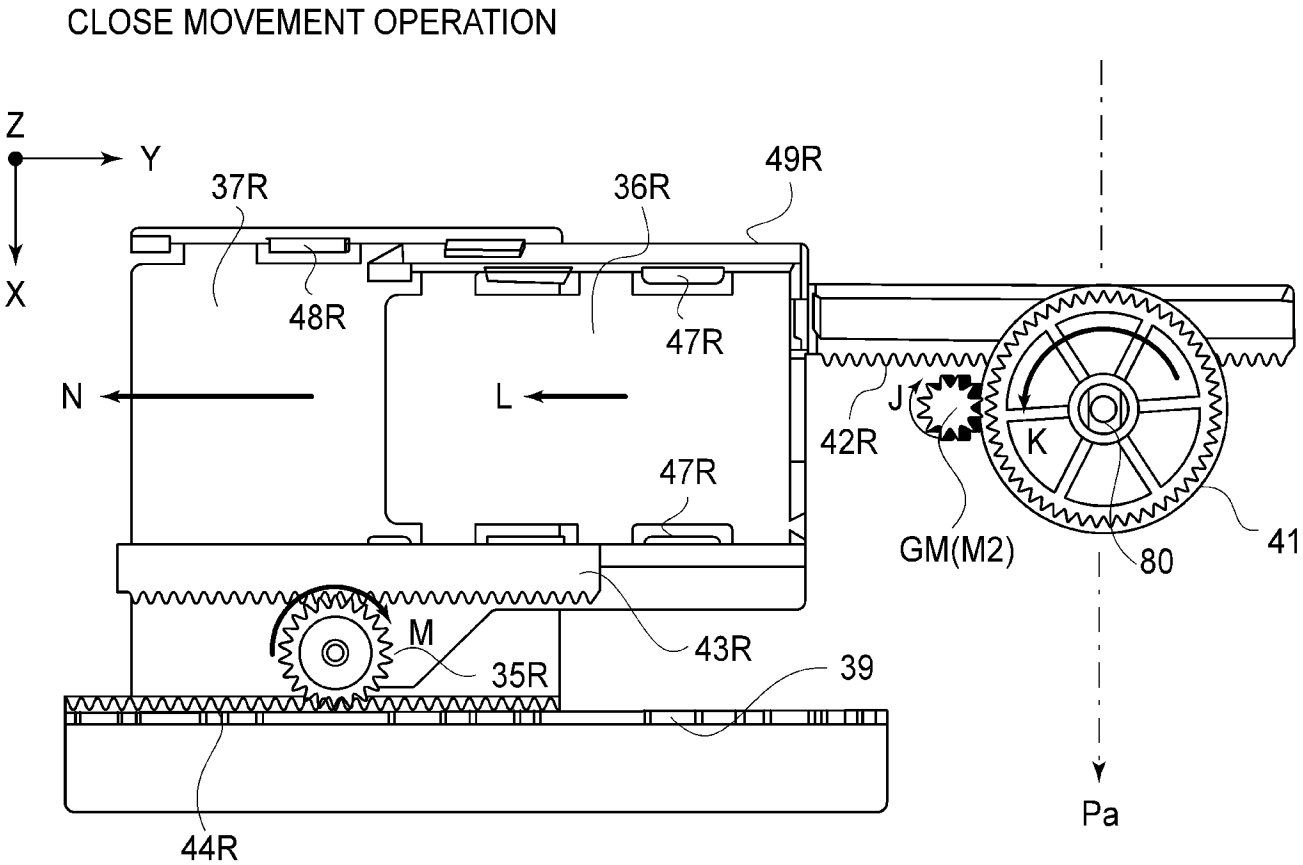

FIG. 18 is a schematic view of the shutter mechanism as seen from the inlet port side (the inside of the shutter mechanism), in which the shutter member is in a substantially intermediary open position between an all-close position and an all-open position.

Figure 19:
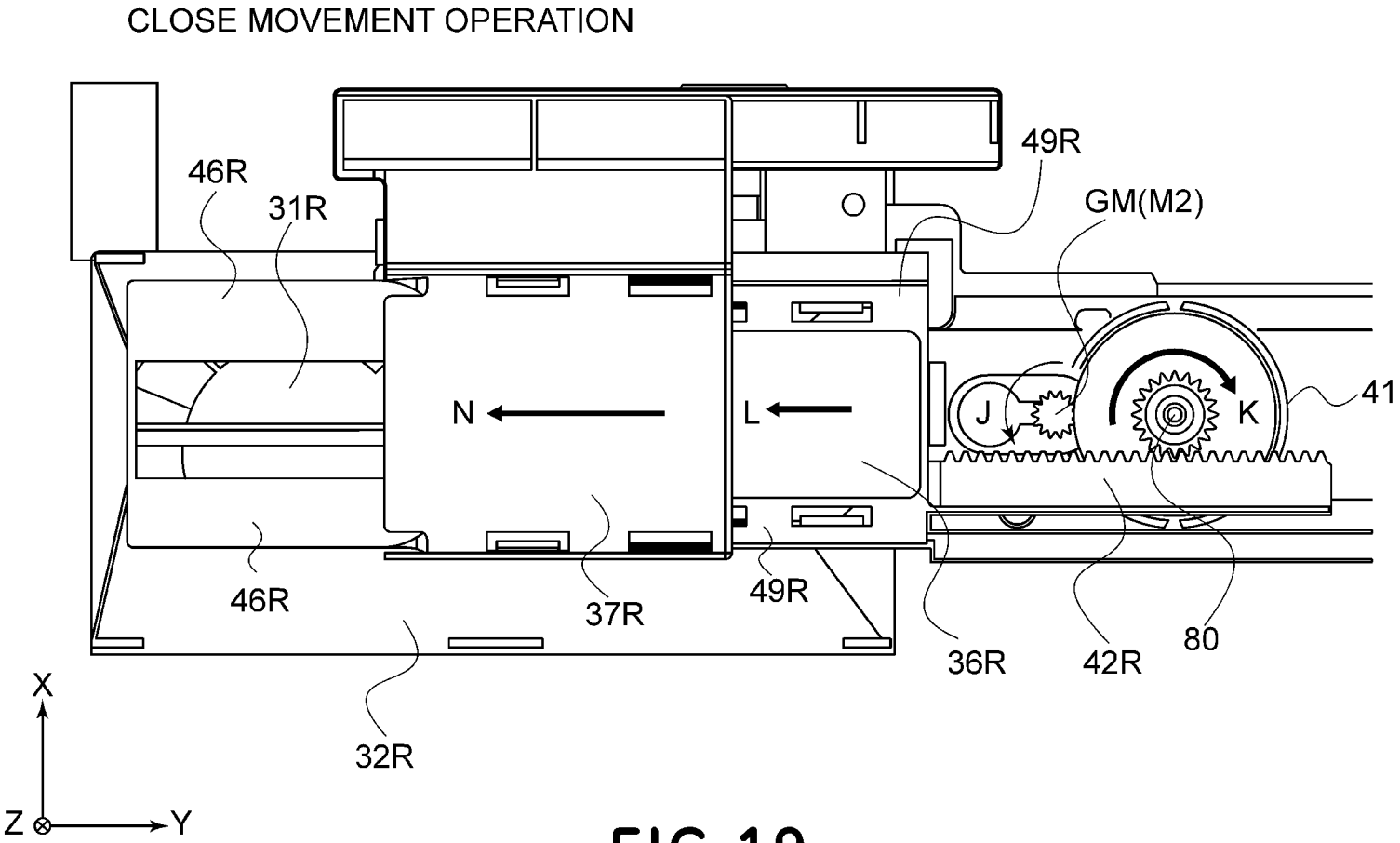

FIG. 19 is a schematic view of the shutter mechanism as seen from the air blowing port side (the outside of the shutter mechanism), in which the shutter member is in a substantially intermediary open position between the all-close position and the all-open position.

Figure 20:
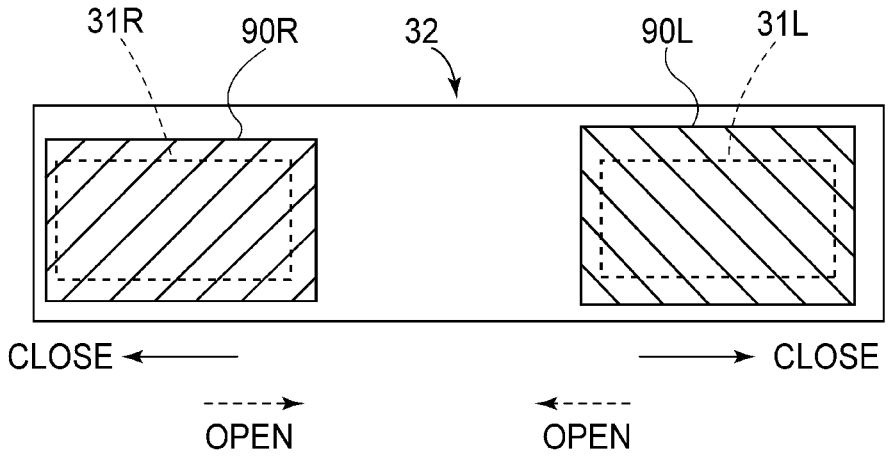
Figure 20:
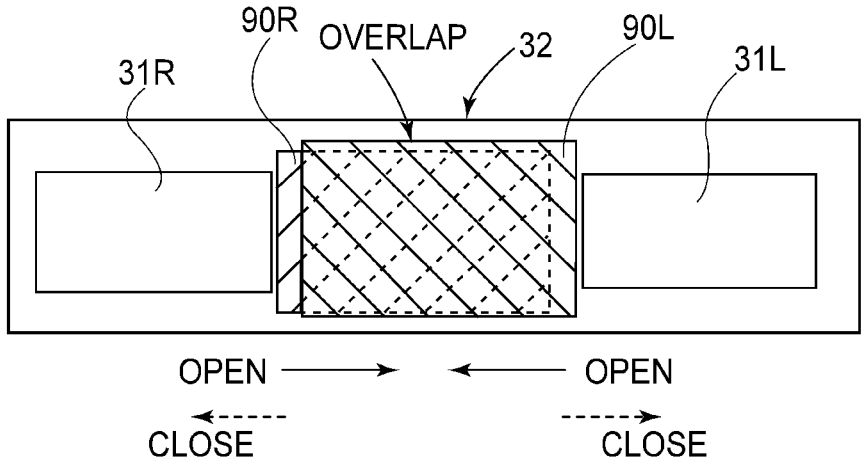

Parts (a) and (b) of FIG. 20 are schematic views of a principal part of an air blowing cooling mechanism in Embodiment 2 in an all-close state and an all-open state, respectively.

Figure 21:
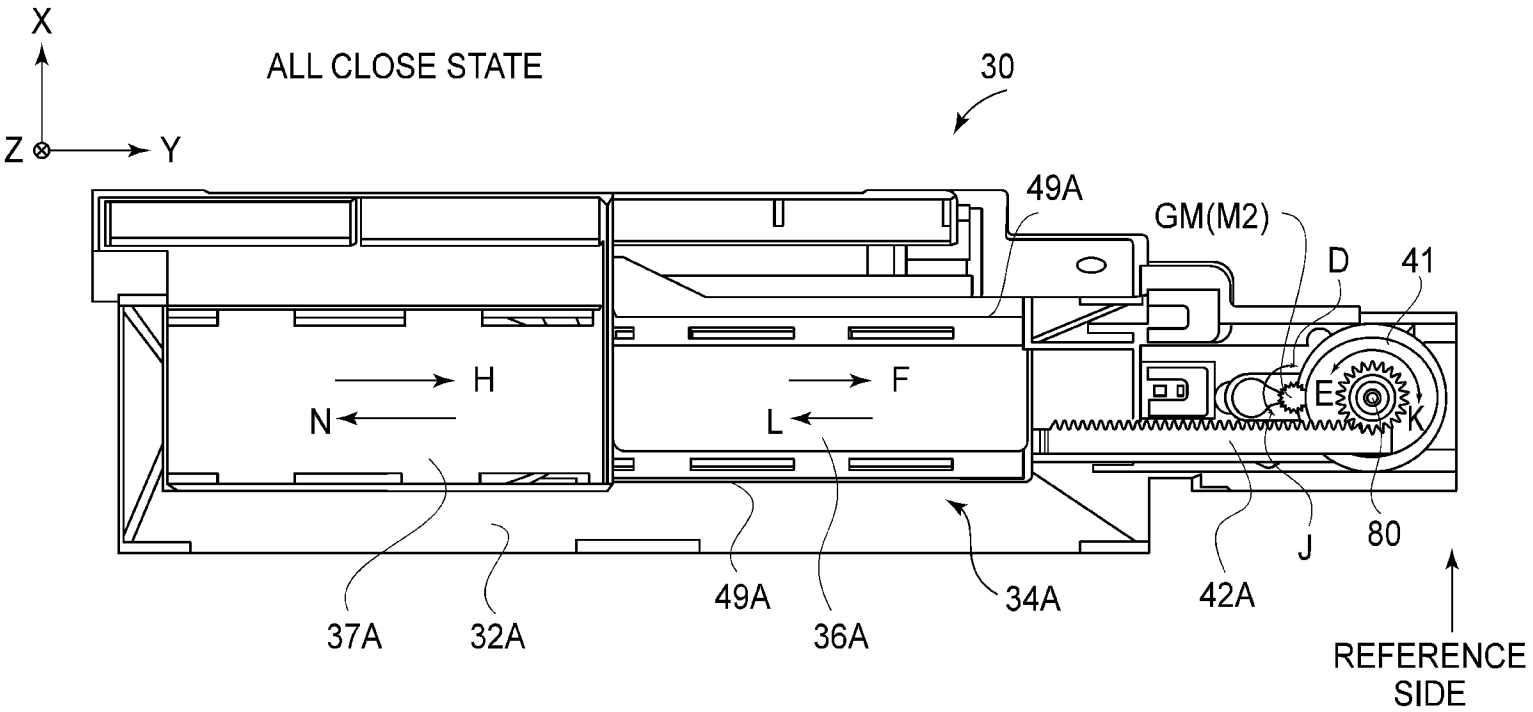

FIG. 21 is an illustration of an air blowing cooling mechanism in Embodiment 3.

Figure 22:
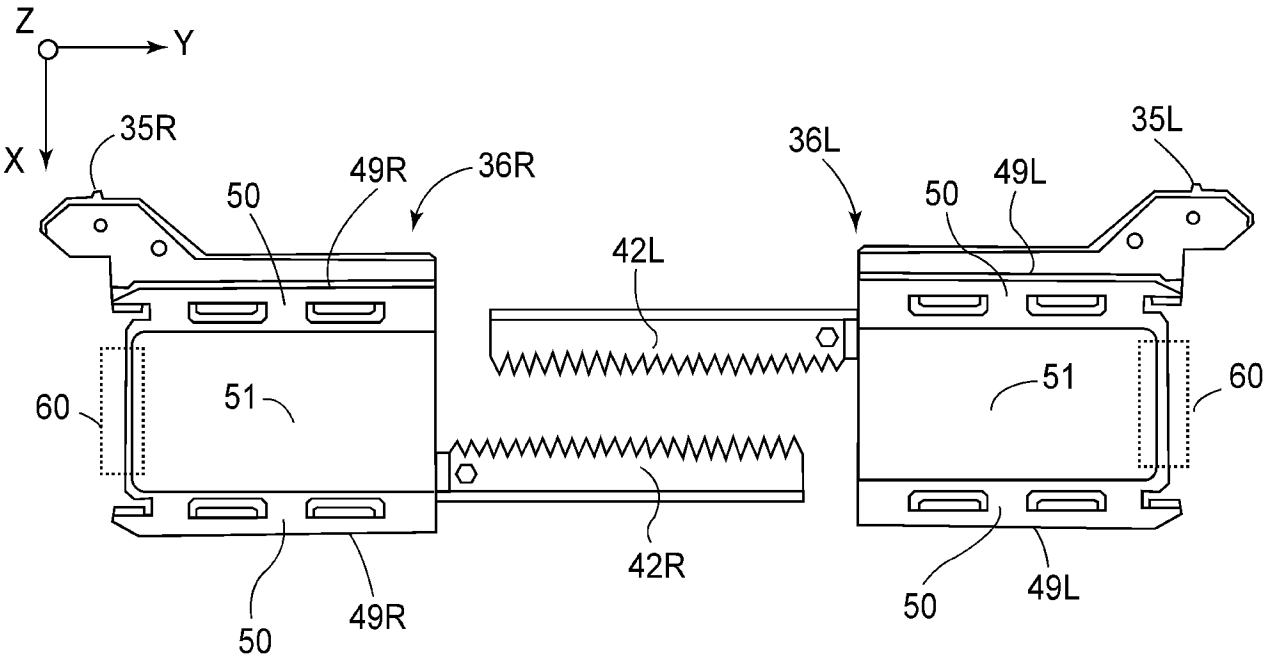

FIG. 22 is an illustration of an air blowing cooling mechanism in Embodiment 4 and is an outer surface view of an inner shutter member.

Figure 23:
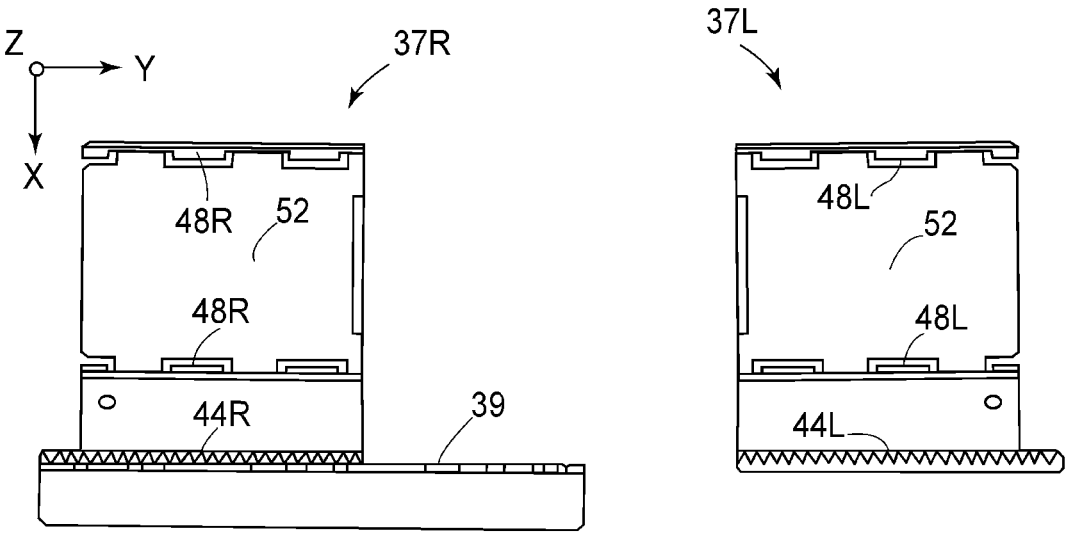

FIG. 23 is an illustration of the air blowing cooling mechanism in Embodiment 4 and is an inner surface view of an outer shutter member.

Figure 24:
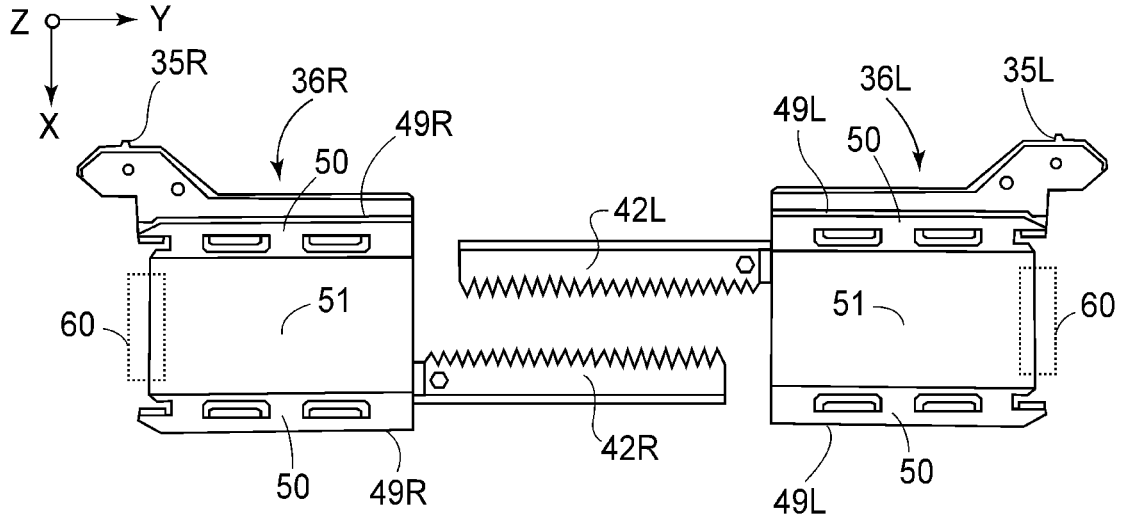

FIG. 24 is an illustration of an air blowing cooling mechanism in Embodiment 5 and is an outer surface view of an inner shutter member.

Figure 25:
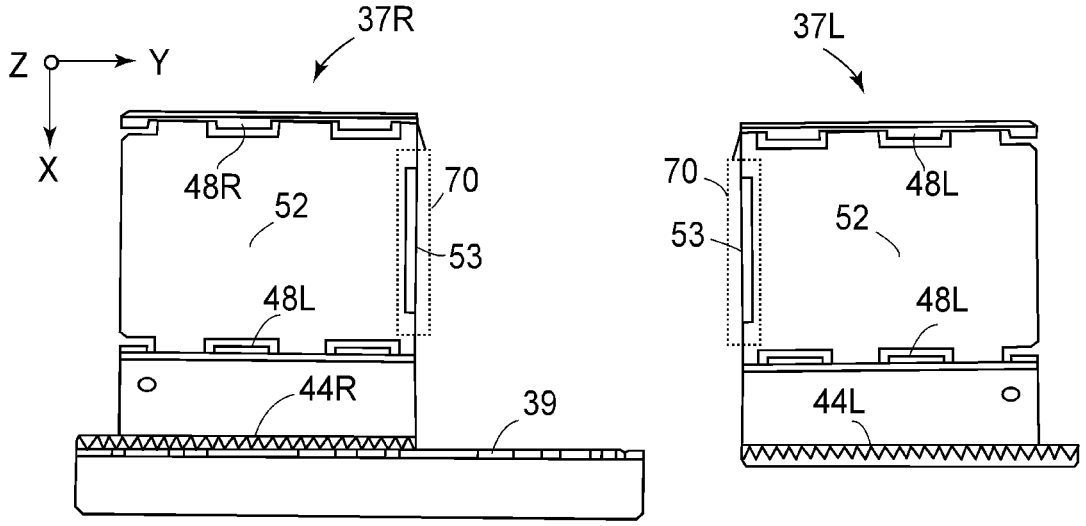

FIG. 25 is an illustration of the air blowing cooling mechanism in Embodiment 5 and is an inner surface view of an outer shutter member.

Figure 26:
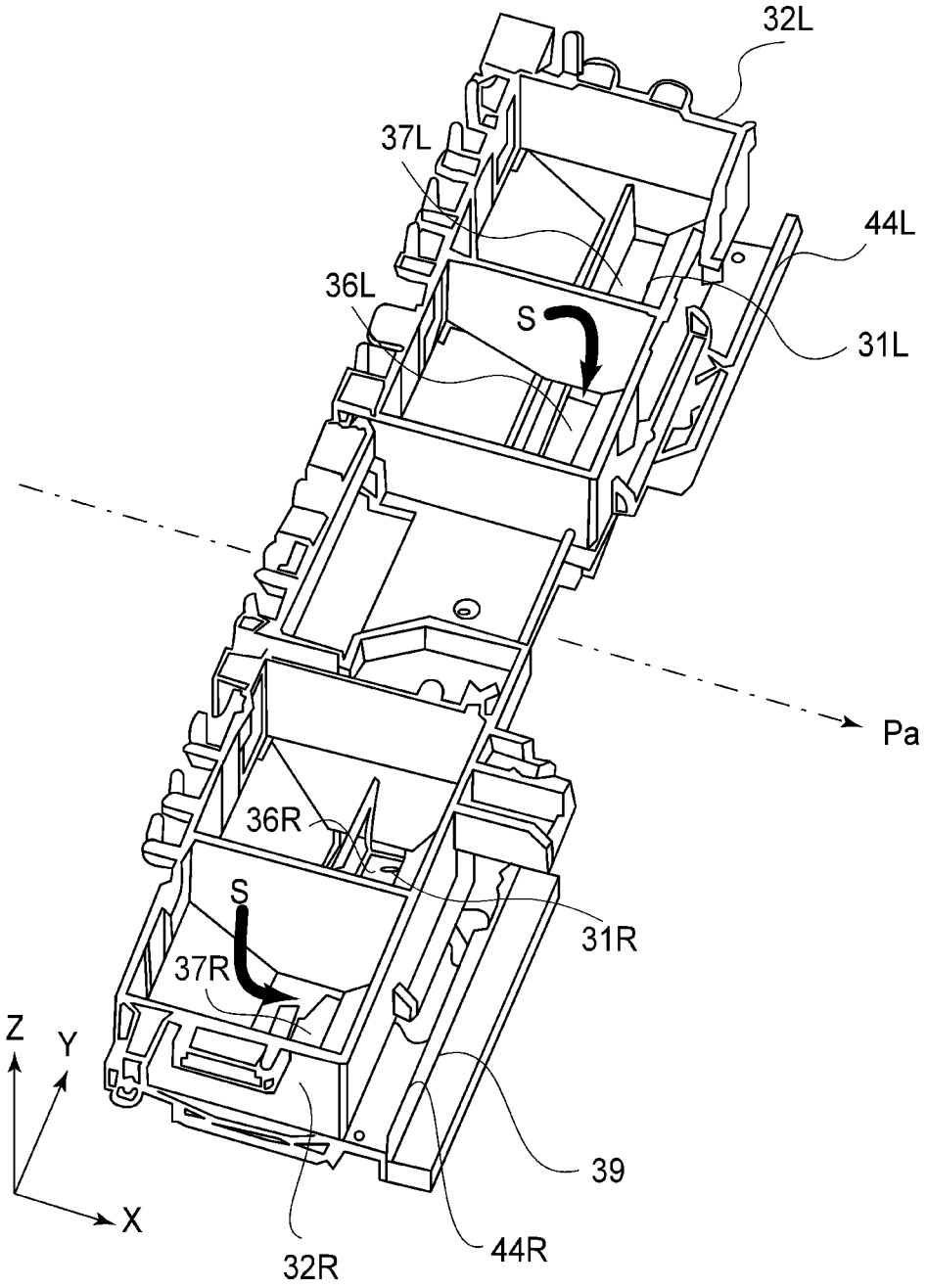

FIG. 26 is an illustration of a gap between the inner shutter member and the outer shutter member.

Figure 27:
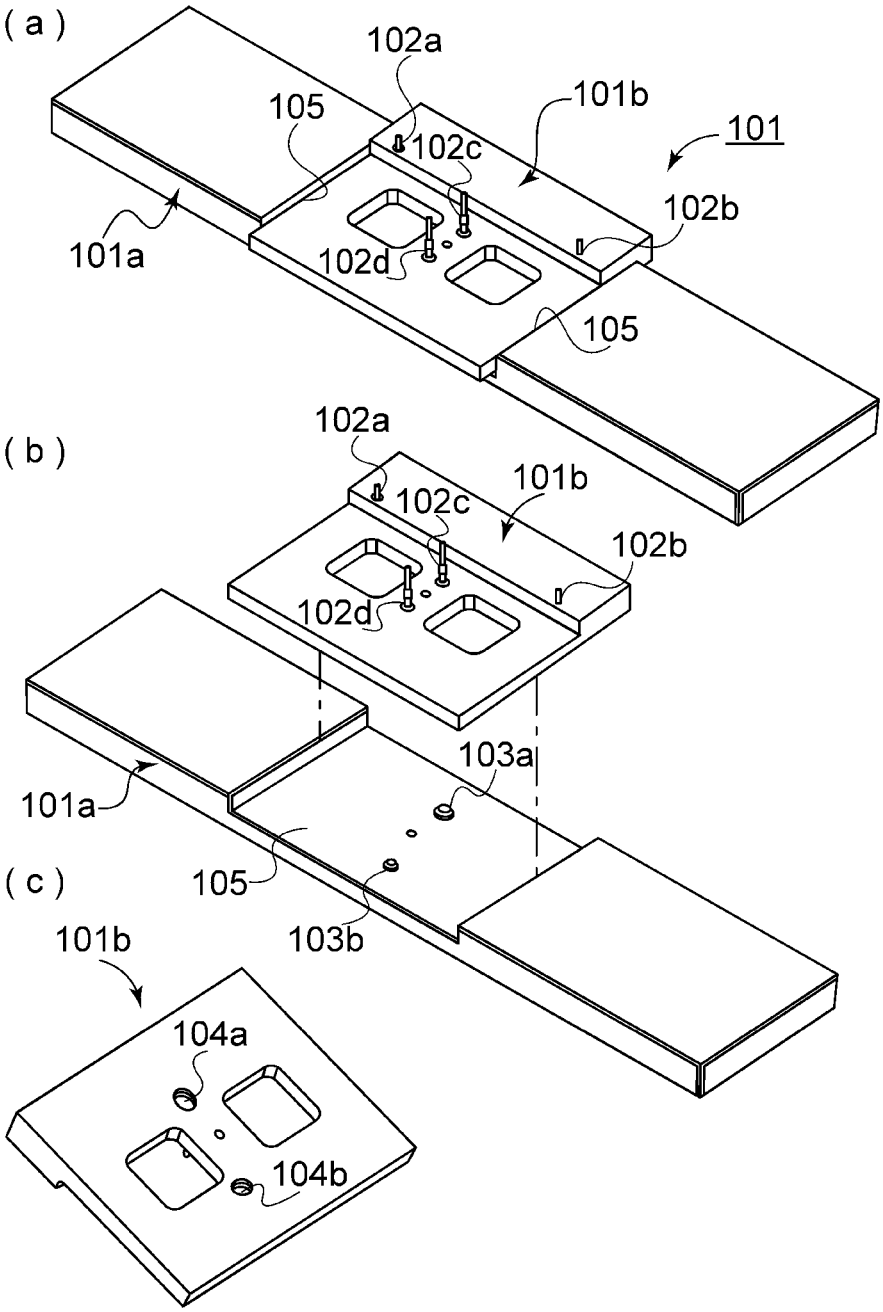

Parts (a) to (c) of FIG. 27 are illustration of jigs used in an assembling method of an air blowing cooling mechanism in Embodiment 6.

Parts (a) and (b) of FIG. 28, FIG. 29, FIG. 30, and FIG. 31 are perspective views for illustrating an assembling process of the air blowing cooling mechanism.

Figure 32:
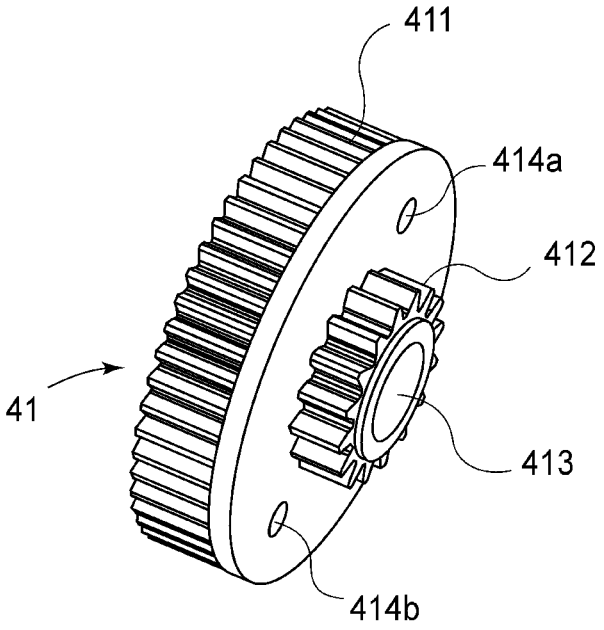

FIG. 32 is a perspective view of a driving pinion gear.

Figure 33:
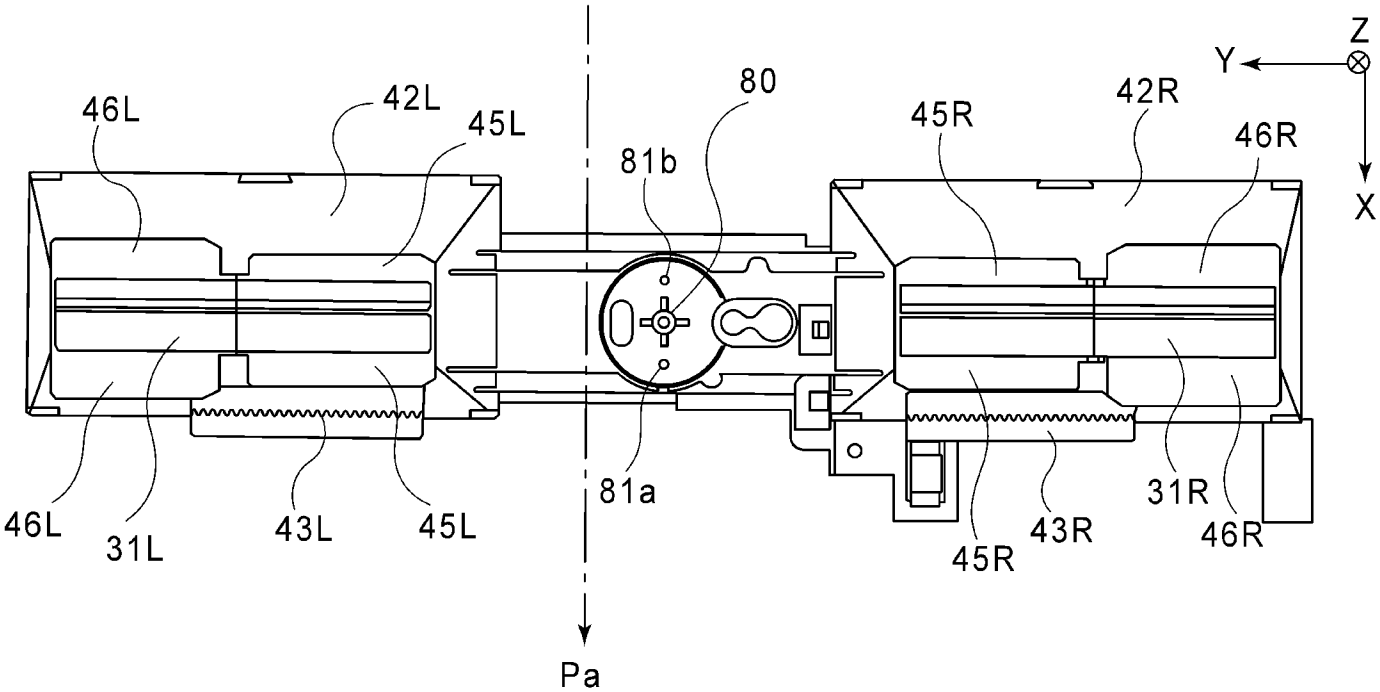

FIG. 33 is a schematic view showing a surface (duct lower surface) of a duct on an air blowing port side.

FIGS. 34 to 40 are perspective views for illustrating the assembling process of the air blowing cooling mechanism.

Figure 41:
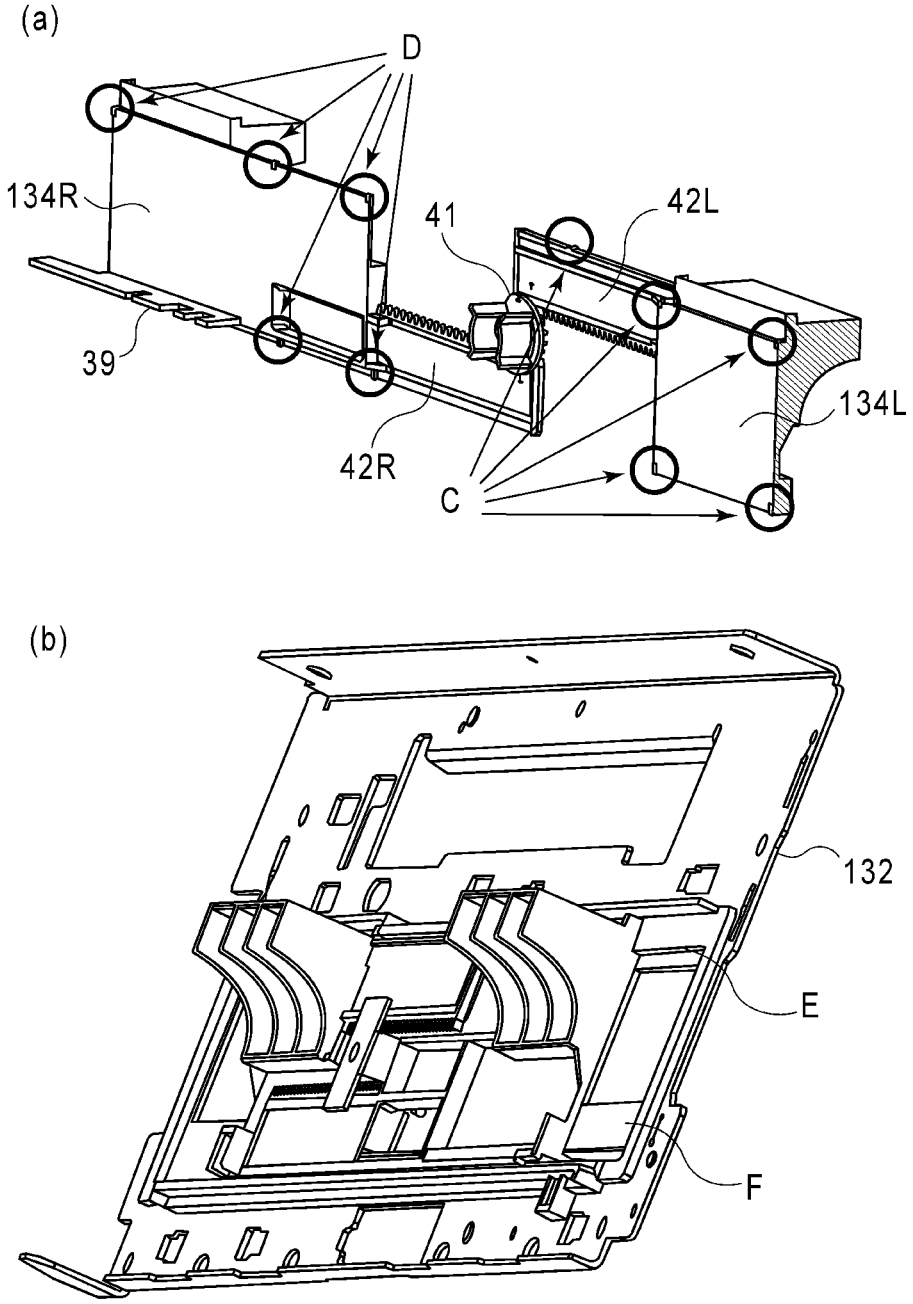

Parts (a) and (b) of FIG. 41 are illustrations of a reference example in Embodiments 4 and 5.

Figure 42:
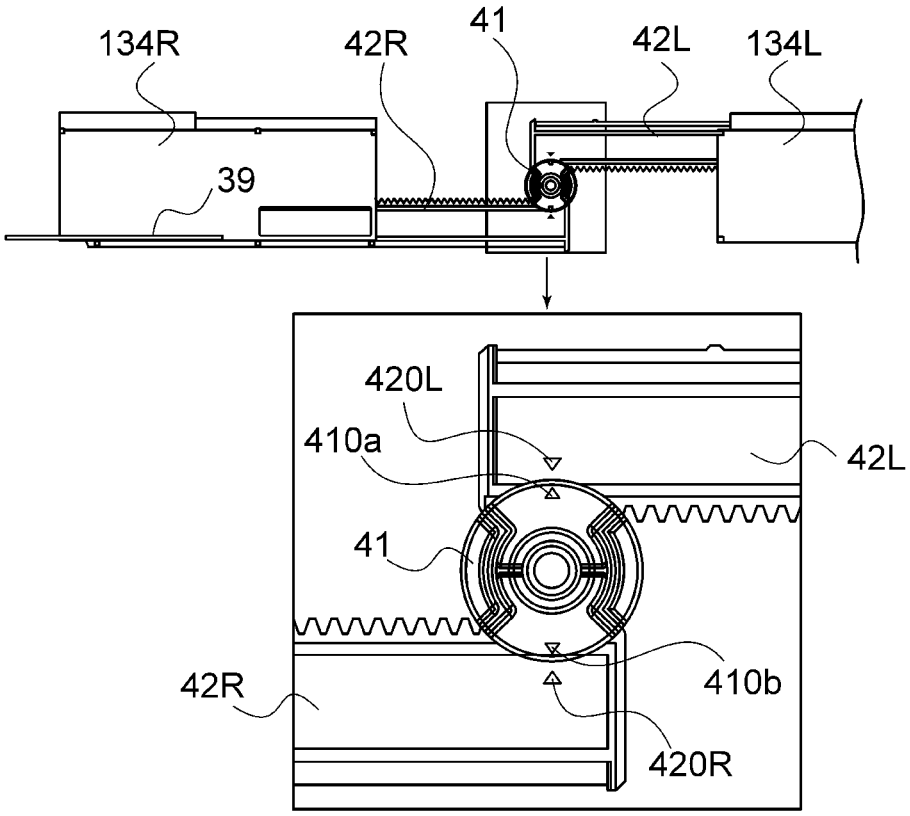

FIG. 42 is an illustration of a reference example in Embodiment 6.

DESCRIPTION OF EMBODIMENTS

Embodiments for carrying out the present invention will be specifically described with reference to the drawings. Dimensions, materials, shapes and relative arrangements of constituent elements described in the following embodiments should be appropriately be changed depending on structures and various conditions of mechanisms (apparatuses) to which the present invention is applied, and the scope of the present invention is not intended to be limited to the following embodiments.

Embodiment 1

Image Forming Apparatus

Figure 2:
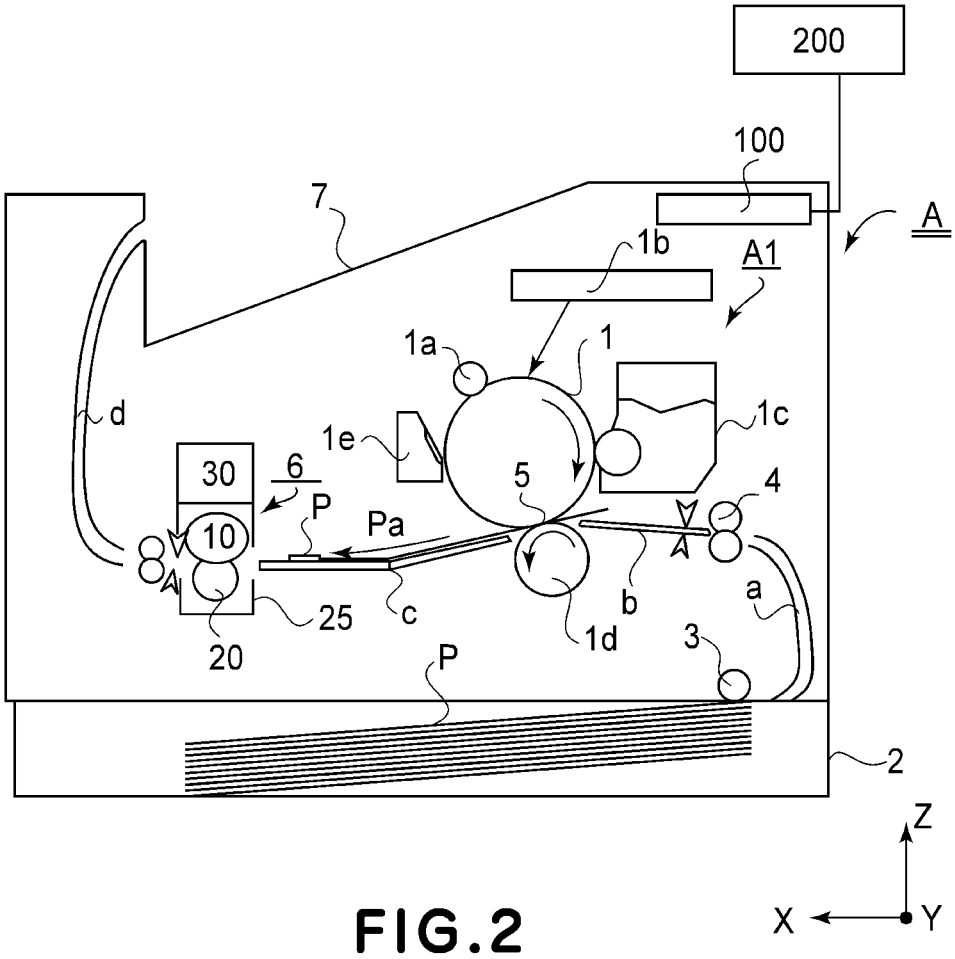
FIG. 2 is a schematic sectional view showing a general structure of an image forming apparatus in Embodiment 1.

FIG. 2 is a schematic sectional view showing a general structure of an example of an image forming apparatus A using electrophotography. In this embodiment, the image forming apparatus A is a monochromatic printer in which an image-formed product, on which a toner image was formed by executing an image forming operation corresponding to a print job input from an external host device 200, such as a personal computer, to a control circuit portion (CPU) 100, is printed out.

In the image forming apparatus A, an image forming portion A1 for forming the toner image on a sheet-shaped recording material P (sheet), which is a recording medium, includes a drum-type electrophotographic photosensitive member (drum) 1 as an image bearing member. The drum 1 is rotationally driven at a predetermined peripheral speed in the clockwise direction indicated by an arrow. Further, at a periphery of the drum 1 along a drum rotational direction, the image forming portion A1 includes, as process devices actable on the drum 1, a charging roller 1*a*, a laser scanner 1*b*, a developing device 1*c*, a transfer roller 1*d*, and a cleaning device 1*e*. An electrophotographic process and an image forming operation of the image forming portion A1 are well known, and, therefore, will be omitted from description.

Incidentally, the recording material P is a sheet-shaped recording medium (media) on which the toner image is capable of being formed by the image forming apparatus A. For convenience, treatment of the recording material (sheet) P will be described using sheet (paper)-related terms, such as sheet passing, sheet feeding, sheet discharge, sheet passing portion, and non-sheet-passing portion, but the recording material is not limited to paper.

One sheet P, of sheets P accommodated in a sheet cassette 2, is separated and fed at predetermined control timing by rotation of a feeding roller 3. The sheet P passes through a path including a feeding path a, a registration roller pair 4, and a feeding path b, and is introduced at predetermined control timing to a transfer portion (transfer nip) 5, which is a contact portion between the drum 1 and the transfer roller 1*d*. The sheet P is successively subjected to transfer of the toner image formed on the surface of the drum 1 during a process of being nipped and fed at the transfer portion 5.

Figure 1:
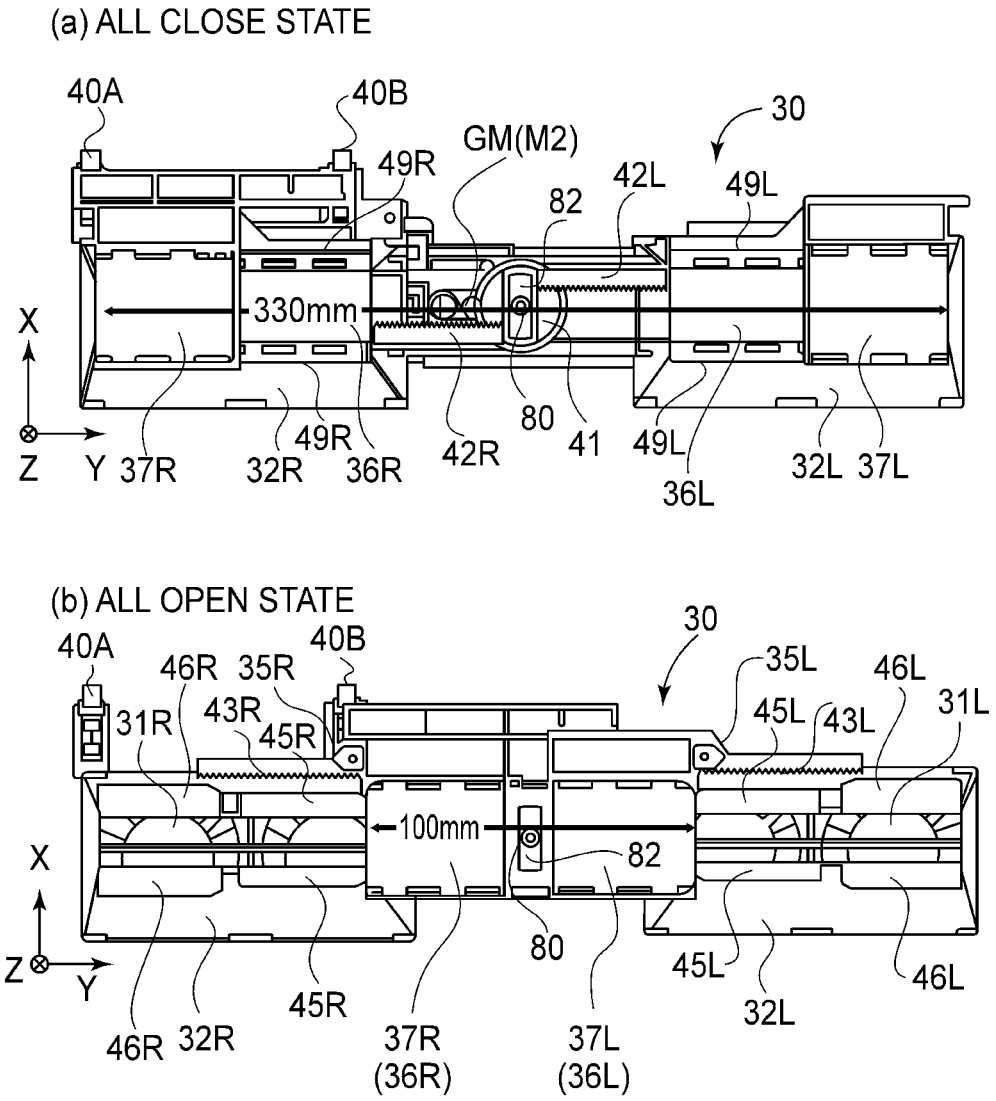

The sheet P coming out of the transfer portion 5 is separated from the surface of the drum 1 and passes through a feeding path c, and then is introduced into a fixing device (heating fixing device, image heating apparatus) 6, in which the toner image (image), formed on the sheet (recording material) P, is fixed on the sheet S under application of heat and pressure. The sheet P coming out of the fixing device 6 passes through a feeding path d and is discharged as the image-formed product onto a discharge tray 7. In FIG. 1, an arrow Pa direction is a sheet feeding direction.

Fixing Device

Here, with respect to the fixing device 6, a front surface (side) is a surface (side) on an introduction side of the sheet P, a rear surface (side) is a surface (side) opposite from the front surface (side), and left and right are left (L) and right (R) as seen from the front side. A longitudinal direction is an axial direction or a generatrix direction of a rotatable member, and a short side direction is a direction perpendicular to the longitudinal direction. Up (upper) and down (lower) are up (upper) and down (lower) with respect to a direction of gravitation. These are also true for constituent members of the fixing device 6.

Further, an upstream side and a downstream side are an upstream side and a downstream side with respect to the sheet feeding direction Pa. One end side and the other end side are one end side and the other end side with respect to the longitudinal direction, and in this embodiment, a left side is one end side (non-driving side, front side), and a right side is the other end side (driving side (on which a driving force is received), rear side). A width of the sheet P is a sheet dimension on a sheet surface with respect to a direction perpendicular to the sheet feeding direction Pa.

Figure 3:
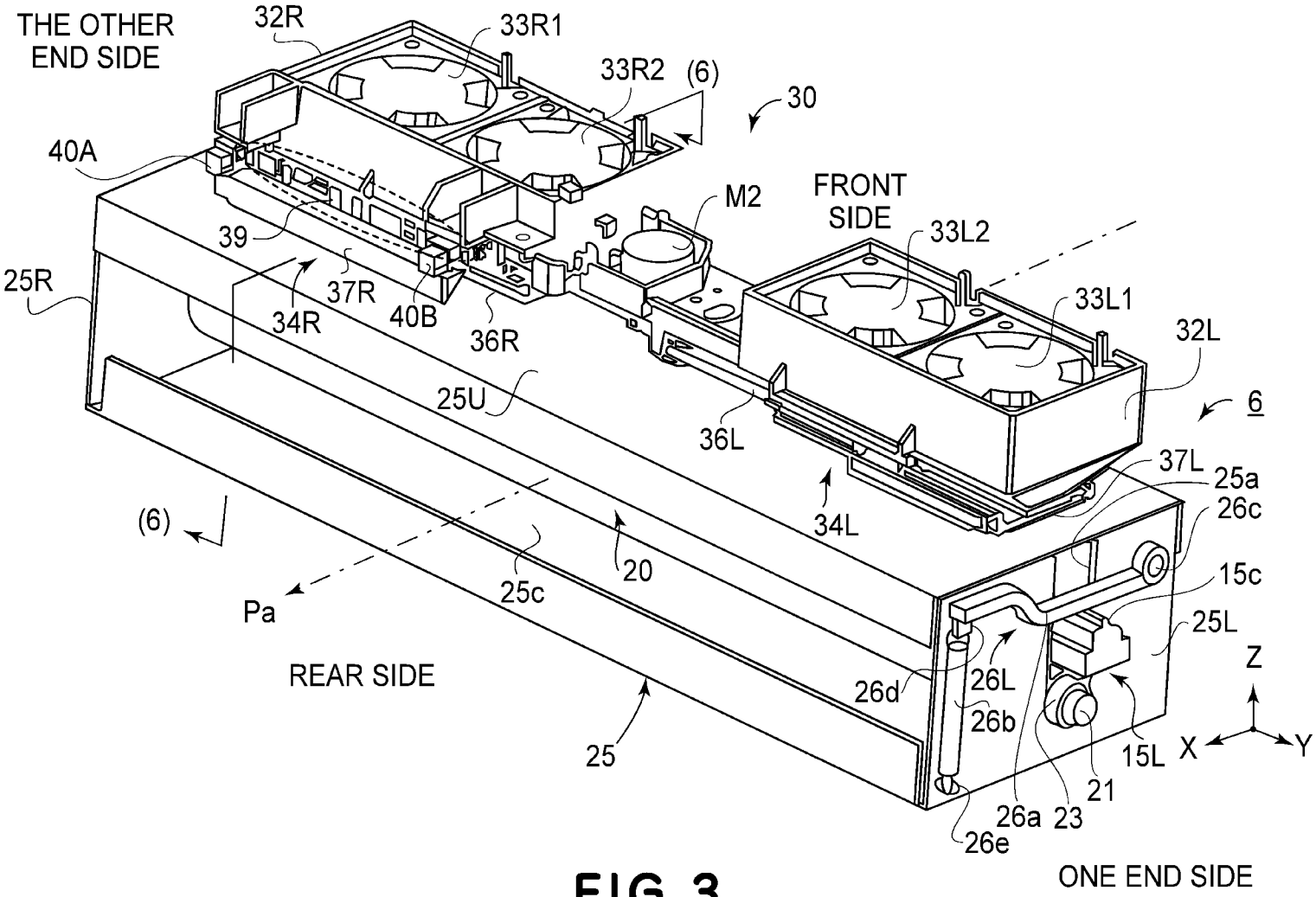
FIG. 3 is a schematic perspective view of an outer appearance of a fixing device on a rear side, one end side, and an upper surface side.
Figure 4:
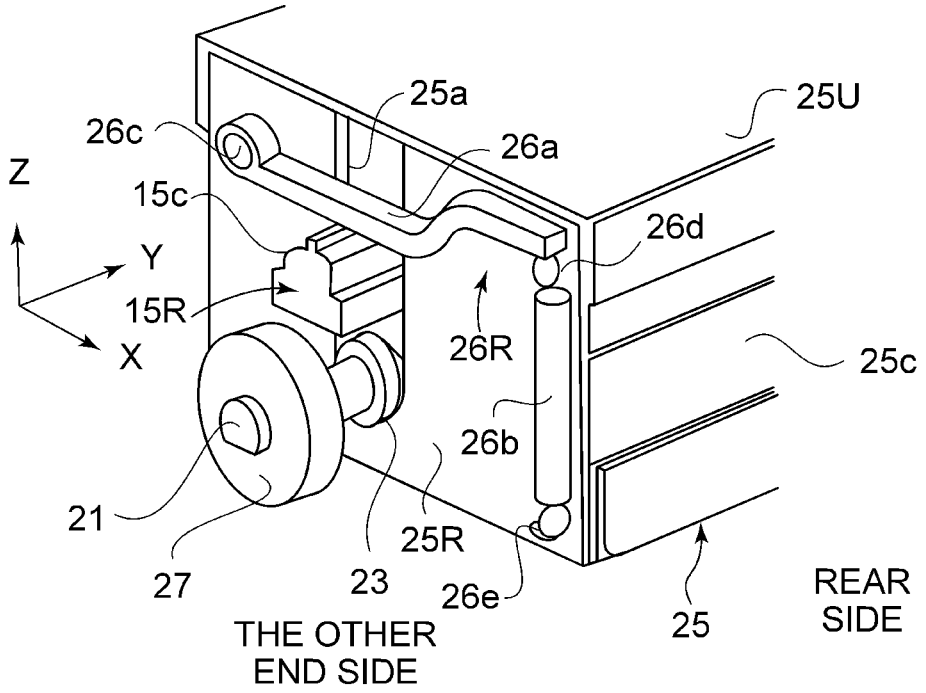
FIG. 4 is a schematic perspective view of an outer appearance of the fixing device on the other end side.
Figure 5:
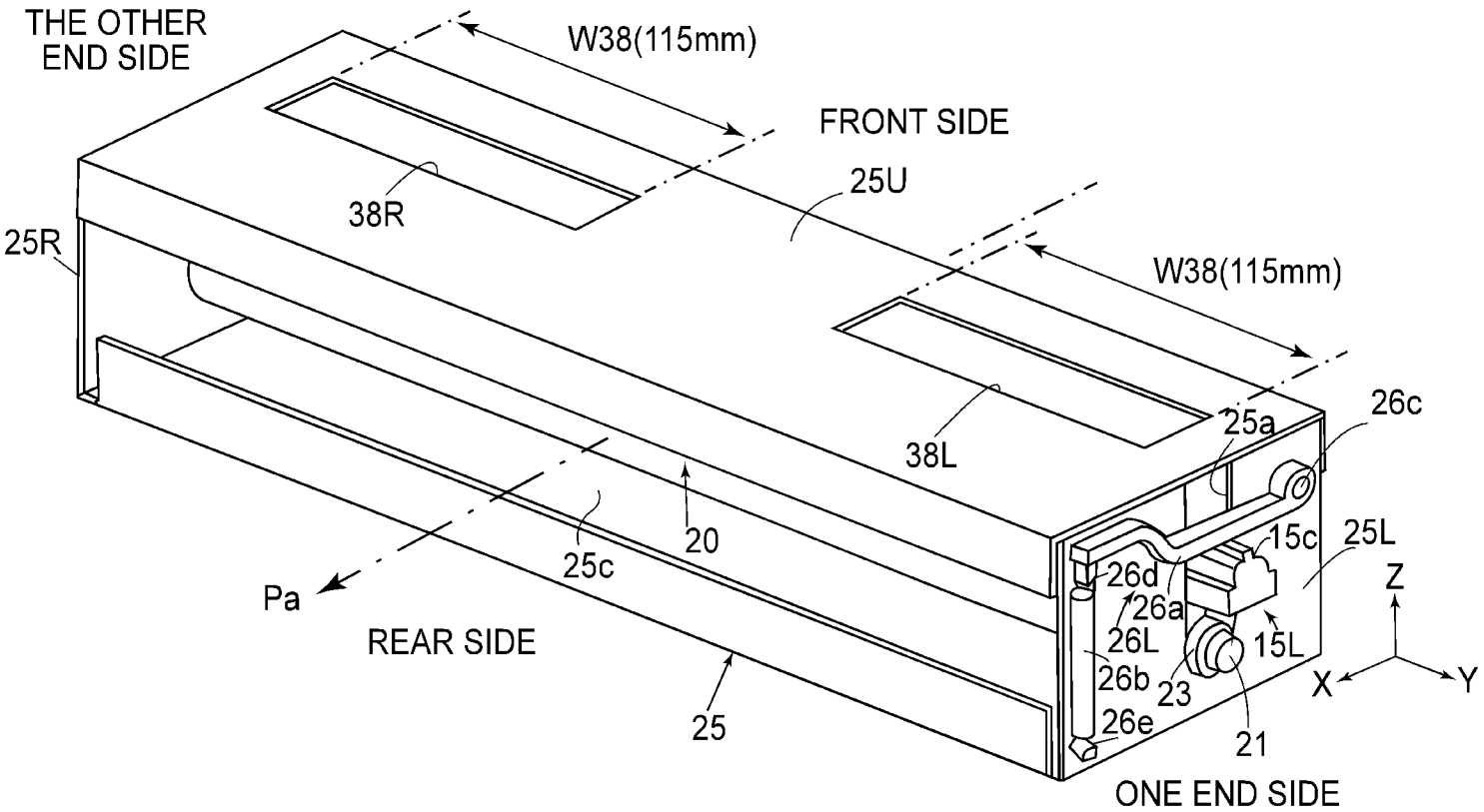
FIG. 5 is a schematic perspective view showing a state of the fixing device of FIG. 3 from which an air blowing cooling mechanism, provided on an upper surface side of a device frame, is removed.
Figure 6:
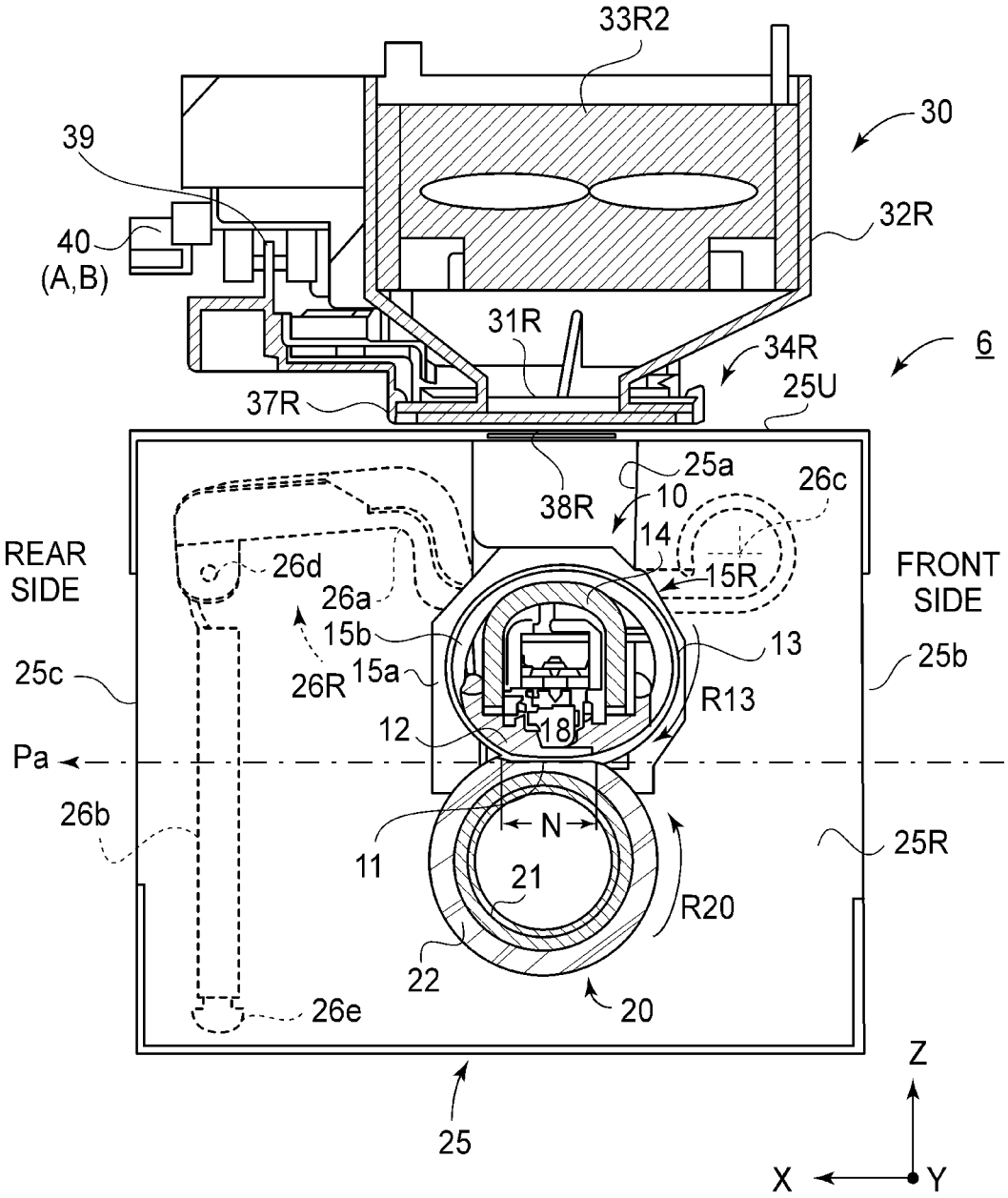
FIG. 6 is a schematic sectional view of the fixing device taken along (6)-(6) line of FIG. 3.
Figure 7:
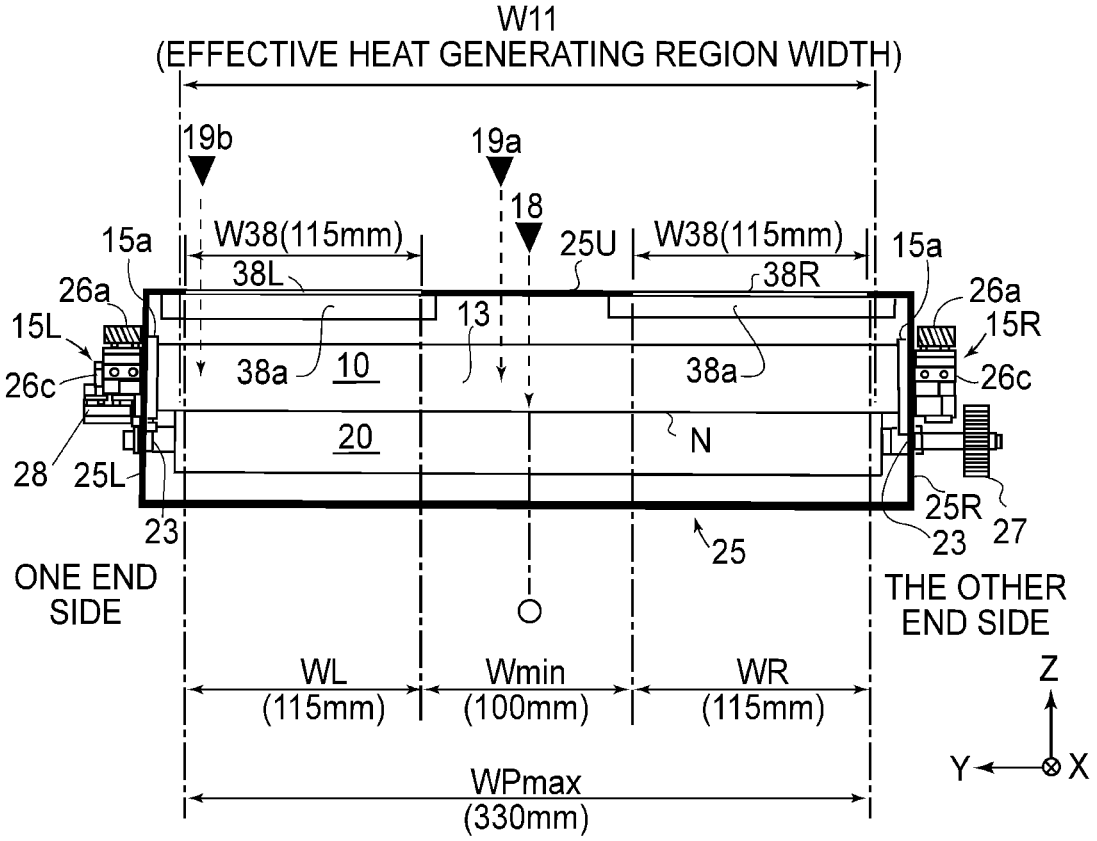
FIG. 7 is a schematic front view of the fixing device of FIG. 5, which is partially cut away.
Figure 8:
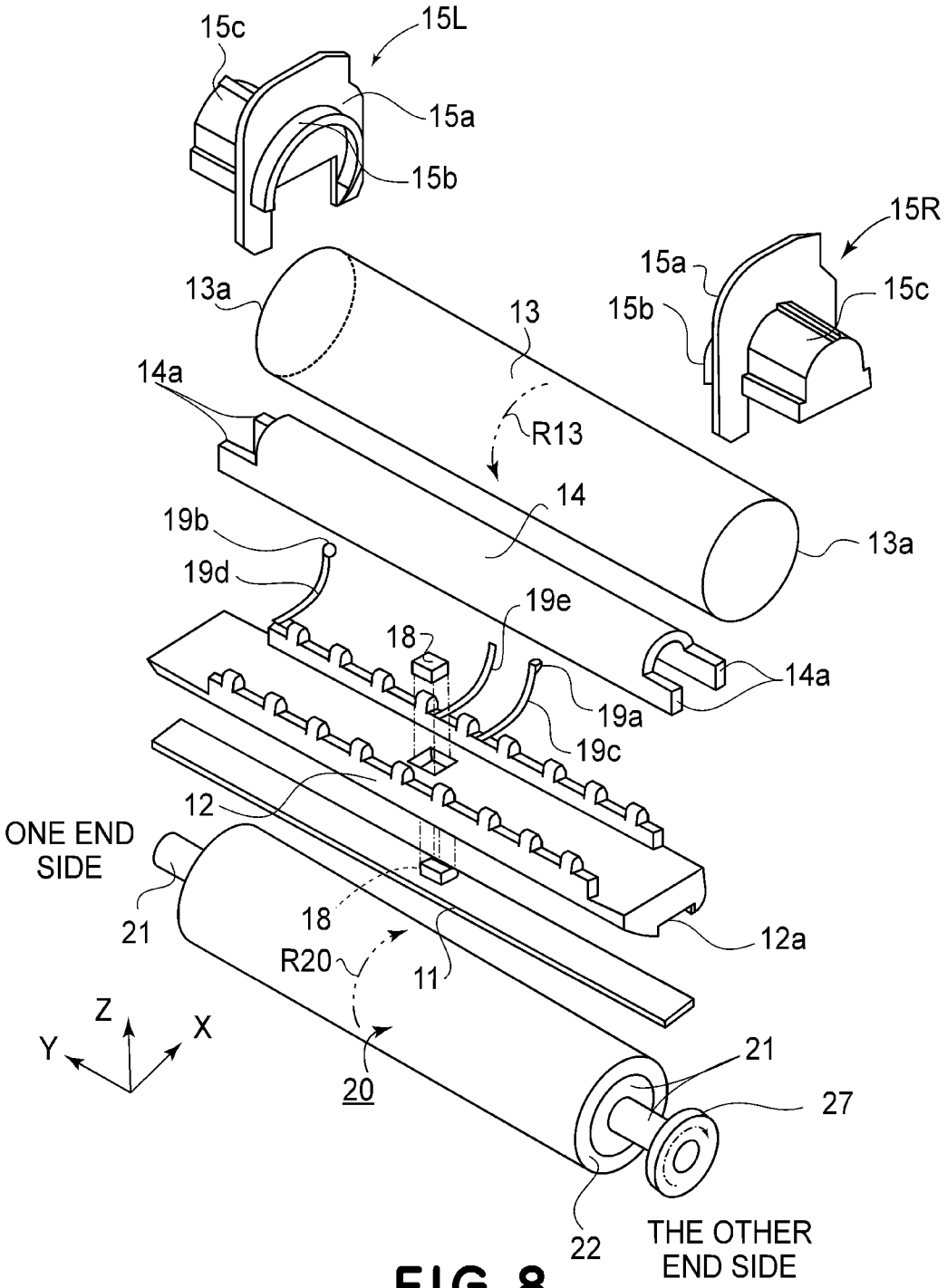
FIG. 8 is a schematic exploded perspective view of a fixing assembly (fixing member).
Figure 9:
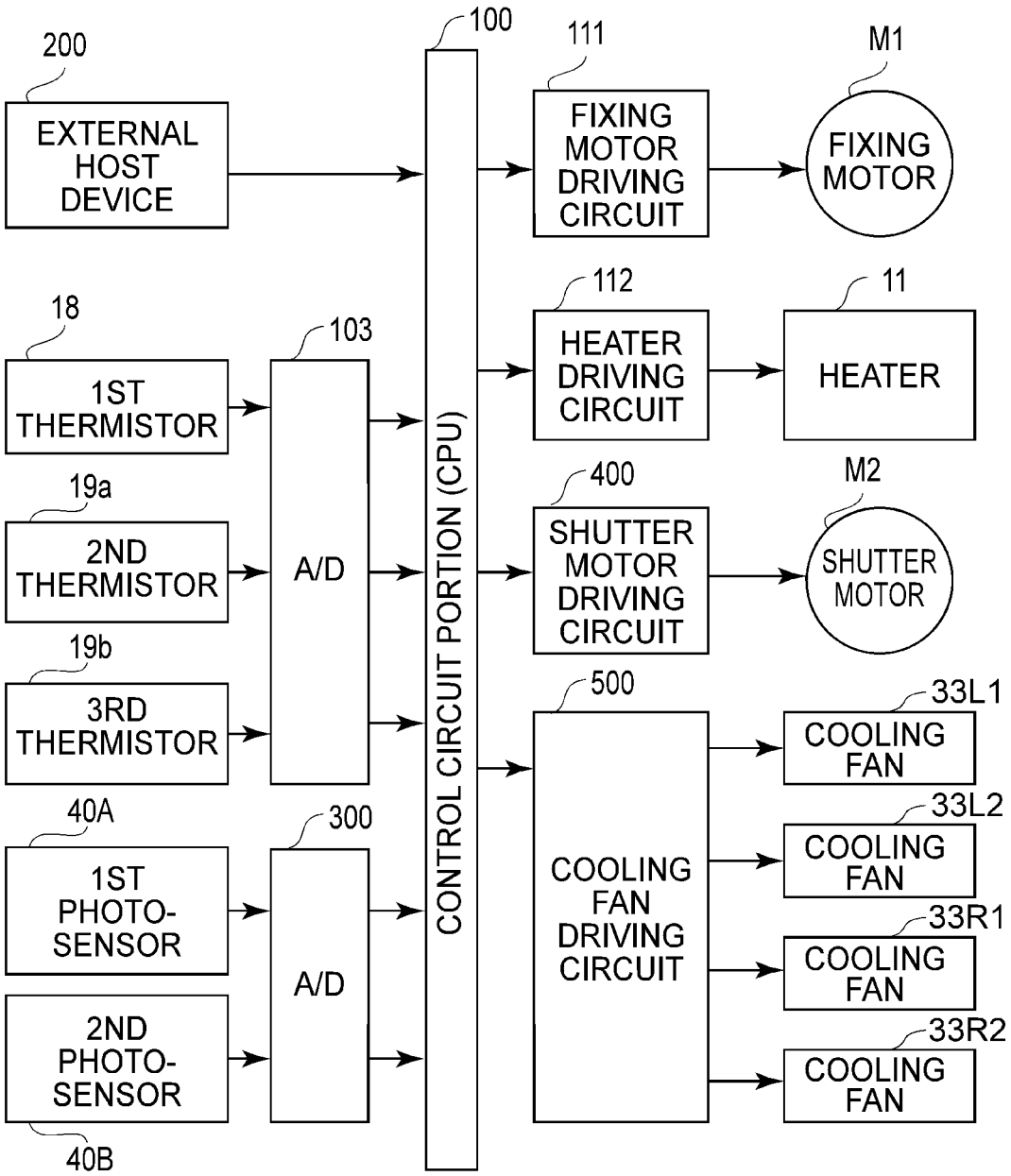
FIG. 9 is a block diagram of a control system principally of the fixing device.

FIG. 3 is a schematic perspective view of an outer appearance of the fixing device 6 on a rear side, one end side, and an upper surface side. FIG. 4 is a schematic perspective view of an outer appearance of the fixing device 6 on the other end side. FIG. 5 is a schematic perspective view showing a state of the fixing device 6 of FIG. 3 from which an air blowing cooling mechanism 30 provided on an upper surface side of a device frame is removed. FIG. 6 is a schematic sectional view of the fixing device 6 taken along (6)-(6) line of FIG. 3. FIG. 7 is a schematic front view of the fixing device 6 of FIG. 5, which is partially cut away. FIG. 8 is a schematic exploded perspective view of a fixing assembly. FIG. 9 is a block diagram of a control system principally of the fixing device 6.

This fixing device 6 is an image heating apparatus of a film heating type. The fixing device 6 roughly includes a fixing assembly (fixing member) 10 provided with a fixing film 13, a pressing roller (fixing member) 20 having elasticity, a (fixing) device frame (device casing) 25 accommodating these members 10 and 20, and an air blowing cooling mechanism 30. In the following description, the fixing assembly 10 is similarly referred to as the assembly 10. A nip (fixing nip) N is formed by cooperation between the fixing film 13 (rotatable heating member) and the pressing roller 20 (rotatable pressing member), which are used as a pair of rotatable members) (FIGS. 6 and 7).

The nip N is a portion in which the sheet P carrying thereon an unfixed toner image is nipped and fed, and thus, the toner image is fixed on the sheet P under application of heat and pressure. In the nip N, the fixing film (fixing belt) 13 contacts the surface of the sheet P on which the unfixed toner image is carried.

The assembly 10 is, as shown in FIG. 6, an assembly of a cylindrical (endless, endless belt-shaped) fixing film 13, a heater 11, a heat-insulating holder 12, a pressing stay (metal stay) 14, fixing flanges 15 (L, R), and the like. FIG. 8 is an exploded perspective view of this assembly 10, and the pressing roller 20 is also illustrated together with the assembly 10.

(1) Fixing Film

The fixing film (fixing belt, flexible sleeve, or, hereafter, referred to as a film) 13 is a thin endless heat transfer member having flexibility and a heat-resistant property, and assumes a substantially cylindrical shape in a free state thereof by its own elasticity.

The film 13 is a heat-resistant film of 200 μm or less in thickness in order to enable quick start. The film 13 is formed of, as a material of a base layer, a heat-resistant resin material, such as polyimide, polyamideimide, or polyether ether ketone (PEEK), or pure metal, having a heat-resistant property and a high heat transfer property, such as stainless steel (SUS), aluminum (Al), nickel (Ni), copper (Cu), or zinc (Zn), or an alloy of these metals.

In the case of the base layer made of the resin material, in order to improve the heat transfer property, heat transfer powder of boron nitride (BN), alumina, Al, or the like, may also be mixed in the base layer. Further, in order to constitute fixing device having a long lifetime, as a film 13 having sufficient strength and excellent in durability, the film 13 is required to have a total thickness of 100 μm or more. Therefore, as the total thickness of the film 13, a total thickness of 100 μm or more and 200 μm or less is an optimum thickness.

Further, in order to prevent offset and to ensure a separating property of the sheet P, as a surface layer, a parting layer made of a heat-resistant resin material having a good parting property, which is a fluorine-containing resin material, such as polytetrafluoroethylene (PTFE), tetrafluoroethylene-perfluoroalkylvinyl ether copolymer, (PFA), tetrafluoroethylene-hexafluoropropylene copolymer (FEP), ethylenetetrafluoroethylene copolymer (ETFE), polychlorotrifluoroethylene (CTFE), or polyvinylidene difluoride (PVDF), or a silicone resin material is formed and coated on the base layer singly or in mixture. In this embodiment, the surface layer is constituted by a material at least containing PTFE and PFA.

As a coating method, the parting layer may be coated on an outer surface of the film 13 after being subjected to etching, by dipping, powder spraying, or the like. Alternatively, a method in which the surface of the film 13 is coated with a resin material formed in a tube shape may also be employed. In addition, a method in which the outer surface of the film 13 is subjected to blasting and, thereafter, a primer layer of an adhesive is coated on the blasted surface of the film 13, and then, the parting layer is coated on the primer layer may also be employed.

(2) Heater

The heater 11 is an elongated plate-shaped heat generating element, in which a full length portion having an effective heat generating region width W11 (FIG. 7), is abruptly increased in temperature by energization, and which has low thermal capacity, and is a ceramic heater in this embodiment. In this heater 11, the heat generating element (heat generating resistor, an energization heat generating resistor layer) is formed by printing electroconductive paste of silver palladium (Ag—Pd), or the like, in a thick film (layer) on an elongated thin plate-shaped substrate (ceramic substrate) of aluminum nitride (AlN) having a good heat-transfer property.

Then, on the heat generating elements, as a slidable insulating member, a glass coating layer, having a thickness of about 50 μm to 60 μm, is provided integrally with the heat generating element, so that the ceramic heater is constituted. In this embodiment, the glass coating layer side is a heater front surface side and the ceramic heater contacts an inner surface of the film 13 on this side.

The heat generating element is formed along the longitudinal direction of the substrate in a length corresponding to a width of a maximum-width size sheet usable in the fixing device or a length greater than the above length by a predetermined distance. A length range of this heat generating element is the effective heat generating region width W11 of the heater 11. In the heater 11, on the substrate (on the heater rear surface side) opposite from a side on which the heat generating element is provided, a chip-shaped thermistor (first thermistor) 18 (FIGS. 6 and 8), as a temperature detecting element, is provided while sandwiching between itself and the heat generating element. This thermistor 18 is fixed to the substrate (heater rear surface) with a predetermined pressure by a pressing means (not shown), such as a spring.

(3) Heating Insulating Holder

The heat insulating holder (heater holding member, hereafter referred to as a holder) 12 is an elongated member extending along the longitudinal direction (widthwise direction) of the film 13 and is formed of a heat-resistant resin material, such as a liquid crystal polymer, a phenolic resin, PPS or PEEK. With a decreasing thermal conductivity, heat of the heater 11 is less taken, so that heat can be efficiently conducted to the film 13, and therefore, a filler such as a glass balloon or a silica balloon may also be incorporated in the resin layer. The heater 11 is engaged in and held by a groove 12*a* (FIG. 8) formed on a lower surface of the holder 12 along the longitudinal direction of the holder 12 in a state in which a front surface thereof faces the inner surface of the film 13. Further, the movement 12 also has a function of guiding rotation of the film 13.

(4) Pressing Stay

The pressing stay 14 is a rigid member that extends along the longitudinal direction of the film 13 and that receives a reaction force from the pressing roller 20, and may desirably be formed of a material that is not readily flexed even under application of a high pressure. In this embodiment, the stay 14 is a metal stay and uses a molded member of SUS 304 having a U-shape in cross section. The stay 14 is provided on an upper surface side of the holder 12 and contacts the holder 12, so that flexure and twisting of an entirety of the assembly 10 are suppressed.

(5) Fixing Flanges

The film 13 is externally engaged (fitted) loosely with an assembly (assembled member) of the heater 11, the holder 12 and the stay 14. Both end portions 14*a* (FIG. 8) of the stay 14 project toward outsides of the film 13 thermistor openings formed at both end portions of the film 13, fixing flanges 15 (L, R) on one end side and the other end side, respectively, are engaged with the associated end portions 14*a*, respectively, of the stay 14. The film 13 is positioned between opposing end portion regulating (preventing) surfaces (opposing collar seat portions) 15*a* of the engaged flanges 15 (L, R).

The flanges 15 (L, R) are regulating (preventing) members for regulating (preventing) movement of the film 13 in the longitudinal direction and a shape of the film 13 with respect to a circumferential direction, and are molded products of a heat-resistant resin material, such as polyphenylene sulfide (PPS), the liquid crystal polymer, the phenolic resin, or the like. Each of the flanges 15 (L, R) includes the end portion regulating surface 15*a*, an inner periphery regulating surface 15*b* and a portion-to-be-pressed (pressure-receiving portion) 15*c*.

(6) Pressing Roller

The pressing roller 20, as the rotatable member, is an elastic roller including a metal core 21 formed of SUS, SUM (sulfur and sulfur composite free-cutting steels), Al, or the like, and including an elastic layer 22, formed outside the core metal 21, such as an elastic solid rubber layer, an elastic sponge rubber layer, or an elastic foam rubber layer.

Here, the elastic solid rubber layer is formed of a heat-resistant rubber, such as a silicone rubber or a fluorine-containing rubber. Further, the elastic sponge rubber layer is formed by foaming a silicone rubber in order to impart a heat-insulating effect. Further, the elastic foam rubber layer is formed by dispersing a hollow filler (microballoons, or the like) in a silicone rubber layer, so that a hardened product is provided therein with a gas portion and thus, the heat-insulating effect is enhanced. On these layers, a parting layer of a perfluoroalkoxy resin (PFA), polytetrafluoroethylene resin (PTFE), or the like, may also be formed.

The pressing roller 20 is supported between side plates 25 (L, R) on one end side and the other end side of the device frame 25 so as to be rotatable via bearings 23 on one end side and the other end side of the metal core 21.

The assembly 1 is disposed between the side plates 25 (L, R) in parallel to the pressing roller 20 so that the heater 11 side is opposed to an upper side of the pressing roller 20. The flanges 15 (L, R) in the assembly 10 are engaged with guiding holes 25*a* formed symmetrically in the side plates 25 (L, R) so that the portions-to-be-pressed 15*c* thereof are slidable (movable) in a direction toward the pressing roller 20.

Then, the flanges 15 (L, R) receive predetermined pressing forces in the direction toward the pressing roller 20 at the portions-to-be-pressed 15*c* by pressing arms 26*a* of a pressing mechanism 26 on one end side and the other end side. By the pressing forces, an entirety of the flanges 15 (L, R), the stay 14, the holder 12, and the heater 11 of the assembly 10 is pressed in the direction toward the pressing roller 20. For that reason, a part of the heater 11 and a part of the holder 12 are pressed toward the pressing roller 20 through the film 13 against elasticity by the predetermined pressing forces. As a result, the nip N with a predetermined width with respect to the sheet feeding direction Pa is formed between the film 13 and the pressing roller 20.

Referring to FIGS. 3 and 4, outside the side plates 25 (L, R) on one end side and the other end side of the frame 25, the pressing mechanisms 26 (L, R) on one end side and the other end side are provided, respectively. These pressing mechanisms 26 (L, R) have a mirror symmetrical constitution and have the same structure.

Each of the pressing mechanisms 26 (L, R) includes a pressing lever (arm) 26*a* and a pressing spring 26*b*. The lever 26*a* is mounted to the associated one of the side plates 26 (L, R) on a base portion side thereof so as to be swingable about a shaft portion 26*c*. The lever 26*a* extends from the shaft portion 26*c* to a side opposite from the shaft portion 26*c* side via an upper side of the associated one of the portions-to-be-pressed 16*c* of the flanges 15 (L, R).

The spring 26*b* is an elastic member for rotationally urging the lever 26*a* about the shaft portion 26*c* in a pressing (urging) direction by bringing the lever 26*a* into contact with the associated one of the portions-to-be-pressed 15*c* of the flanges 15 (L, R). In this embodiment, the spring 26*b* is stretched between a free end portion 26*d* and a pin shaft 26*e* implanted in the associated one of the side plates 26 (L, R). Accordingly, the lever 26*a* is contacted to the associated one of the portions-to-be-pressed 15*c* of the flanges 15 (L, R) by a tensile force of the spring 26 and imparts the predetermined pressing force to the associated portion-to-be-pressed 15*c*.

The lever 26*a* is supported rotatably relative to the associated one of the side plates 15 (L, R), so that rotational moment generates about the shaft portion 26*c* by the tensile force of the spring 26*b* and thus the associated one of the flanges 15 (L, R) is pressed in the direction toward the pressing roller 20 by the pressing force.

(7) Fixing Operation

On the other end side (driving side) of the metal core 21 of the pressing roller 20, a driving gear 27 (FIGS. 4 and 8) is provided concentrically integral with the metal core 21. To this gear 27, a driving force of a fixing motor (driving source) M1, driven by a fixing motor driving circuit 111 controlled by the control circuit portion 100 (FIG. 9), is transmitted through a drive transmitting mechanism (not shown). As a result, the pressing roller 20 is rotationally driven as a rotatable driving member at a predetermined speed in the counterclockwise direction of an arrow R20 shown in FIG. 6.

By rotationally driving the pressing roller 20, rotational torque acts on the film 13 in the nip N by a frictional force between the film 13 and the pressing roller 20. The pressing roller 20 functions as a rotatable member for rotating the film 13. The film 13 is rotated by the pressing roller 20. As a result, the film 13 is rotated around the assembly of the heater 11, the holder 12 and the stay 14 in the clockwise direction of an arrow R13 shown in FIG. 6, while an inner surface of the film 13 slides on the part of the heater 11 and the part of the holder 12 in the nip N in close contact with the part of the heater 11 and the part of the holder 12. A rotational peripheral speed of the film 13 substantially corresponds to a rotational peripheral speed of the pressing roller 20.

The end portion regulating (preventing) surfaces 15*a* of the flanges 15 (R, L) operation end surfaces (edge surfaces) 13*a* (FIG. 8) of the rotating film 13 and thus, prevent movement of the film 13 in the longitudinal direction (thrust direction) of the film 13. The inner periphery regulating surfaces 15*b* are guiding surfaces for supporting an inner peripheral surface of the film 13 at end portions of the film 13 from an inside of the film 13, and are provided as arcuately projected edge portions toward the inner surface side of the flanges 15 (R, L). Between the film 13 and the heater 11, a lubricant, such as heat-resistant grease of a fluorine-containing type, a silicone type, or the like, is interposed, whereby a friction resistance is suppressed to a low level and thus, the film 13 is rotatable (movable) smoothly.

The control circuit portion 100 controls a heater driving circuit portion 112 and thus, starts energization to the heater 11. Although an energization path from the heater driving circuit portion 112 toward the heater 11 is omitted from illustration, the energization is carried out via wiring electrically connecting the heater driving circuit portion 112 with the heater 11 and a connector 28 (FIG. 7). By this energization, a full length region of the effective heat generating region W11 (FIG. 7) of the heater 11 abruptly increases in temperature.

A temperature of the heater 11 is detected by the first thermistor 18 provided on the rear surface of the heater 11, so that detection temperature information is input to the control circuit portion 100 through an analog/digital (A/D) converter 103. Further, inner surface temperatures of the film 13 rotating while being heated by the heater 11 are detected by second and third thermistors 19*a* and 19*b* (FIGS. 7 and 8), so that pieces of detection temperature information are input to the control circuit portion 100 through the A/D converter 103.

The control circuit portion 100 determines and appropriately controls a duty ratio, wave number, and the like, of a voltage applied from the heater driving circuit 112 to the heater 11, depending on the pieces of the detection temperature information (outputs) input from the first to third thermistors 18, 19*a* and 19*b*. As a result, the temperature in the nip N is increased to a predetermined fixing set temperature, so that temperature control is carried out.

In the above state of the fixing device 6, the sheet P, on which the unfixed toner image is formed, is introduced from the image forming portion A1 into the fixing device 6 through an introducing port 25*b* (FIG. 6) on the front side of the frame 25, and is nipped and fed through the nip N. To the sheet P, heat of the heater 11 is imparted through the film 13 in a process in which the sheet P is nipped and fed through the nip N. The unfixed toner image is melted by the heat of the heater 11 and is fixed as a fixed image on the sheet P by heat and pressure applied to the nip N. Then, the sheet P coming out of the nip N is discharged to an outside of the fixing device 6 through a discharging port 25*c* of the device frame 25.

Incidentally, inside the frame 25, a sheet guiding member, a sheet sensor, and the like, are provided between the introducing port 25*b* and the nip N, and a sheet guiding member, a discharging roller pair, a sheet sensor, and the like, are provided between the nip N and the discharging port 25*c*, but these members are omitted from the figures.

Here, in this embodiment, the sheet P is fed to the fixing device 6 on a so-called center (line) feeding basis. Here, center (line) feeding refers to a method in which, when sheets different in size are fed, these sheets are fed so that centers (center lines) of the respective sheets with respect to the widthwise direction (perpendicular to the recording material (sheet) feeding direction) of the sheets coincide with each other. In FIG. 7, "0" represents a reference line (center reference line, phantom line) as the center line in the center (line) feeding.

In FIG. 7, "WPmax" is a sheet passing region width of a maximum width sheet usable in the apparatus. In this embodiment, the width of the maximum width sheet usable in the apparatus is 330 mm. "WPmin" is a sheet passing region width of a minimum width sheet usable in the apparatus. In this embodiment, the width of the minimum width sheet usable in the apparatus is 100 mm, which is a postcard width. In the case in which the minimum width sheet is fed by the center (line) feeding (sheet passing) basis, with respect to the widthwise direction, non-sheet-passing portions exist outside WPmin on both sides (one end side and the other end side).

The effecting heat generating region width W11 of the heater 11 is set so as to be equal to the sheet passing region width WPmax or greater than the sheet passing region width WPmax by a predetermined width. The first thermistor 18 is disposed in contact with the rear surface of the heater 11 at a heater rear surface position substantially corresponding to the center reference line O.

The second thermistor 19*a* detects the film temperature in contact with the inner surface of the film 13 at a position that is downstream of the nip N with respect to the film rotational direction and that substantially corresponds to the center reference line O. The third thermistor 19*b* detects the film temperature in contact with the inner surface of the film 13 at a position that is downstream of the nip N with respect to the film rotational direction and that substantially corresponds to an inside position of an end of the sheet passing region width WPmax.

That is, the second thermistor 19*a* detects a temperature of a film portion corresponding to a portion within the sheet passing region width WPmax that is a sheet passing portion common to any sheets having large and small (various) sizes usable in the apparatus. The third thermistor 19*b* detects a temperature of a film portion corresponding to the non-sheet-passing portion when a sheet narrower in width than the maximum width sheet is passed through the nip N (FIG. 7).

The second and third thermistors 19*a* and 19*b* are supported at free end portions of elongated spring members 19*c* and 19*d*, respectively (FIG. 8). Base portions of the spring members 19*c* and 19*d* are fixed to the holder 12. That is, the second and third thermistors 19*a* and 19*b* are supported by the spring members 19*c* and 19*d*, respectively, so as to elastically contact and slide with the inner surface of the film 13. Further, the second and third thermistors 19*a* and 19*b* are mounted so that, in a free state, free ends thereof project with a spring property to an outside of a projection shape of the film 13 during mounting of the film 13.

Further, the stay 14 made of metal is provided with a grounding member 19*e* (FIG. 8) contacting the inner surface of the film 13 in the neighborhood of the second thermistor 19*a* for the purpose of establishing the grounding of the film 13. The grounding member 19*e* is an elongated spring member in which a base portion is electrically conducted to the stay 14 and a free end portion slides with the inner surface of the film 13 in elastic contact with the film inner surface. This grounding member 19*e* is also mounted similarly as in the case of the second and third thermistors 19*a* and 19*b* so that, in a free state, a free end thereof projects with a spring property to the outside of the projection shape of the film 13 during the mounting of the film 13.

Air Blowing Cooling Mechanism

The air blowing cooling mechanism (also referred to as a cooling mechanism) 30 will be described. The air blowing cooling mechanism 30 is a cooling means for preventing the non-sheet-passing portion temperature rise of the assembly 10 occurring when sheets narrower in width than the maximum width sheet usable in the apparatus are continuously passed through the nip N. The air blowing cooling mechanism 30 includes ducts provided with air blowing ports and fans for blowing air toward the air blowing ports through the ducts in order to cool predetermined regions of the film 13 that is the rotatable heating member. Further, the air blowing cooling mechanism 30 includes a first shutter member having a first surface for closing the air blowing port in a closing position for closing the air blowing port and includes a second shutter member having a second surface for closing the air blowing port in a closing position for closing the air blowing port.

The air blowing cooling mechanism 30 is supported by a supporting member (not shown) on an upper side of an upper surface plate (to plate) 25U of the frame 25 and is provided close to the upper surface plate 25U in a predetermined manner. The air blowing cooling mechanism 30 has an inlet port surface on the upper side thereof and an air blowing port surface on a lower side thereof, and the air blowing port surface of the air blowing cooling mechanism 30 is provided opposed to and in proximity to the upper surface of the upper surface plate 25U in a predetermined manner.

Figure 10:
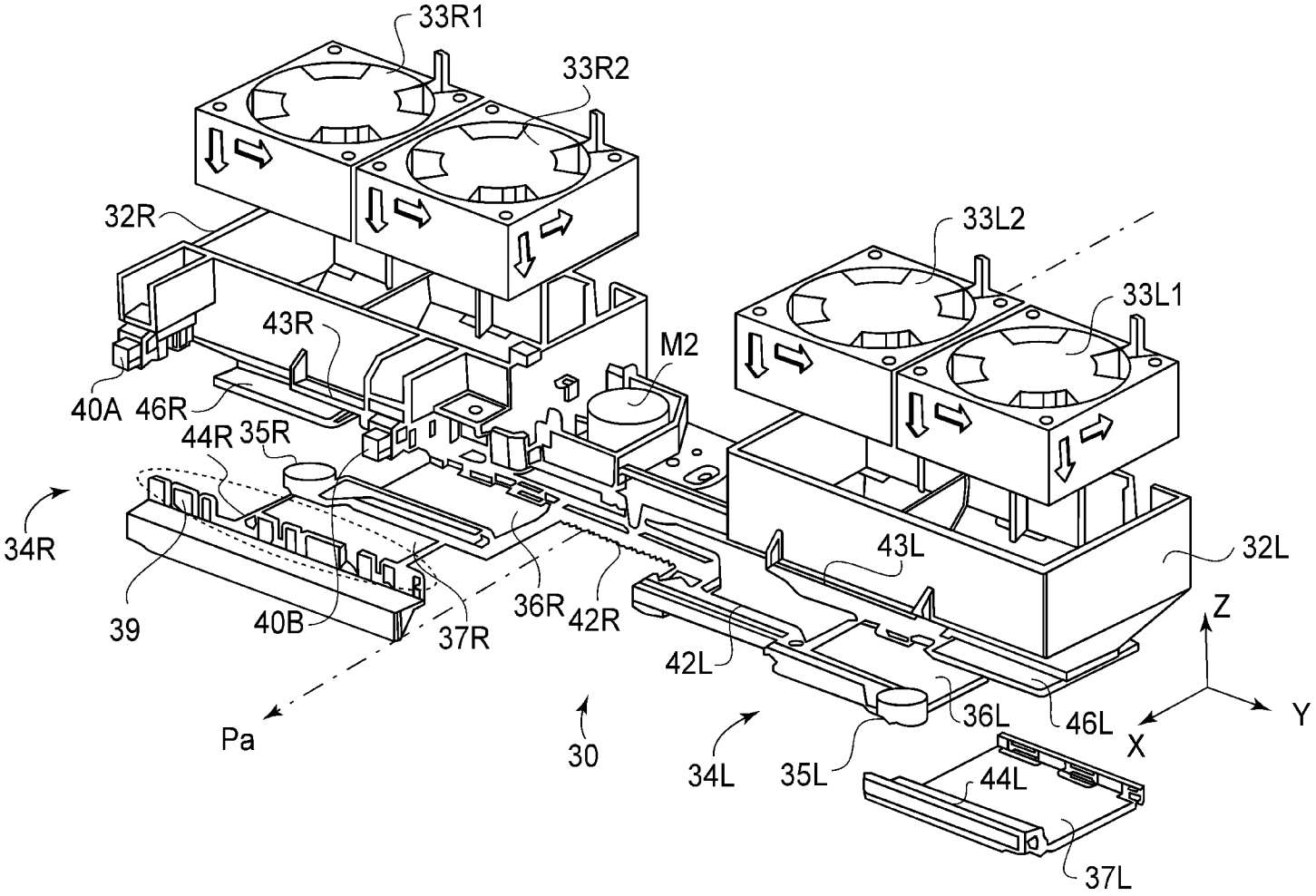
FIG. 10 is an exploded perspective view of the air blowing cooling mechanism of FIG. 3 as seen from an inlet (intake) port side.
Figure 11:
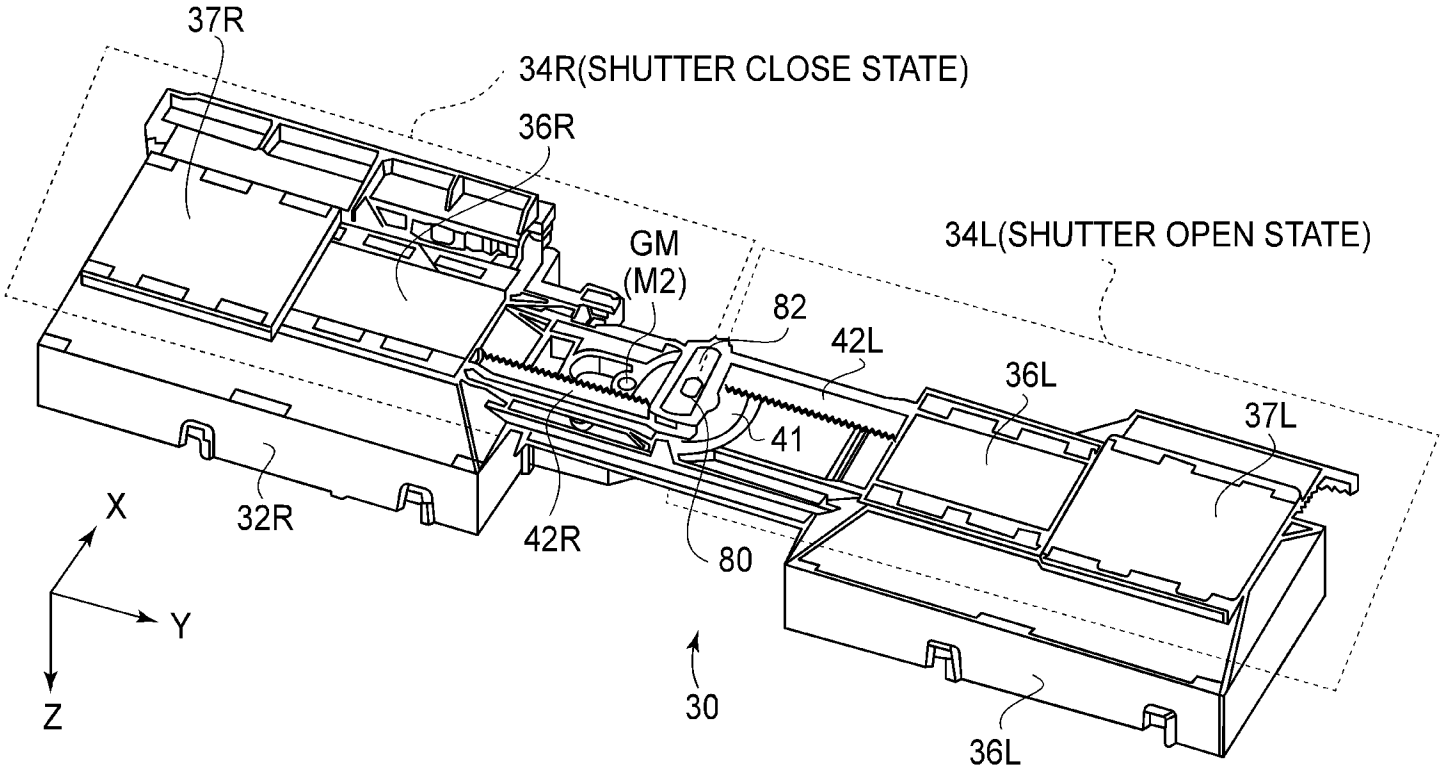
FIG. 11 is a perspective view of the air blowing cooling mechanism of FIG. 3, which is turned upside down, and which is as seen from an air blowing port side, in which a shutter mechanism is in a shutter member close state.
Figure 12:
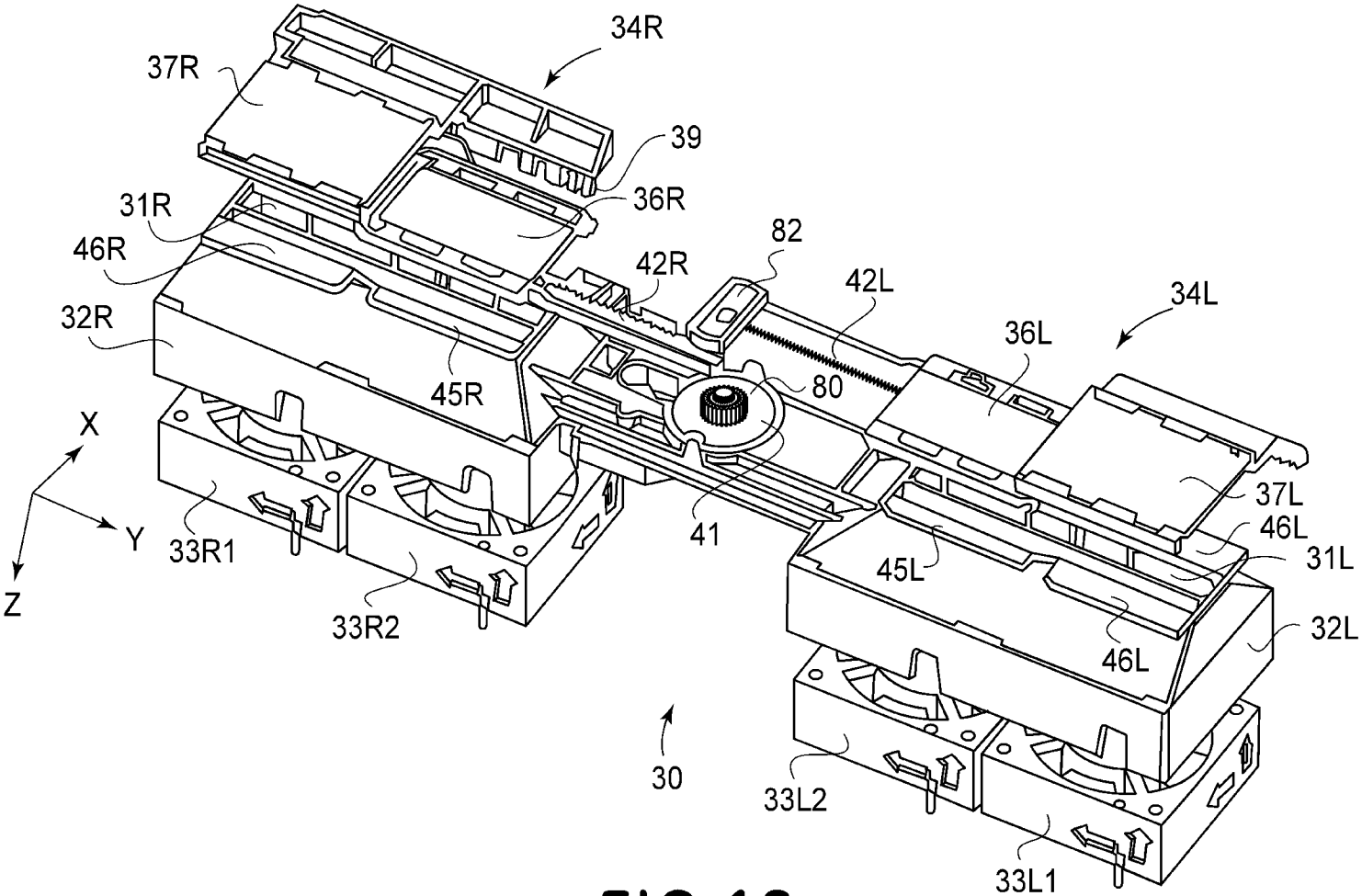
FIG. 12 is an exploded perspective view of the air blowing cooling mechanism of FIG. 11.
Figure 13:
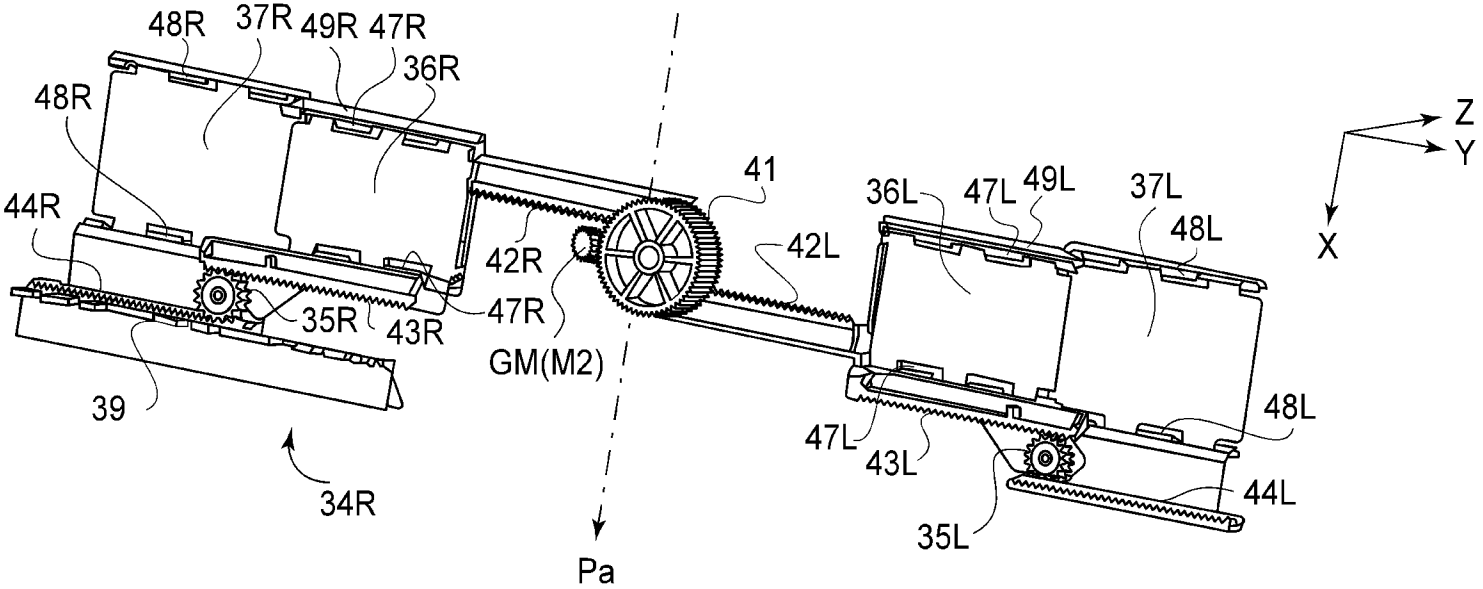
FIG. 13 is a perspective view showing only the shutter mechanism as seen from an inside of the shutter mechanism.

FIG. 10 is an exploded perspective view of the air blowing cooling mechanism 30 of FIG. 3 as seen from an inlet (intake) port side. FIG. 11 is a perspective view of the air blowing cooling mechanism 30 of FIG. 3, which is turned upside down and which is as seen from an upward air blowing port side, in which shutter mechanisms 34 (L, R), described later, are in a shutter member close state. FIG. 12 is an exploded perspective view of the air blowing cooling mechanism 30 of FIG. 11. FIG. 13 is a perspective view showing only the shutter mechanisms 34 (L, R) as seen from an inside of the shutter mechanisms 34 (L, R).

Figure 14:
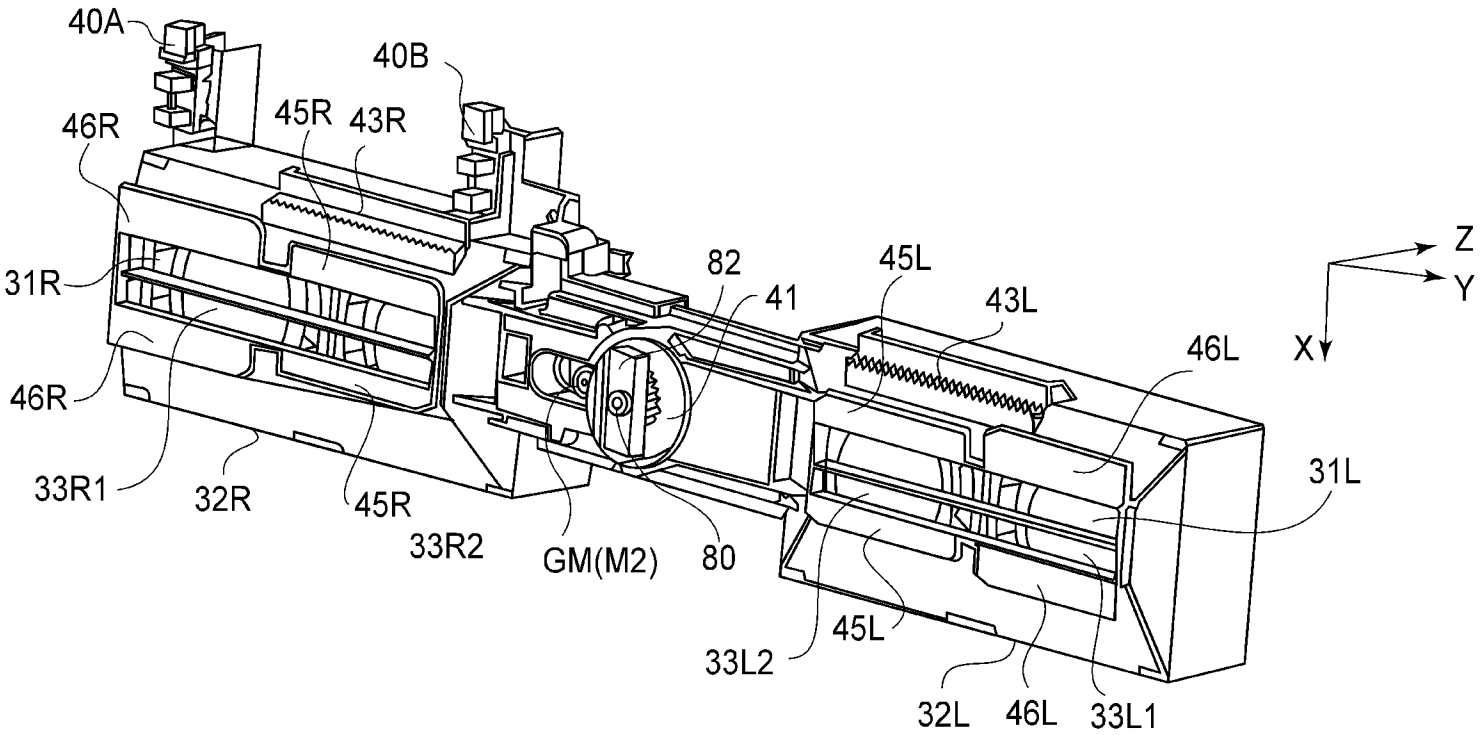
FIG. 14 is a perspective view showing an air blowing cooling mechanism portion, which is a portion of the air blowing cooling mechanism of FIG. 11 from which a shutter member is removed, in which the air blowing cooling mechanism portion is seen from the air blowing port side.

FIG. 14 is a perspective view showing an air blowing cooling mechanism portion, which is a portion of the air blowing cooling mechanism 30 of FIG. 11 from which shutter members 36L, 37L, 36R and 37R of the shutter members 34 (L, R) are removed, in which the air blowing cooling mechanism portion is seen from the air blowing port side.

As shown in FIG. 5, the upper surface plate 25U is provided with two elongated window holes 38 (L, R), extending in the left-right direction on a left-half portion side and a right-half portion side, respectively, for causing cooling air to act on the non-sheet-passing portions of the assembly 10, respectively, by the air blowing cooling mechanism 30. These two window holes 38 (L, R) are disposed bilaterally symmetrically with respect to the reference line of the center (line) basis feeding of the sheet P.

Each of the window holes 38 (L, R) is, as shown in FIG. 7, positioned so as to oppose an upper surface portion of the assembly 10 and is positioned correspondingly to an associated one of a left-side non-sheet-passing region width WL and a right-side non-sheet-passing region width WR when the minimum-size sheets usable in the apparatus are passed through the nip N. In this embodiment, a width dimension (length dimension) W38 of each of the window holes 38 (L, R) is 115 mm (=[(330 mm-100 mm)/2].

The air blowing cooling mechanism 30 includes two elongated ducts 32 (L, R) extending in the left-right direction on the left and right sides, respectively. The ducts 32 (L, R) include air blowing ports (exhaust ports) 31 (L, R), which correspond to the window holes 38 (L, R) of the upper surface plate 25, respectively, on a lower surface side thereof and which extend in the left-right direction (FIGS. 12 and 14). Upper surfaces of the ducts 32 (L, R) are open as (air) inlet port surfaces.

Inside the left(-side) duct 32L, two left(-side) cooling fans 33 (L1, L2) for blowing cooling air to this left duct 32L are provided along the left-right direction. Further, the left duct 32L includes a partition portion provided at a position corresponding to a boundary between the cooling fans 33 (L1, L2) so as to introduce the cooling air from the cooling fans 33 (L1, L2) toward the air blowing port 31L. Further, inside the right(-side) duct 32R, two right(-side) cooling fans 33 (R1, R2) for blowing cooling air to this right duct 32R are provided along the left-right direction. Further, similarly the right duct 32R includes a partition portion provided at a position corresponding to a boundary between the cooling fans 33 (R1, R2).

Further, the air blowing cooling mechanism 30 includes the shutter mechanism 34 functioning as an opening and closing mechanism not only for opening and closing the air blowing port 31L of the left duct 32L, but also for opening and closing the air blowing port 31R of the right duct 32R. This shutter mechanism 34 also functions as an opening width adjusting mechanism for adjusting an opening width of the air blowing port 31L and an opening width of the air blowing port 31R. The shutter mechanism 34 is constituted by a left shutter mechanism 34L for limiting a cooling range of the cooling air sent through the left duct 32L and by a right shutter mechanism 34R for limiting a cooling range of the cooling air sent through the right duct 32R.

The left shutter mechanism 34L, including two shutter members, is consisting of an inner shutter member (first shutter member) 36L provided on a longitudinal central (inner) side of the assembly 10 and an outer shutter member (second shutter member) 37L provided on a longitudinal outer side of the assembly 10. Further, the left shutter mechanism 34L is constituted by a shutter pinion gear 35L rotatably supported by the inner shutter member 36L, a driving pinion gear 41, a rack-shaped portion (rack teeth) 43L formed in the duct 32L, and a shutter motor M2.

The inner shutter member 36L is provided on the duct 32L in a state in which guiding portions 47L provided on the inner shutter member 36L engage with collar-shaped inner shutter member regulating portions 45L formed along the longitudinal direction of the air blowing port 31L, and is slidable along the longitudinal direction of the regulating portions 45L.

The outer shutter member 37L is provided on the duct 32L in a state in which guiding portions 48L provided on the outer shutter member 37L engage with collar-shaped outer shutter member regulating portions 46L formed along the longitudinal direction of the air blowing port 31L, and is slidable along the longitudinal direction of the regulating portions 46L.

Further, the outer shutter member 37L engages with collar-shaped outer shutter member regulating portions 49L formed on the inner shutter member 36L with respect to the longitudinal direction of the inner shutter member 36L.

Similarly, the right shutter mechanism 34R including two shutter members is consisting of an inner shutter member (first shutter member) 36R provided on a longitudinal central (inner) side of the assembly 10 and an outer shutter member (second shutter member) 37R provided on a longitudinal outer side of the assembly 10. Further, the right shutter mechanism 34R includes a shutter pinion gear 35R rotatably supported by the inner shutter member 36R, the driving pinion gear 41, a rack-shaped portion (rack teeth) 43R formed in the duct 32R, and the shutter motor M2.

The inner shutter member 36R is provided on the duct 32R in a state in which guiding portions 47R provided on the inner shutter member 36R engage with collar-shaped inner shutter member regulating portions 45R formed along the longitudinal direction of the air blowing port 31R, and is slidable along the longitudinal direction of the regulating portions 45R.

The outer shutter member 37R is provided on the duct 32R in a state in which guiding portions 48R provided on the outer shutter member 37R engage with collar-shaped outer shutter member regulating portions 46R formed along the longitudinal direction of the air blowing port 31R, and is slidable along the longitudinal direction of the regulating portions 46R.

Further, the outer shutter member 37R engages with collar-shaped outer shutter member regulating portions 49R formed on the inner shutter member 36R with respect to the longitudinal direction of the inner shutter member 36R.

As regards the above-described left and right shutter mechanisms 34 (L, R), the driving pinion gear 41 and the shutter motor 42 are constituent members common to the shutter mechanisms 34 (L, R). The shutter motor (driving motor) 42, which is a driving source for driving the driving pinion gear 41 of the shutter mechanisms 34 (L, R) is provided in the neighborhood of a central portion between the left and right ducts 32L and 32R. The inner shutter members 36 (L, R) are provided with the rack-shaped portions 42 (L, R) each engaging with the driving pinion gear 41.

The rack-shaped portions 43 (L, R) provided on the left and right ducts 32 (L, R) are provided so as to engage with the shutter pinion gears 35 (L, R) rotatably supported by the shutter members 36 (L, R).

The driving pinion gear 41 is rotationally driven normally and reversely by an output gear MG of the shutter motor (pulse motor) M2. In interrelation with normal and reverse rotational drive of this gear 41, the inner and outer shutter members 36 (L, R) and 37 (L, R) of the left and right shutter mechanisms 34 (L, R) are moved as described above for opening and closing the air blowing ports 31 (L, R) of the left and right ducts 32 (L, R). That is, in this embodiments, the driving pinion gear 41 is a driving member for transmitting drive (driving force) of the shutter motor M2 (output gear MG), which is the driving source to the inner and outer shutter members 36 (L, R) and 37 (L, R) of the left and right shutter mechanisms 34 (L, R).

The inner and outer shutter members 36 (L, R) and 37 (L, R) of the left and right shutter mechanisms 34 (L, R) are controlled so as to be moved to positions corresponding to the width of the sheet P passed through the nip N. As a result, widths of the air blowing ports 31 (L, R) of the left and right ducts 32 (L, R), i.e., widths of the left and right window holes 38 (L, R) in the upper surface plate 25U are adjusted to optimum opening widths corresponding to the passed sheet width, so that air blowing cooling is carried out in ranges in which non-sheet-passing region temperature rise in the assembly 10 occurs.

A shutter member opening and closing operation will be described. The outer shutter member 37R of the right shutter mechanism 34R is provided at a bent edge portion thereof with a plurality of sensor flags 39 (a portion enclosed by a broken line in FIGS. 3 and 10) determined correspondingly to sheets having various width sizes. Further, first and second photo-sensors 40A and 40B for detecting edge portions of the sensor flags 39 are provided by being fixed to the right direction 32R. Edge portion detection information of each of the sensor flags 39 by the first and second photo-sensors 40A and 40B is input to the control circuit portion 100 through an A/D converter 300 as shown in FIG. 9.

In this embodiment, the sensor flags 39 and the first and second photo-sensors 40A and 40B are a detecting means for detecting opening (portion) positions of the shutter members. The control circuit portion 100 causes a shutter motor driving circuit 400 to control the shutter motor M2 so that an edge portion of the sensor flag 39 corresponding to width size information of the sheet P used, which is input from the external host prevent 200 is detected by the second photo-sensor 40B. That is, the shutter motor M2 is subjected to normal rotation control (CW (clockwise)) or reverse rotation control (CCW (counterclockwise)), so that the left and right shutter mechanism 34L and 34R are driven.

Then, at the time when the edge portion of the sensor flag 39 corresponding to width size information of the sheet P, which is to be used and passed through the nip N, is detected, with the time as a starting point, the shutter motor M2 is driven for several msec and is stopped. As a result, outside edge portions of the outer shutter members 37 (L, R) of the left and right shutter mechanisms 34 (L, R) are moved to positions corresponding to the width of the sheet P, which is to be used and passed through the nip N.

An operation of the left and right cooling fans 33 (L1, L2, R1, R2) in the fixing device 6 in this embodiment will be described. During image formation, in the case in which sheets smaller in width than a size of maximum width sheets P, usable in and passable through the fixing device 6, are continuously fixed by the fixing device 6, the temperature in the non-sheet-passing region increases. The third thermistor 19*b* detects an inner surface temperature of a film portion corresponding to the non-sheet-passing region.

The control circuit portion 100 controls the shutter motor control circuit 400 (FIG. 9) when the third thermistor 19*b* detects a temperature not less than a predetermined threshold temperature. That is, the inner and outer shutter members 36 (L, R), and 37 (L, R) of the left and right shutter mechanisms 34 (L, R) are moved by the shutter motor M2 to positions corresponding to the width of the small width sheets continuously passed through the fixing device 6. Further, the control circuit portion 100 controls a cooling fan driving circuit 500 (FIG. 9), so that an operation of the cooling fans 33 (L1, L2, R1, R2) in the left and right ducts 32 (L, R) is started.

As a result, the non-sheet-passing portions of the assembly 10 are cooled by the cooling air from the cooling fans, so that the non-sheet-passing region temperature rise of the fixing device 6 is suppressed.

Then, when a detection temperature of the third thermistor 19*b* is below the predetermined threshold temperature, the operation of the cooling fans 33 (L1, L2, R1, R2 is stopped. A temperature range of ON=OFF control of the cooling fans depending on the detection temperature of the third thermistor 19*b* is controlled so as to be changed depending on a status of the operation of the cooling fans.

The temperature range of ON-OFF control of the cooling fans 33 (L1, L2, R1, R2 in this embodiment is controlled in the following manner in the case in which, for example, B4-size sheets (short edge feeding; 257 mm×364 mm) are continuously passed through the fixing device 6.

That is, during sheet passing, when the detection temperature of the third thermistor 19*b* reaches 200° C. (operation start temperature), the operation of the cooling fans 33 (L1, L2, R1, R2 is started. Then, the non-sheet-passing portions of the assembly 10 are cooled by the cooling air, and when the detection temperature of the third thermistor 19*b* decreases to 190° C. (operation stop temperature), the operation of the cooling fans is stopped.

Shutter Member Opening and Closing Operation Constitution

Next, a shutter member opening and closing operation constitution, which is a feature of this embodiment, will be specifically described using FIG. 1 and FIGS. 15 to 19. A shutter member opening and closing operation of the left shutter mechanism 34L and a shutter member opening and closing operation of the right shutter mechanism 34R are similar to each other. Operation directions of the left and right shutter mechanisms 34 (L, R) are, however, in a mutually opposite relationship. In the following description, the shutter member opening and closing operation of the right shutter mechanism 34R will be specifically described as a representative.

First, an opening operation of the shutter members will be described.

Parts (a) and (b) of FIG. 15 are schematic views of the shutter mechanism 34R in an all-close state and during an open movement operation, respectively, as seen from the inlet port side (an inside of the shutter mechanism 34R).

Parts (a) and (b) of FIG. 16 are schematic views of the shutter mechanism 34R in the all-close state and during the open movement operation, respectively, as seen from the air blowing port side (an outside of the shutter mechanism 34R).

FIG. 17 is a schematic view showing a relationship among the inner shutter member 36R, the outer shutter member 37R and the duct 32R.

Parts (a) of FIG. 15 and part (a) of FIG. 16 show an all-close state of the shutter members of the shutter mechanism 34R. In this state, the air blowing port 31R of the duct 32R is closed over a full width by the inner shutter member 36R and the outer shutter member 37R, which are moved to an all-close position (closed position).

That is, the air blowing port 31R and the window hole 38R opposing the air blowing port 31R are held in a non-communication state over a full width. The shutter mechanism 34R is in the all-close position in order to prevent failure (out of order) of the cooling fans 33(L1, L2, R1, R2) due to radiant heat from the film 13 in the case where cooling by the cooling fans is not needed (for example, when the images are fixed on the maximum-width sheets).

Incidentally, in this embodiment, a constitution in which the air blowing port 31R is sufficiently closed at the all-close position was employed, but a state in which an open portion is slightly formed may also be used as the closed position. That is, a state in which the air blowing port 31R is most closed in a range in which the inner and outer shutter members 36R and 37R can be moved by control of the control circuit portion 100 is defined as the closed position.

In this all-close state of the shutter members, the shutter motor M2 is rotationally driven in CW (clockwise direction) (arrow D direction in FIGS. 15 and 16). Then, the driving pinion gear 41 engaging with the output gear MG of the shutter motor M2 is rotated in an arrow E direction (clockwise direction in FIG. 15). Then, the rack-shaped portion 42R engaging with the driving pinion gear 41 are formed in the inner shutter member 36R receives a force by rotation of the driving pinion gear 41.

As shown in FIG. 17, the guiding portion 47R formed on the inner shutter member 36R engages with the collar-shaped inner shutter member regulating portion 45R formed on the duct 32R along the longitudinal direction of the assembly 10. For that reason, the inner shutter member 36R moves in an assembly F direction toward a central side with respect to the longitudinal direction of the assembly 10 as shown in parts (b) of FIGS. 15 and 16.

The inner shutter member 36R includes a supporting portion 361R rotatably supporting the shutter pinion gear 35R, and the supporting portion 361R is also moved together with the inner shutter member 36 by movement of the inner shutter member 36 in the longitudinal direction of the assembly 10. The shutter pinion gear 35R rotatably supported by the supporting portion 361R of the inner shutter member 36R engages with the rack-shaped portion 43R formed on the duct 32R.

The rack-shaped portion 43R is fixed to the duct 32R, and, therefore, is not moved even when the inner shutter member 36R is moved in the longitudinal direction of the assembly 10. For that reason, the inner shutter member 36R is moved in the longitudinal direction of the assembly 10, so that the shutter pinion gear 35R rotates in an arrow G direction (counterclockwise direction in FIG. 15) as shown in FIG. 15. Then, a rack-shaped portion 44R of the outer shutter member 37R engages with the shutter pinion gear 35R.

For that reason, when the shutter pinion gear 35R rotates while moving together with the inner shutter member 36R, the rack-shaped portion 44R receives a force for moving the rack-shaped portion 44R in the longitudinal direction of the assembly 10, via the shutter pinion gear 35R. As a result, in interrelation with movement of the inner shutter member 36R in the longitudinal direction (F direction), the outer shutter member 36R also moves in the same direction (H direction).

The guiding portion 48R formed on the outer shutter member 37R engages with the collar-shaped outer shutter member regulating portion 46R formed on the duct 32 with respect to the longitudinal direction of the assembly 10. Further, the outer shutter member 37R engages with the collar-shaped outer shutter member regulating portion 49R formed on the inner shutter member 36R with respect to the longitudinal direction of the assembly 10. For that reason, the outer shutter member 37R moves in a direction (arrow H direction) toward a longitudinal center of the assembly 10 by an amount of movement by the rotation of the shutter pinion gear 35R in addition to a movement amount of the inner shutter member 36R, i.e., by a movement amount twice the movement amount of the inner shutter member 36R.

As a result, the outer shutter member 37R and the inner shutter member 36R are opened so that an overlapping region therebetween increases. Here, with respect to the longitudinal direction of the fixing film 13, a width of the air blowing port 31R, which is not covered with the outer shutter member 37R and the inner shutter member 36R, is referred to as an opening width.

Further, when the outer shutter member 37R is in the closed position (all-close position in this embodiment), a surface on which the outer shutter member 37R covers the air blowing port 31R is referred to as a surface a, and, when the inner shutter member 36R is in the closed position (all-close position in this embodiment), a surface on which the inner shutter member 36R covers the air blowing port 31R is referred to as a surface (3. At this time, a relationship among the opening width, the outer shutter member 37R, and the inner shutter member 36R is as follows.

When the opening width is a first width, the outer shutter member 37R and the inner shutter member 36R include the overlapping region therebetween, so that when these shutter members 37R and 36R are seen from the fixing film side as shown in part (b) of FIG. 16, a part of the surface a and a part of the surface 13 overlap with each other. Further, when the opening width is a second width greater than the first width, the overlapping region between the outer shutter member 37R and the inner shutter member 36R further increases. Therefore, in the case in which the opening width is the second width, when the shutter members 37R and 36R are seen from the fixing film side as shown in part (b) of FIG. 16, an overlapping area therebetween is greater than an overlapping area in the case of the first width while a part of the surface a and a part of the surface 13 overlap with each other.

In other words, the inner shutter member 36R has a first surface for closing the air blowing port 31R at the closed position for closing the air blowing port 31R. The outer shutter member 37R has a second surface for closing the air blowing port 31R at the closed position for closing the air blowing port 31R. Each of the inner shutter member 36R and the outer shutter member 37R are movable so as to take the closed position, a first open position for changing the opening width of the air blowing port 31R to the first width, and a second open position for changing the opening width of the air blowing port 31R to the second width greater than the first width.

Further, the shutter members 36R and 37R move so that an overlapping area between the first surface and the second surface when the shutter members 36R and 37R are in the first open positions is greater than that when the shutter members 36R and 37R are in the second open positions.

The air blowing port 31R of the duct 32 is gradually opened from a longitudinal end portion side toward a longitudinal central portion side by an opening movement operation of the inner shutter member 36R and the outer shutter member 37R, as described above. The air blowing port 31R and the window hole 38R communicate with each other correspondingly to the opening width.

When the inner shutter member 36R and the outer shutter member 37R are in a sufficiently closed position, most of the guiding portion 48R of the outer shutter member 37R is regulated by the collar-shaped outer shutter member regulating portion 46R. With an increasing opening amount of the air blowing port 31R, by the opening movement operation of the inner and outer shutter members 36R and 37R, a portion of the guiding portion 48R, formed on the outer shutter member 37R, by the outer shutter member regulating portion 46R formed on the duct 32R gradually shortens. Further, a portion of the guiding portion 48R by the collar-shaped outer shutter member regulating portion 49R formed on the inner shutter member 36R along the longitudinal direction of the assembly 10 gradually lengthens.

Next, a closing operation of the shutter members will be described. The shutter member closing operation is the reverse of the shutter member opening operation described above. Details of the shutter member closing operation will be described.

FIG. 18 is a schematic view of the shutter mechanism as seen from the inlet port side (the inside of the shutter mechanism 34R), in which the shutter members are in a substantially intermediary open position between an all-close position and an all-open position. Further, FIG. 19 is a schematic view of the shutter mechanism 34R as seen from the air blowing port side (the outside of the shutter mechanism 34R), in which the shutter members are in a substantially intermediary open position between the all-close position and the all-open position similarly as in FIG. 18.

In this open state of the shutter members shown in FIGS. 18 and 19, the shutter motor M2 is rotationally driven in CCW (counterclockwise direction) (arrow J direction). Then, the driving pinion gear 41 engaging with the output gear MG of the shutter motor M2 is rotated in an arrow K direction. Then, the rack-shaped portion 42R engaging with the driving pinion gear 41 are formed in the inner shutter member 36R receives a force by rotation of the driving pinion gear 41.

The guiding portion 47R formed on the inner shutter member 36R engages with the collar-shaped inner shutter member regulating portion 45R formed on the duct 32R along the longitudinal direction of the assembly 10. For that reason, the inner shutter member 36R moves in an assembly L direction toward an outside with respect to the longitudinal direction of the assembly 10.

The supporting portion 361R of the inner shutter member 36R is also moved by movement of the inner shutter member 36 in the longitudinal direction of the assembly 10. The shutter pinion gear 35R rotatably supported by the supporting portion 361R of the inner shutter member 36R engages with the rack-shaped portion 43R formed on the duct 32R. The rack-shaped portion 43R is fixed to the duct 32R, and, therefore, is not moved even when the inner shutter member 36R is moved in the longitudinal direction of the assembly 10. For that reason, the inner shutter member 36R is moved in the longitudinal direction of the assembly 10, so that the shutter pinion gear 35R rotates in an arrow M direction (clockwise direction in FIG. 18).

Then, a rack-shaped portion 44R of the outer shutter member 37R engages with the shutter pinion gear 35R. For that reason, when the shutter pinion gear 35R rotates, the rack-shaped portion 44R receives a force for moving the rack-shaped portion 44R in the longitudinal direction (L direction) of the assembly 10, via the shutter pinion gear 35R. As a result, in interrelation with movement of the inner shutter member 36R in the longitudinal direction, the outer shutter member 36R also moves in the same direction (N direction).

The guiding portion 48R formed on the outer shutter member 37R engages with the collar-shaped outer shutter member regulating portion 46R formed on the duct 32 with respect to the longitudinal direction of the assembly 10. Further, the outer shutter member 37R engages with the collar-shaped outer shutter member regulating portion 49R formed on the inner shutter member 36R with respect to the longitudinal direction of the assembly 10.

For that reason, the outer shutter member 37R moves in the arrow N direction toward a longitudinal outside of the assembly 10 by an amount of movement by the rotation of the shutter pinion gear 35R in addition to a movement amount of the inner shutter member 36R, i.e., by a movement amount twice the movement amount of the inner shutter member 36R. As a result, the outer shutter member 37R and the inner shutter member 36R are closed so that the overlapping region therebetween decreases.

The air blowing port 31R of the duct 32 is gradually closed from the longitudinal central portion side toward the longitudinal end portion side by a closing movement operation of the inner shutter member 36R and the outer shutter member 37R as described above. The air blowing port 31R and the window hole 38R communicate with each other correspondingly to the decreasing opening width.

When the inner shutter member 36R and the outer shutter member 37R are in a sufficiently opened position, the guiding portion 48R of the outer shutter member 37R is sufficiently regulated by the collar-shaped outer shutter member regulating portion 49R formed on the inner shutter member 36R along the longitudinal direction of the assembly 10. With a decreasing opening amount of the air blowing port 31R by the closing movement operation of the inner and outer shutter members 36R and 37R, a portion of the guiding portion 48R, formed on the outer shutter member 37R, by the outer shutter member regulating portion 49R formed on the inner shutter member 36R gradually shortens. Further, a portion of the guiding portion 48R by the outer shutter member regulating portion 46R formed on the duct 32R along the longitudinal direction of the assembly 10 gradually lengthens.

In this embodiment, in the shutter member all-close state of the left and right shutter mechanisms 34L and 34R, as shown in part (a) of FIG. 1, the shutter mechanisms 34L and 35R cover a range up to a width of 330 mm. In the shutter member all-close state, as shown in part (b) of FIG. 1, the shutter mechanisms 34L and 35R can open the left and right openings so that an interval therebetween is decreased to a width of 100 mm. Therefore, even in the case in which sheets ranging from a widthwise size of 330 mm to a postcard width size of 100 mm are passed through the fixing device 6, a cooling range can be adjusted by appropriately adjusting shutter member positions.

Therefore, as in the air blowing cooling mechanism 30 in this embodiment, a constitution in which the plurality of shutter members of the left and right shutter mechanisms 34 (L, R) movable depending on the width size of the sheet to be used are moved while overlapping with each other during the opening and closing operation thereof is employed. As a result, with the shutter member opening operation, a cooling regulation area by the shutter members reduces, and thus, a maximum opening width of the shutter members can be enlarged, so that it becomes possible to enlarge a control width of the fixing member end portions in cooling ranges by the cooling fans. Therefore, even when the small-size sheets, such as a postcard and an envelope, are passed through the fixing device 6, the sheet passing can be carried out without lowering productivity.

Embodiment 2

Parts (a) and (b) of FIG. 20 are schematic views of a principal part of an air blowing cooling mechanism in Embodiment 2. Also in this embodiment, similarly as in Embodiment 1, feeding of the sheet P to the fixing device 6 is carried out on the so-called center (line) feeding basis using a sheet width center (line). For that reason, similarly as FIG. 14 in Embodiment 1, the duct 32 is provided with the air blowing port 31L on one end side and the air blowing port 31R on the other end side with respect to the longitudinal direction thereof. Further, shutter members for changing opening widths of the respective air blowing ports 31 (L, R) depending on a widthwise length of the sheet P introduced in the fixing device 6 are provided.

In this embodiment, the shutter members on one end side and the other end side are constituted by a single shutter member 90L and a single shutter member 90R, respectively (one-side single shutter constitution). Part (a) of FIG. 20 shows a state in which the shutter members 90 (L, R) are moved to all-close positions by a moving mechanism (not shown) and the air blowing ports 31 (L, R) are sufficiently closed by the shutter members 90 (L, R), respectively.

Parts (b) of FIG. 20 shows a state in which the shutter members 90 (L, R) located in the all-close positions are moved to all-open positions at a longitudinal central portion of the duct 32 by the moving mechanism (not shown) and the air blowing ports 31 (L, R) are sufficiently opened.

In this embodiment, with the shutter member opening operations, the two shutter members 90 (L, R) on one end side and the other end side are operated so as to be superposed inside and outside. In part (b) of FIG. 20, the shutter members 90 (L, R) on one end side and the other end side are superposed in the all-open positions at the longitudinal central portion of the duct 32 so that the shutter member 90L on one end side is disposed on the outside and the shutter member 90R on the other end side is disposed in the inside.

Accordingly, also in the case of the shutter constitution of Embodiment 2, similarly as in Embodiment 1, the shutter member opening operation can be performed while the shutter members decrease a cooling regulating range, so that it becomes possible to enlarge duct opening widths by the shutter members.

Embodiment 3

In Embodiments 1 and 2, the feeding of the sheet P to the fixing device 6 is carried out on the so-called center feeding basis using the sheet width center. That is, the sheet P is passed through the fixing device 6 so that the sheet passing region is based on the longitudinal center position of the assembly 10. Also, in the case in which the sheet passing region is based on one-side end portion as shown in FIG. 21 (so-called one-side feeding basis in which the sheet is fed on the basis of one end thereof), similarly as in Embodiments 1 and 2, the non-sheet-passing portion temperature rise of the assembly 10 occurs.

Also, in this case, by disposing the air blowing cooling mechanism 30 similarly as in Embodiments 1 and 2, the non-sheet-passing portion temperature rise can be suppressed. As a difference from Embodiments 1 and 2, however, as shown in FIG. 21, only on one side, a duct 32A is needed, and, therefore, a shutter mechanism 34A is also sufficient by being provided on only one side.

In this embodiment, the shutter mechanism 34A is constituted by an inner shutter member 36A and an outer shutter member 37A, which are extended in the longitudinal direction of the assembly 10 similarly as in the case of the right shutter mechanism 34R described in Embodiment 1. As a result, it becomes possible to make a size of the air blowing cooling mechanism 30 smaller than a size in the case in which the shutter member opening operation is performed using a single shutter constitution.

Embodiment 4

In the air blowing cooling mechanism, when a shutter constitution using a single set of left and right shutter members is employed, the shutter members slide on the duct while generating friction. For that reason, as a reference example, as shown in FIG. 41, in order to reduce the friction between a duct 132 and each of left and right shutter members 134L and 134R, it would be considered that the left and right shutter members 134L and 134R are provided with ribs C and D, respectively. As a result, the shutter members 134 (L, R) slide with an air blowing port surface (surface E) and a duct guiding surface (surface F) of the duct 132 only at surfaces of the ribs C and D, and, therefore, a sliding resistance can be reduced.

On the other hand, in the shutter member constitution of the air blowing cooling mechanisms 30 in Embodiments 1 to 3 described above, in order to enlarge the maximum opening widths of the shutter members, the inner shutter member and the outer shutter member are provided. The inner and outer shutter members move while overlapping with each other, and, therefore, there is a liability that a sliding resistance generates between the inner and outer shutter members. For that reason, it is preferable that not only the sliding resistance between the duct and each of the shutter members is reduced but also the sliding resistance between the inner and outer shutter members is reduced.

In a case in which the ribs are provided between the inner shutter member and the outer shutter member along a shutter member open-close direction, however, a gap is generated between the inner and outer shutter members by the ribs, so that there is a liability that air leaks out through the gap and thus, cools the sheet passing region.

Embodiment 4 and subsequent Embodiment 5 are embodiments as countermeasures against the leakage of the air through the gap. When the air blowing cooling mechanisms 30 in Embodiments 4 and 5 are used, by shaping the inner shutter member as described in the following embodiments, a contact area of the inner shutter member with the outer shutter member can be reduced while suppressing the leakage of the air toward the sheet passing region through the gap between the inner and outer shutter members. As a result, the sliding resistance can be reduced.

Structure of Inner Shutter Member and Outer Shutter Member

A structure of the inner shutter member and the outer shutter member in this embodiment (Embodiment 4) will be described. As shown in FIG. 13 described above, in the left and right shutter mechanism 34 (L, R), the inner shutter members 36 (L, R) are connected by the driving pinion gear 41 and the racks (part-shaped portions) 42 (L, R). The driving pinion gear 41 is rotationally driven by the shutter motor M2, so that the drive (driving force) is transmitted and thus, the inner shutter members 36 (L, R) are moved.

Further, the inner shutter members 36 (L, R) are provided with the shutter pinion gears 35 (L, R), respectively. These shutter pinion gears 35 (L, R) are engaged and connected with racks 44 (L, R) of the outer shutter members 37 (L, R) and with fixing racks 43 (L, R) of the ducts 32 (L, R).

The shutter pinion gears 35 (L, R) are rotated along the fixing racks 43 (L, R) of the ducts 32 (L, R) when the inner shutter members 36 (L, R) are moved. A constitution in which the racks 44 (L, R) of the outer shutter members 37 (L, R) are pushed in the same direction as the movement directions of the inner shutter members 36 (L, R) by rotation of the shutter pinion gears 35 (L, R) is employed.

As a result, the outer shutter members 37 (L, R) can be moved along the air blowing ports 31 (L, R) of the ducts 32 (L, R) in a movement amount twice a movement amount of the inner shutter members 36 (L, R). By this constitution, the outer shutter members 37 (L, R) are moved to move outsides of the air blowing ports than are the inner shutter members 36 (L, R).

FIG. 22 shows a state (inner shutter member outer surface view) of the inner shutter member 36 (L, R) as seen from the air blowing port side of the ducts and FIG. 23 shows a state (outer shutter member inner surface view) of the outer shutter members 37 (L, R) as seen from the inlet port side of the ducts.

During opening and closing of the shutter members, back sides of the surfaces 52 of the outer shutter members 37 (L, R) and the surfaces 50 of the inner shutter members 36 (L, R) move while sliding with each other. Therefore, in order to reduce sliding friction, as shown in FIG. 22, regions 51 in which the inner shutter members 36 (L, R) oppose the back sides of the surfaces 52 of the outer shutter members 36 (L, R) are formed in a recessed shape relative to regions 60 so as to be spaced from the back sides of the surfaces 52 of the outer shutter members 37 (L, R).

In this embodiment, a thickness of the regions 51 of the inner shutter members 36 (L, R) is made thinner than thicknesses of the surfaces 50 on the duct air blowing port side and the region 60. As a result, the regions 51 are decreased in contact area with the back sides of the surfaces 52 of the outer shutter members 37 (L, R), and, therefore, the sliding friction can be reduced. On the other hand, the surfaces 50 and the region 60 slide with the back sides of the surfaces 52 of the outer shutter members 37 (L, R).

Here, the contact portions (regions) 60 may preferably be provided continuously so as to cover the openings of the air blowing ports 31 (L, R) with respect to the direction (X-axis direction in FIG. 22) perpendicular to the open-close direction of the inner shutter members 36 (L, R). When the operation portions 60 are discontinuous in the direction perpendicular to the open-close direction of the inner shutter members 36 (L, R), there is a liability that the air from the cooling fans 33 (L1, L2, R1, R2) leaks toward the sheet passing region.

Further, in the closed positions, the contact portions 60 may preferably be provided in regions in which the contact portions 60 overlap with the outer shutter members 37 (L, R), respectively. That is, as shown in FIG. 22, the contact portions 60 may preferably be provided at outside end portions of the inner shutter members 36 (L, R) with respect to the film longitudinal direction. This is because the contact portions 60 can always contact the outer shutter members 37 (L, R) with the opening and closing operation of the inner shutter members 36 (L, R) and the outer shutter members 37 (L, R).

Incidentally, not only the contact portions 60, but also the surfaces 50 are provided as slidable surfaces in a direction parallel to the opening and closing directions of the inner shutter members 36 (L, R) and the outer shutter members 37 (L, R). As a result, during the opening and closing operation, it is possible to suppress sliding of the regions 51 with the outer shutter members 37 (L, R) caused by inclination of the inner shutter members 36 (L, R).

Here, heights of the contact portions 60 and the surfaces 50 from the regions 51 are 0.5 mm or more.

Embodiment 5

FIGS. 24 to 26 are illustrations of a constitution of Embodiment 5.

FIG. 24 shows a state (inner shutter member outer surface view) of the inner shutter member 36 (L, R) as seen from the air blowing port side of the ducts and FIG. 25 shows a state (outer shutter member inner surface view) of the outer shutter members 37 (L, R) as seen from the inlet port side of the ducts.

In Embodiment 4, as shown in FIG. 22, the thickness of the regions 60 provided at end portions remote from the driving pinion gear 41 of the inner shutter members 36 (L, R) is not decreased. That is, in Embodiment 4, between the region 51 and the region 60 of each of the inner shutter members 36 (L, R), an uneven portion for reducing the sliding resistance may also be not provided.

In this embodiment, as shown in FIG. 25, on the surfaces 52 (sliding surfaces) of the outer shutter members 37 (L, R), ribs 53 are provided at end portions 70 on the driving pinion gear 41 side. The thickness of the ribs 53 may preferably be made equal to a difference in thickness between the surface 50 and the surface 51 of each of the inner shutter members 36 (L, R). Here, heights of the ribs 53 from the surfaces 52 are 0.5 mm or more.

Here, the ribs 53 may preferably be provided continuously so as to cover the openings of the air blowing ports 31 (L, R) with respect to the direction (X-axis direction in FIG. 24) perpendicular to the open-close direction of the outer shutter members 37 (L, R). When the operation portions 60 are discontinuous in the direction perpendicular to the open-close direction of the outer shutter members 37 (L, R), there is a liability that the air from the cooling fans 33 (L1, L2, R1, R2) leaks toward the sheet passing region.

Further, in the closed positions, the ribs 53 may preferably be provided in regions in which the contact portions 60 overlap with the inner shutter members 36 (L, R), respectively. That is, as shown in FIG. 25, the ribs 53 may preferably be provided at inside end portions of the outer shutter members 37 (L, R) with respect to the film longitudinal direction. This is because the ribs 53 can always contact the inner shutter members 36 (L, R) with the opening and closing operation of the inner shutter members 36 (L, R) and the outer shutter members 37 (L, R).

That is, in the case of a mechanism with the opening and closing operation while the plurality of shutter members (two shutter members of each of the outer shutter member and the inner shutter member in this embodiment) slide with each other, at least one shutter member has a surface thinned from the sliding surface on the sliding surface side. The other shutter member opposing the shutter member has a surface thickened from the sliding surface on the sliding surface side.

In the case of Embodiment 4, the thickness of the end portions 60 of the inner shutter members 36 (L, R) remote from the driving pinion gear 41 is maintained thick, so that the gap between the inner shutter member 36L and the outer shutter member 36R and the gap between the inner shutter member 36R and the outer shutter member 37R are filled. As a result, the air from the cooling fans 33 (L1, L2, R1, R2) is prevented from leaking out through the gaps between the inner shutter members 36 (L, R) and the outer shutter members 37 (L, R). That is, the air is prevented from blowing onto not only the non-sheet-passing region but also the sheet passing region of the assembly 10 due to leakage of the air from the fans in an arrow S direction shown in FIG. 25, and thus, temperature lowering can be prevented.

In the case of Embodiment 5, the thickness of the end portions 60 of the inner shutter members 36 (L, R) remote from the driving pinion gear 41 is made thin and the ribs 53 are provided at the end portions 70 on the driving pinion gear 41 side. By employing this constitution, the gap between the inner shutter member 36L and the outer shutter member 36R and the gap between the inner shutter member 36R and the outer shutter member 37R are filled. As a result, the air from the cooling fans 33 (L1, L2, R1, R2) is prevented from leaking out through the above gaps in arrow S directions shown in FIG. 26 and is prevented from blowing onto not only the non-sheet-passing region but also the sheet passing region of the assembly 10, and thus, temperature lowering can be prevented.

Embodiment 6

In the air blowing cooling mechanism 30, when the positions of the racks 42 (L, R) of the left and right shutter members are deviated relative to the driving pinion gear 41, the opening widths of the duct air blowing ports 31 (L, R) by the left and right shutter members are different from each other. For example, a situation such that one-side shutter member sufficiently closes the opening but the other side shutter member does not completely close the opening occurs. For that reason, there is a need to assemble the racks 42 (L, R) with the driving pinion gear 41 so that phases of the racks 42 (L, R) are aligned with the driving pinion gear 41.

For that reason, as a reference example, it would be considered that a constitution as shown in FIG. 42 is employed. Assembling of a left shutter member 134L and a right shutter member 134R in the case of a single shutter constitution with a single left shutter member and a single right shutter member will be described. A mark 420L provided on a rack 142L of the left shutter member 134L and a mark 420R provided on a rack 142R of the right shutter member 134R are aligned with marks 410*a* and 410*b*, respectively, provided on the driving pinion gear 41 through eye observation (i.e., positions of apexes (vertexes) of opposing "A" marks are aligned with each other on opposite sides).

As in Embodiment 1, however, in the air blowing cooling mechanism 30 provided with the plurality of shutter members on each of the left and right sides in order to enlarge the maximum opening width of the shutter members, the following circumstances arise. That is, when a phase of an innermost shutter member is deviated, a deviation amount of the outer shutter member moving while following the innermost shutter member becomes greater than a deviation amount in the reference example of FIG. 42. Further, also as regards the plurality of shutter members on each of the sides, when each of phases of the shutter members is deviated, a gap generates between the shutter members or a situation such that the shutter members cannot completely close the openings occurs.

Thus, when the number of shutter members increases, not only the number of places in which phase alignment is needed increases, but also accuracy is further needed. When the phase alignment is intended to be carried out through eye observation, as in the reference example of FIG. 42, however, there is a problem such that operativity is poor and thus, the openings cannot be completely closed.

Embodiment 6 (this embodiment) is a constitution embodiment as countermeasure against the problem. In the case in which a shutter mechanism constitution or a shutter mechanism assembling method as in this embodiment is employed, even in a constitution in which the plurality of shutter members are provided on each of the left and right sides, when the left and right shutter members are assembled by aligning the phases of the left and right shutter members with each other, operativity can be improved more than the constitution (method) of the reference example of FIG. 42.

Further, the shutter mechanism can be assembled while carrying out phase alignment with high accuracy.

Assembling of Shutter Structure with Two Shutter Members on Each Side

A structure and an assembling method of the air blowing cooling mechanism 30 in Embodiment 6 will be described. The air blowing cooling mechanism 30 in this embodiment includes the left and right shutter mechanisms 34 (L, R) provided with two inner shutter members 36 (L, R) and two outer shutter members 37 (L, R) structure with two shutter members on each side). For that reason, there is a need to align phases of the four shutter members during assembling in order to permit movement of the four shutter members to predetermined positions relative to the air blowing ports 31 (L, R) of the ducts 32 (L, R) in a bilaterally symmetrical manner.

In order to facilitate the phase alignment during assembling, a jig 101 for shutter assembling shown in part (a) of FIG. 27 is used. The jig 101 is constituted by a base jig 101*a* and a central jig 101*b*. As shown in part (b) of FIG. 27, the base jig 101*a* is provided with a groove hole portion 105 at a longitudinal central portion thereof, and the central jig 101*b* is engaged in this groove hole portion 105 and thus, is dismountably mounted on the base jig 101*a* (i.e., mountable to and dismountable from the base jig 101*a*).

On an upper surface side (front surface side) of the central jig 101*b*, four pins 102(*a, b, c, d*) are provided. The pin 102*a* is used for phase alignment between the inner shutter member 36L, and the outer shutter member 37L of the left shutter mechanism 34L, as described later. The pin 102*b* is used for phase alignment between the inner shutter member 36R and the outer shutter member 37R of the right shutter mechanism 34R, as described later. The pins 102*c* and 102*d* are used for phase alignment among the rack 42L of the inner shutter member 36L, the driving pinion gear 41 and the duct 32L and phase alignment among the rack 42R of the inner shutter member 36R, the driving pinion gear 41 and the duct 32R, respectively.

As shown in part (b) of FIG. 27, on a surface of the groove hole portion 105 of the base jig 101*a*, two bosses 103 (*a, b*) are provided. Part (c) of FIG. 27 is a schematic view of the central jig 101*b* as seen from a lower surface side (back surface side). On the lower surface side of the central jig 101*b*, two holes 104 (*a, b*) corresponding to the bosses 103 (*a, b*), respectively, are provided. When the central jig 101*b* is mounted in the groove hole portion 105 of the base jig 101*a*, the boss 103*a* and the hole 104*a* are engaged with each other correspondingly, and the boss 103*b* and the hole 104 have engaged with each other correspondingly. As a result, the central jig 101*b* is mounted in the groove hole portion 105 in a shift prevention state.

Figure 28:
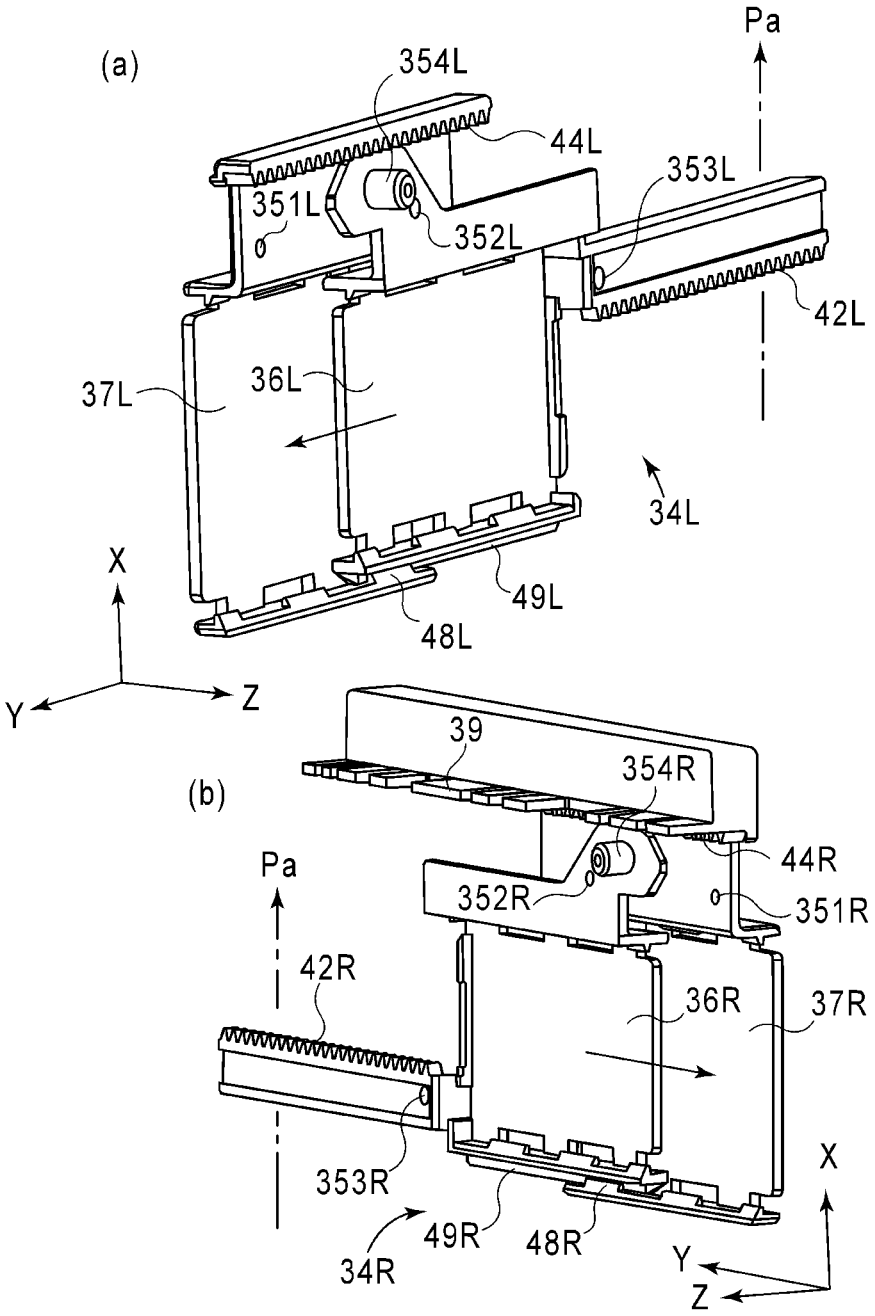

During assembling, as shown in part (a) of FIG. 28, the inner shutter member 36L of the left shutter mechanism 34L is engaged inside the outer shutter member 37L. In this case, the outer shutter member regulating portion 49L of the inner shutter member 36L is slid and engaged along the guiding member 48L of the outer shutter member 37L. As a result, the both shutter members 36L and 37L are assembled is a superposed state.

Further, as shown in part (b) of FIG. 28, the inner shutter member 36R of the right shutter mechanism 34R is engaged inside the outer shutter member 37R. In this case, the outer shutter member regulating portion 49R of the inner shutter member 36R is slid and engaged along the guiding member 48R of the outer shutter member 37R. As a result, the both shutter members 36R and 37R are assembled is a superposed state.

Figure 29:
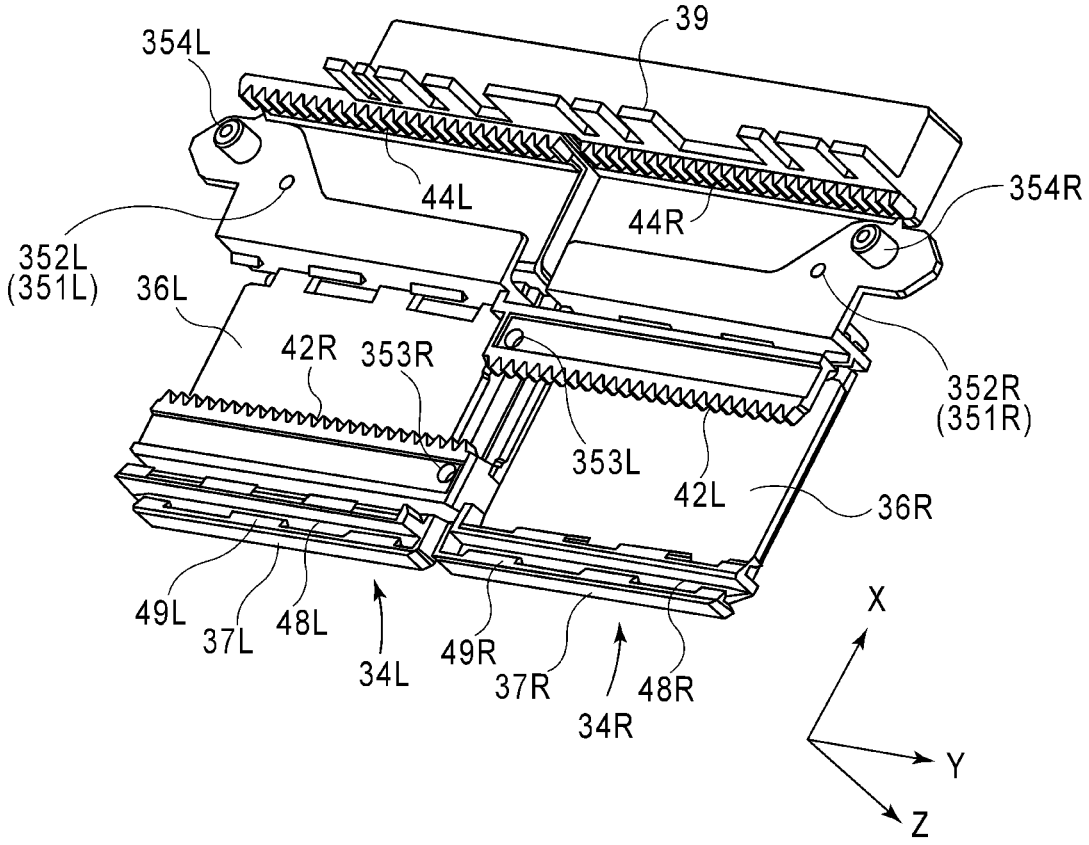

With reference to the inner shutter members 36 (L, R) and the outer shutter members 37 (L, R), which are assembled in the superposed state as described above, the inlet port surface side (shutter member inner surface side) is an upper side, and the air blowing port surface side (shutter member outer surface side) is a lower side. Further, the left and right assembled members are disposed in a crossed state so that as shown in FIG. 29, the rack 42L of the inner shutter member 36L is on an upper side than the inlet port surface side of the inner shutter member 36R and the rack 42R of the inner shutter member 36R is on an upper side than the inlet port surface side of the inner shutter member 36L.

At this time, a positioning hole 352L of the inner shutter member 36L and a positioning hole 351L of the outer shutter member 37L are substantially concentrically positioned with each other. Further, a positioning hole 352R of the inner shutter member 36R and a positioning hole 351R of the outer shutter member 37R are substantially concentrically positioned with each other.

Figure 30:
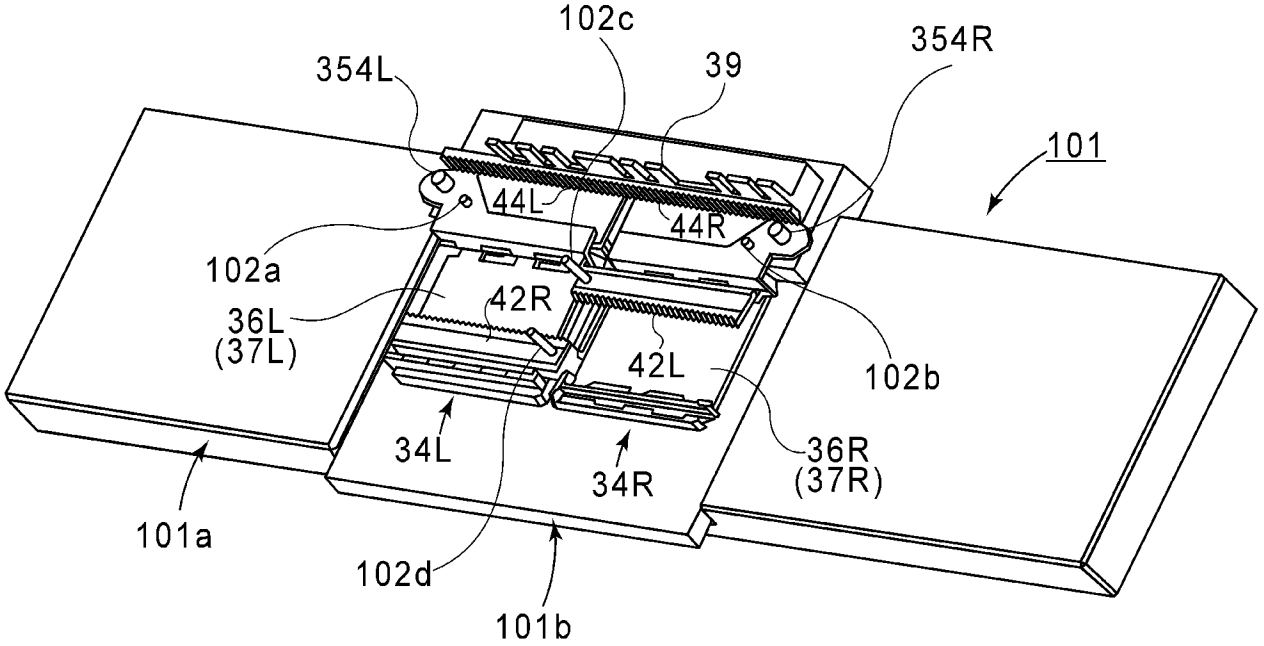

In this state, as shown in FIG. 30, the left and right shutter mechanisms 34L and 34R are mounted on the central jig 101*b* of the jig 101 in which the central jig 101*b* is mounted on the base jig 101*a*. A mounting manner at this time is as follows.

(1) The pin 102*a* of the jig 101 is caused to penetrate from below toward above through the positioning hole 351L of the outer shutter member 37L and the positioning hole 352L of the inner shutter member 36L.

(2) The pin 102*b* of the jig 101 is caused to penetrate from below toward above through the positioning hole 351R of the outer shutter member 37R and the positioning hole 352R of the inner shutter member 36R.

(3) The pin 102*c* of the jig 101 is caused to penetrate from below toward above through a positioning hole 353L of the rack 42L for the inner shutter member 36L.

(4) The pin 102*d* of the jig 101 is caused to penetrate from below toward above through a positioning hole 353R of the rack 42R for the inner shutter member 36R.

Figure 31:
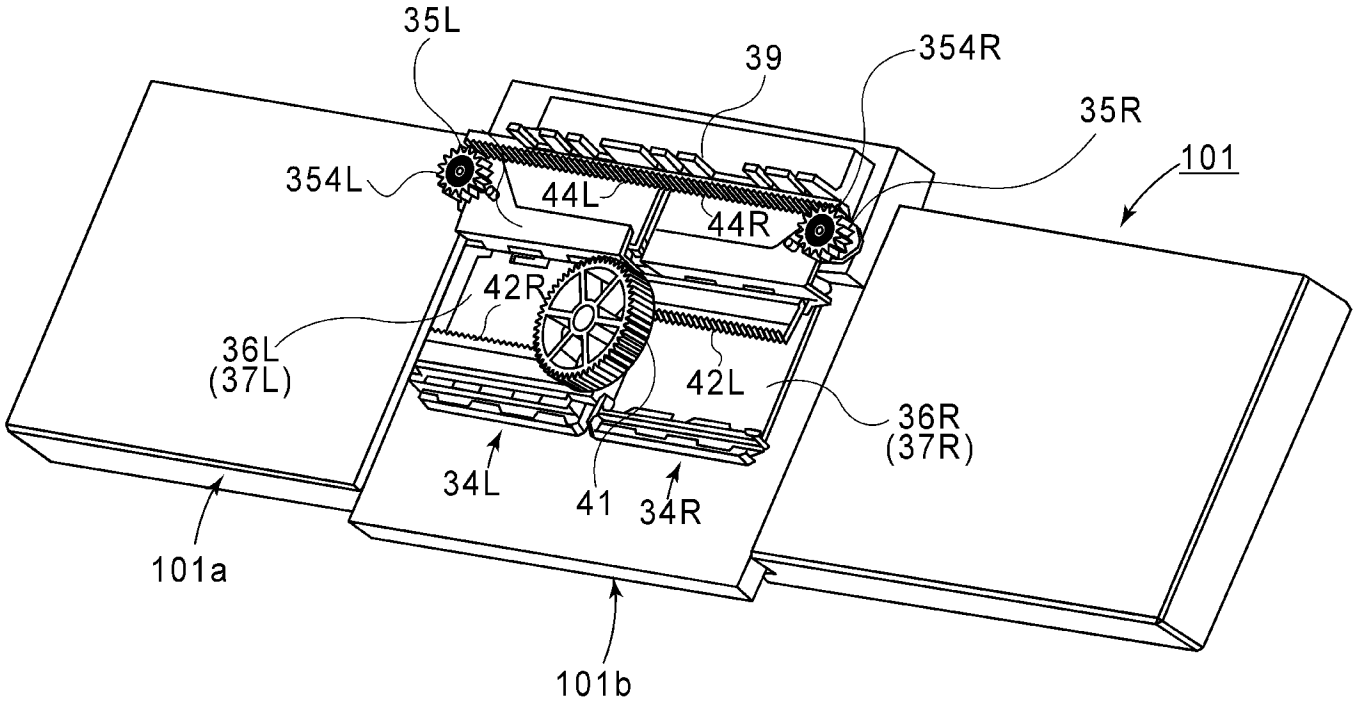

Then, as shown in FIG. 31, the shutter pinion gears 35L and 35R are mounted on shutter pinion gear shafts 354L and 354R, respectively, of the inner shutter members 36L and 36R.

The shutter pinion gears 35 (L, R) are engaged and connected with the racks 42 (L, R) of the outer shutter members 37 (L, R), respectively. Then, when the inner shutter members 36 (L, R) are moved, the racks 44 (L, R) of the outer shutter members 37 (L, R) are pushed toward the same directions as movement directions of the inner shutter member 36 (L, R).

For that reason, the outer shutter members 37 (L, R) can be moved along the air blowing ports 31 (L, R) of the ducts 32 (L, R), respectively, in movement amounts twice movement amounts of the inner shutter members 36 (L, R), respectively.

By this constitution, the outer shutter members 37 (L, R) are moved to outsides of the inner shutter members 36 (L, R) on the air blowing ports 31 (L, R) of the ducts 32 (L, R), respectively. That is, the opening widths of the air blowing ports 31 (L, R) of the ducts 32 (L, R) in full length regions can be adjusted by the two shutter members on the left sides, and by the two shutter members on the right side, respectively.

Further, as shown in FIG. 13, the driving pinion gear 41 is mounted. As shown in FIG. 32, the driving pinion gear 41 is a stepped gear including a gear 411 engaging with the output gear GM of the shutter motor M2, a gear 412 engaging with the racks 42 (L, R) of the inner shutter members 36 (L, R), and a center hole 413. Further, the driving pinion gear 41 is provided with holes 414 (*a, b*) for permitting insertion of the pins 102*c* and 102*d*, respectively of the central jig 101*b*.

When the driving pinion gear 41 is mounted, the position of the driving pinion gear 41 is adjusted so that the pins 102*c* and 102*d* of the central jig 101*b* enter the holes 414*c* and 414*d*, and the gear 412 is mounted toward the central jig 101*b* side. Incidentally, each of the pins 102*c* and 102*d* may be inserted in either one of the holes 414*a* and 414*b*.

Then, the ducts 32 (L, R) are mounted. FIG. 33 shows a surface (duct lower surface) of the ducts 32 (L, R) on the air blowing port side. As described above in Embodiment 1 with reference to FIG. 1, and the like, the ducts 32 (L, R) are provided with the air blowing ports 31 (L, R) through which the air for cooling the assembly 10 passes. Further, the ducts 32 (L, R) are provided with the inner shutter member regulating portion 45L for the inner shutter member 36L, the inner shutter member regulating portion 45R for the inner shutter member 36R, the outer shutter member regulating portion 46L for the outer shutter member 37L and the outer shutter member regulating portion 46R for the outer shutter member 37R.

Further, as shown in FIG. 33, the ducts 32 (L, R) include the rack 43L engaging with the shutter pinion gear 35L, the rack 43R engaging with the shutter pinion gear 35R, and a driving pinion gear shaft 80. Further, in the neighborhood of the driving pinion gear shaft 80, holes 81 (*a, b*) for permitting insertion of the pins 102*c* and 102*d* of the jig 101.

Figure 34:
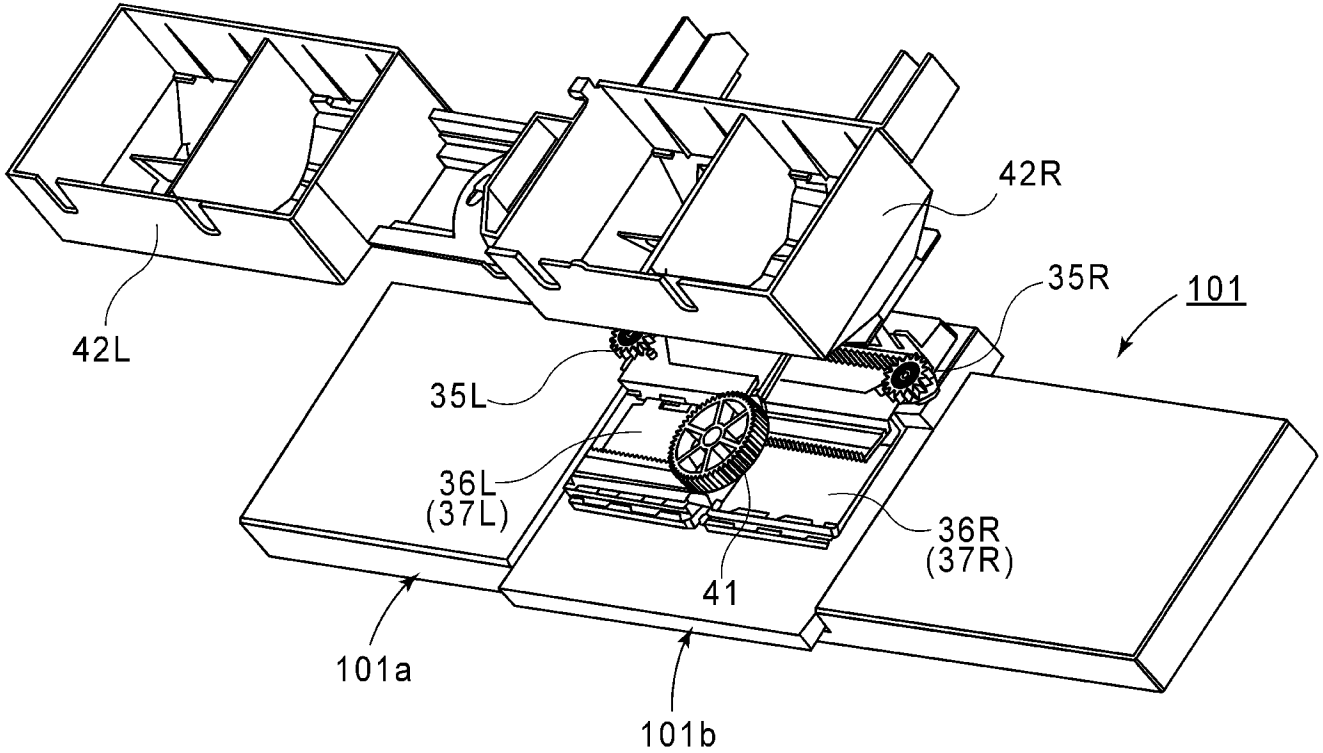

Then, to the jig 101 including the central jig 101*b* on which the left and right shutter mechanisms 34 (L, R) are mounted in procedures and manners of FIGS. 28 to 32, the ducts 32 of FIG. 33 are opposed so that the driving pinion gear shaft 80 faces the jig 101 as shown in FIG. 34. Then, an opposing direction of the ducts 32 to the jig 101 is adjusted so as to connect the racks 43 (L, R) with the shutter pinion gears 35 (L, R).

Figure 35:
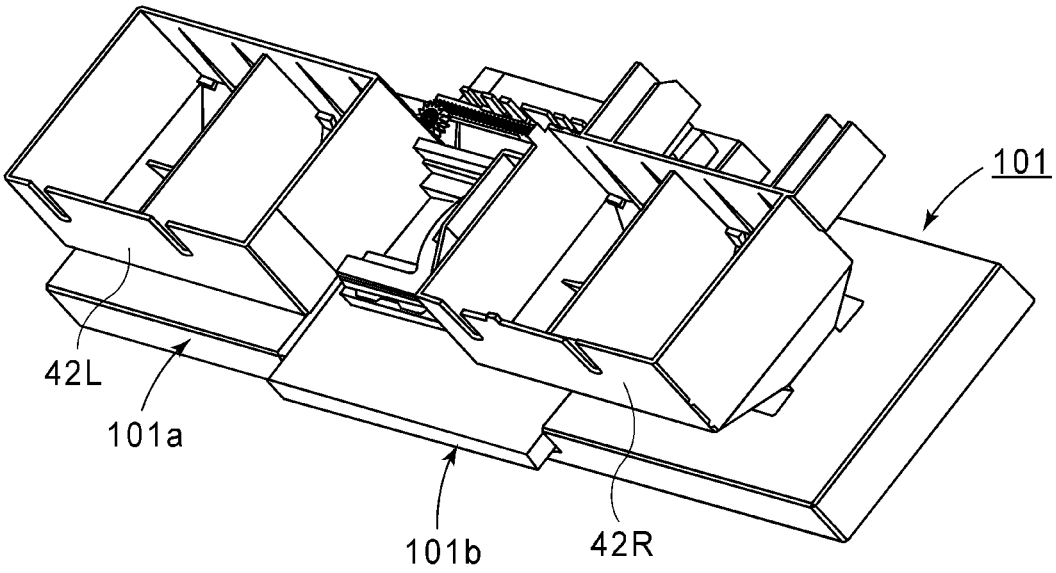

Then, the ducts 32 is mounted on the jig 101 while positioning respective parts so that the pins 102*c* and 102*d* of the central jig 101 enter the holes 81*a* and 81*b*, respectively, of the ducts 32 and so that the driving pinion gear shaft 80 enters the center hole 413 of the driving pinion gear 41. FIG. 35 shows a state in which the ducts 32 are mounted on the jig 101.

Figure 36:
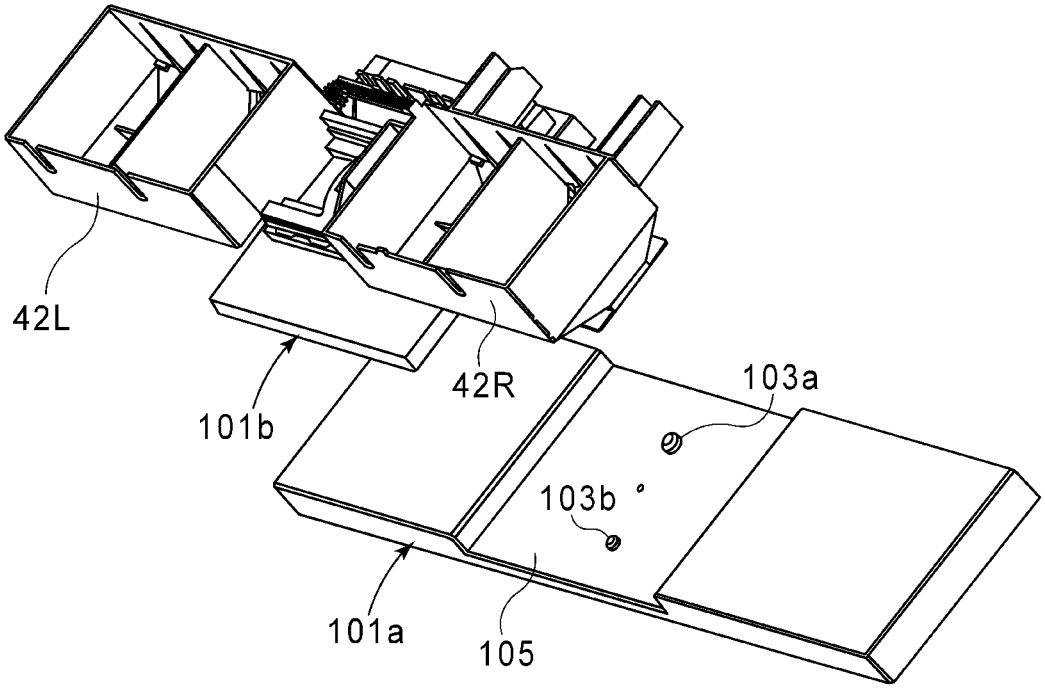
Figure 37:
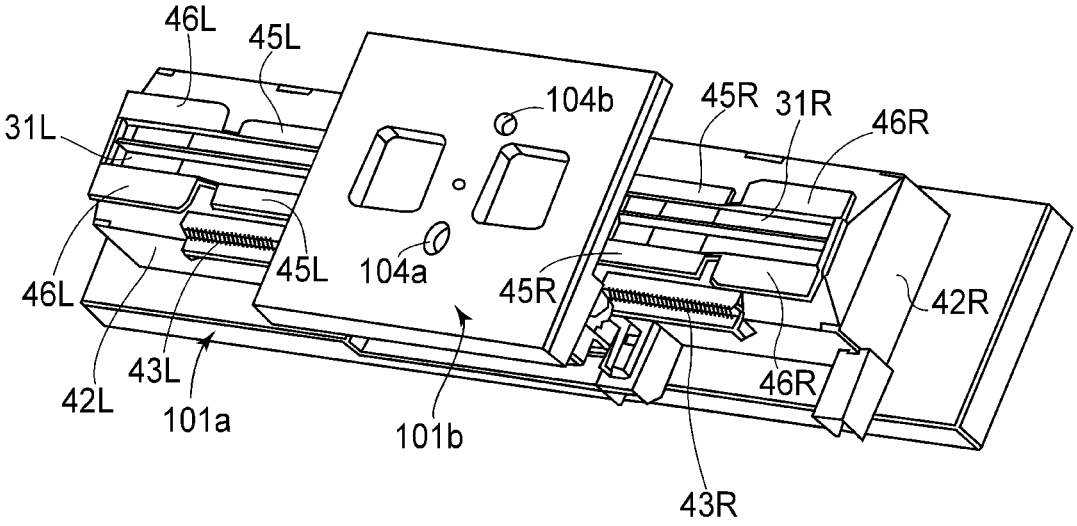
Figure 38:
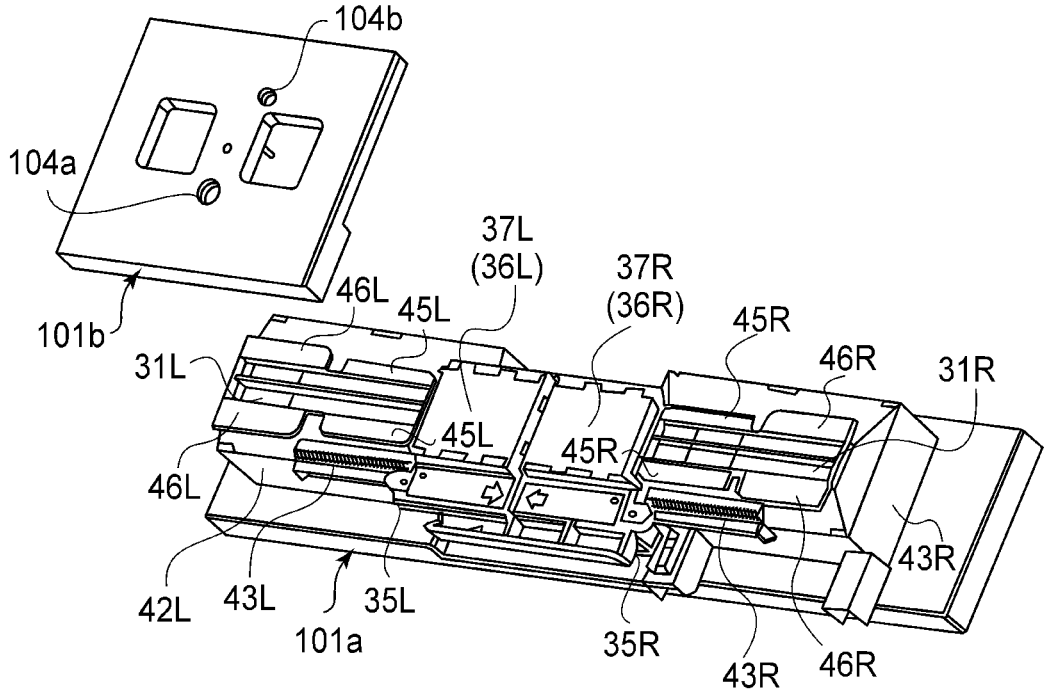

Thus, after the ducts 32 are mounted on the jig 101, as shown in FIG. 36, the central jig 101*b* is dismounted together with the inner shutter members 36, the outer shutter members 37, the driving pinion gear 41 and the ducts 32 from the base jig 101*a*.

Then, these component parts are held so that the inner shutter members 36, the outer shutter members 37 and the driving pinion gear 41 are sandwiched by the central jig 101*b* and the ducts 32 to prevent drop of the inner shutter members 36, the outer shutter members 37 and the driving pinion gear 41 from the ducts 32 and are turned upside down. The resultant structure is placed on the base jig 101*a* so that the central jig 101*b* and the base jig 101*a* are positioned on opposite sides with respect to the remaining component parts.

Then, as shown in FIG. 8, only the central jig 101*b* is dismounted form the inner shutter members 36, the outer shutter members 37, the driving pinion gear 41 and the ducts 32 by disconnecting the pins 102 (*a, b, c*, and *d*) from the ducts 32.

Figure 39:
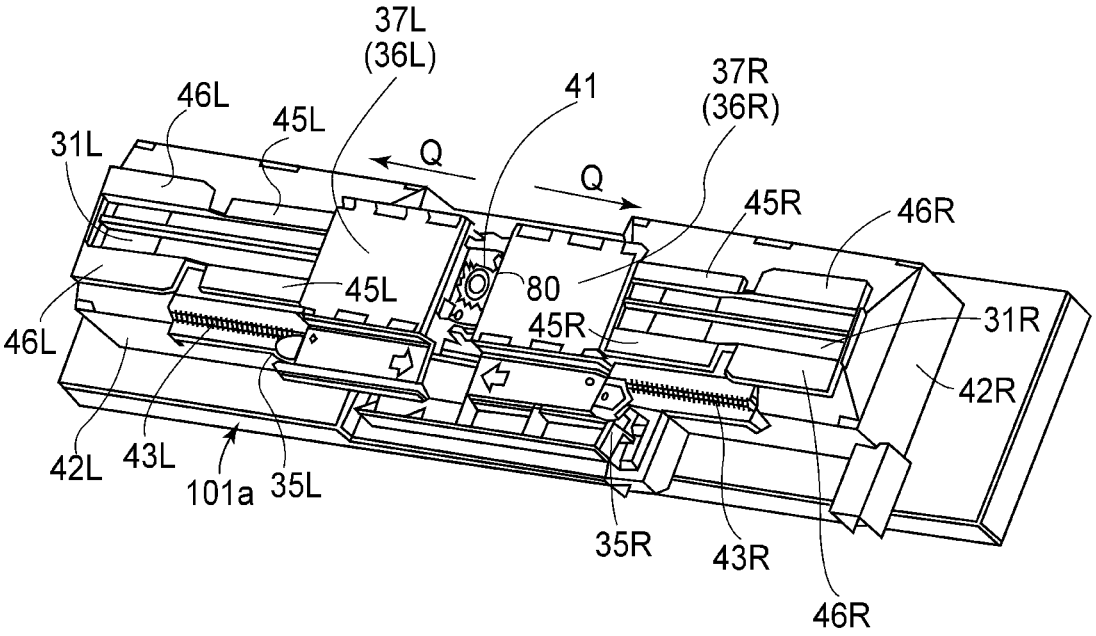

Then, as shown in FIG. 39, the outer shutter members 37 (L, R) are slid in arrow Q directions in which the air blowing ports 31 (L, R) of the ducts 32 (L, R) are closed. As a result, the inner shutter member 36L and the inner shutter member 36R are moved in interrelation with each other, so that an interval therebetween is increased. At this time, the interval between the inner shutter members 36 (L, R) is increased so as to be larger than a distance in which a shutter member movement regulating (limiting) member 82 described later enters between the inner shutter members 36 (L, R).

Figure 40:
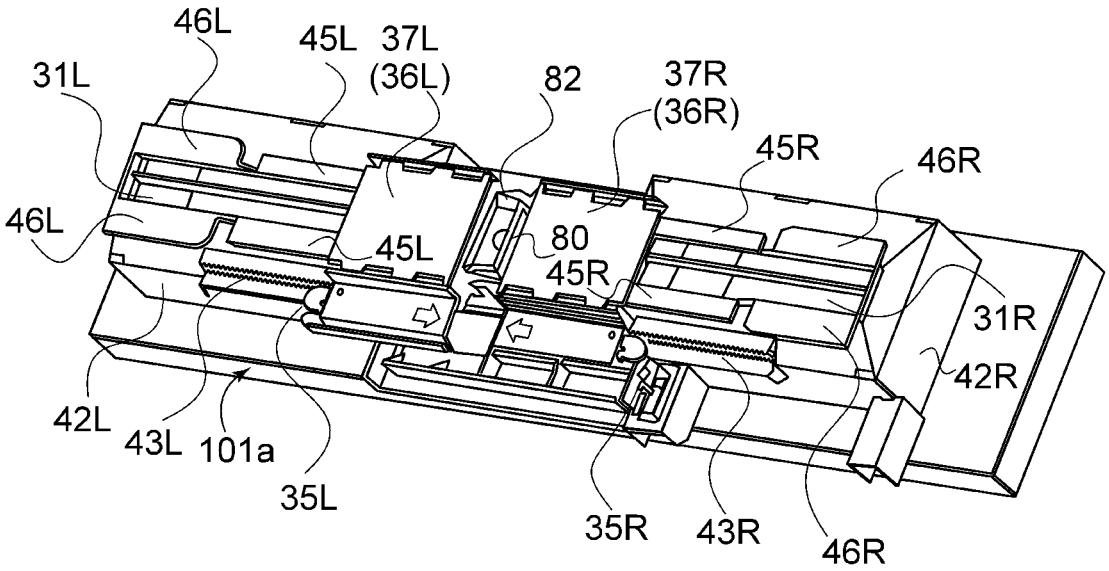

Then, as shown in FIG. 40, the shutter member movement regulating member 82 is mounted on the driving pinion gear 41 and is fixed to the driving pinion gear shaft 80 of the ducts 32 with a fastening member, such as a screw. The shutter member movement regulating member 82 has a function of suppressing disconnection of the driving pinion gear 41 from the ducts 32. Further, the shutter member movement regulating member 82 limits movable regions of the inner shutter members 36 (L, R) and the outer shutter members 37 (L, R). By this limitation, the shutter member movement regulating member 82 has a function of preventing the inner shutter members 36 (L, R) and the outer shutter members 37 (L, R) from being disconnected from the ducts 32 (L, R).

In a case in which the inner shutter members 36 (L, R) and the outer shutter members 37 (L, R) are dismounted, the shutter member movement regulating member 82 is dismounted and then the outer shutter members 37 (L, R) are slid to positions inside the position of the fixing member (shutter member movement regulating member) 82. As a result, the inner shutter members 36 (L, R) are also slid in interrelation with the outer shutter members 37 (L, R), so that the guiding members 47 (L, R) of the inner shutter members 36 (L, R) are disconnected from the inner shutter member regulating portions 45 (L, R) of the ducts 32 (L, R), and, therefore, the inner shutter members 36 (L, R) and the outer shutter members 37 (L, R) can be dismounted.

The above-described constitution and assembling method of the air blowing cooling mechanism 30 are summarized as follows.

(1) The air blowing cooling mechanism 30 is used in the fixing device 6 including the fixing member 10 for heating the image on the recording material. The air blowing cooling mechanism 30 includes the ducts 32 including the air blowing ports 31 for cooling set regions of the fixing member 10, the shutter members for changing the opening widths of the air blowing ports 31 depending on the widthwise length of the recording material P introduced in the fixing device 6, and the driving member 41 for transmitting the drive (driving force) to the shutter members.

The shutter members are constituted by the plurality of shutter members 36 and 37 and have a constitution in which areas of the shutter member surfaces for changing the opening widths of the air blowing ports of the shutter members by movement of the plurality of shutter members with the opening operation of the shutter members are decreased.

The ducts 32, the plurality of shutter members 36 and 37, and the driving member 41 are provided at predetermined positions with the positioning holes 81, 351, 352, 353, and 414 for aligning phases of the plurality of shutter members 36 and 37 and the driving member 41 during assembling of the air blowing cooling mechanism 30.

(2) In the assembling method of the air blowing cooling mechanism 30 described above, as constitution (1), the plurality of pins 102 are provided at predetermined positions, and the jig 101 for unambiguously positioning the ducts 32, the plurality of shutter members 36 and 37, and the driving member 41 are used. The ducts 32, the plurality of shutter members 36 and 37, and the driving member 41 are positioned by engaging the positioning holes thereof with the associated pins 102, so that phase alignment of the plurality of shutter members 36 and 37 with the driving member 41 is carried out.

As described above, in the assembling method of the air blowing cooling mechanism 30, the air blowing cooling mechanism 30 is assembled using the assembling jig 101 while carrying out the phase alignment of the inner shutter members 36 (L, R) and the outer shutter members 37 (L, R) with the driving pinion gear 41. As a result, the phase alignment of the shutter members can be carried out more simply than the method of the reference example shown in FIG. 41.

Other Embodiments (1) In the description above, the embodiments of the present invention were described, but numerical values of dimensions, conditions, and the like, mentioned in the above-described embodiments are examples, and, therefore, the present invention is not limited thereto. The numerical values can be appropriately selected within a range to which the present invention is applicable. For example, fixing devices of a roller fixing type and an induction heating (IH) fixing type may also be used in combination with the air blowing cooling mechanisms as in the above-described embodiments.

(2) The plurality of shutter members can also be made three or more shutter members.

Further, as the shutter members, a bellow-type member (accordion-type member) capable of being developed and folded can also be used. These hollow-type shutter members are also decreased in area of the surfaces for changing the opening widths of the air blowing ports 31 of the shutter members for changing the opening widths of the air blowing ports 31 of the shutter members with the opening operation thereof.

(3) The film 13 in the fixing device 6 of the film heating type described in the above-mentioned embodiments is not limited to that having a constitution in which an inner surface thereof is supported by the heater 11 and the heat-insulating holder 12 and the film 13 is driven by the pressing roller 20. For example, the film 13 may also be of a unit type in which the film 13 is stretched and extended around a plurality of rollers and is driven by either one of these rollers.

(4) The pressing member 20 forming the nip N in cooperation with the film 13 is not limited to a roller member. For example, a pressing belt unit (which is also the fixing member) including a belt stretched and extended around a plurality of rollers may also be used.

(5) As the fixing device 6, the device for fixing the unfixed toner image formed on the sheet by heating the toner image t was described as an example, but the present invention is not limited thereto. For example, a device for increasing a gloss (glossiness) of an image by heating and re-fixing a toner image temporarily fixed on the recording paper (also in this case, the device is referred to as the fixing device) may also be used. That is, for example, the fixing device 6 may also be a device for fixing the partly fixed toner image on the sheet or a device for subjecting the fixed image to a heating process. Accordingly, the fixing device 6 may also be, for example, a surface heating device (apparatus) for adjusting a gloss or a surface property of an image.

(6) The image forming apparatus described using the printer A as an example is not limited to the image forming apparatus for forming the monochromatic image but may also be an image forming apparatus for forming a color image. Further, the image forming apparatus can be carried out in various uses, such as a copying machine, a facsimile machine, and a multi-function machine having functions as these machines, by adding necessary device, equipment and casing structure.

(7) In the above description, for convenience, treatment of the recording material (sheet) P was described using terms associated with paper (sheet), such as sheet (paper) passing, sheet feeding, sheet discharge, sheet-passing-portion, non-sheet-passing-portion, and the like, but the recording material is not limited to the paper. The recording material P is a sheet-shaped recording medium (media) on which the toner image is capable of being formed by the image forming apparatus. For example, regular or irregular recording media, such as plain paper, thin paper, thick paper, high-quality paper, coated paper, envelope, postcard, seal, resin sheet, overhead projector (OHP) sheet, printing sheet, formatted paper, and the like, are cited.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image heating apparatus comprising:

a first rotatable member and a second rotatable member, which are configured to form a nip in which a toner image is fixed on a recording material;

an air blowing mechanism;

a duct configured to guide air from said air blowing mechanism toward an end portion of said first rotatable member with respect to a longitudinal direction of said first rotatable member; and an opening and closing mechanism configured to open and to close an air blowing port of said duct, wherein said opening and closing mechanism includes a plurality of shutter members configured to close said air blowing port in cooperation with each other.

2. The image heating apparatus according to claim 1, wherein said plurality of shutter members includes (i) a first shutter member, and (ii) a second shutter member, which are in a positional relationship such that said first and second shutter members at least partially overlap with each other when said air blowing port is opened.

3. The image heating apparatus according to claim 2, wherein, when said air blowing port is closed, with respect to the longitudinal direction of said first rotatable member, said first shutter member is on a central portion side and second shutter member is on an end portion side.

4. The image heating apparatus according to claim 3, wherein said opening and closing mechanism moves said second shutter member so as to be in a positional relationship in which said second shutter member is closer to said first rotatable member than is said first shutter member when said air blowing port is opened.

5. The image heating apparatus according to claim 1, further comprising a common driving motor configured to move said plurality of shutter members so as to open and to close said air blowing port.

6. The image forming apparatus according to claim 1, wherein said air blowing port includes a first fan positioned on a central portion side and a second fan positioned on an end portion side with respect to the longitudinal direction of said first rotatable member.

7. An image heating apparatus comprising:

a first rotatable member and a second rotatable member which are configured to form a nip in which a toner image is fixed on a recording material;

an air blowing mechanism;

a first duct configured to guide air from said air blowing mechanism toward an end portion of said first rotatable member with respect to a longitudinal direction of said first rotatable member;

a first opening and closing mechanism configured to open and to close a first air blowing port of said first duct, wherein said first opening and closing mechanism includes a plurality of shutter members configured to close said air blowing port in cooperation with each other;

a second duct configured to guide air from said air blowing mechanism toward the other end portion of said first rotatable member with respect to a longitudinal direction of said first rotatable member; and a second opening and closing mechanism configured to open and to close a second air blowing port of said second duct, wherein said second opening and closing mechanism includes a plurality of shutter members configured to close said air blowing port in cooperation with each other.

8. The image heating apparatus according to claim 7, wherein said plurality of shutter members of said first opening and closing mechanism includes (i) a first shutter member, and (ii) a second shutter member, which are in a positional relationship such that said first and second shutter members at least partially overlap with each other when said first air blowing port is opened, and wherein said plurality of shutter members of said second opening and closing mechanism includes (i) a third shutter member, and (ii) a fourth shutter member, which are in a positional relationship such that said third and fourth shutter members at least partially overlap with each other when said second air blowing port is opened.

9. The image heating apparatus according to claim 8, wherein, when said air blowing port is closed, with respect to the longitudinal direction of said first rotatable member, said first shutter member is on a central portion side and second shutter member is on an end portion side, and wherein, when said second air blowing port is closed, with respect to the longitudinal direction of said first rotatable member, said third shutter member is on a central portion side and said fourth shutter member is on the other end portion side.

10. The image heating apparatus according to claim 9, wherein said first opening and closing mechanism moves said second shutter member so as to be in a positional relationship in which said second shutter member is closer to said first rotatable member than is said first shutter member when said first air blowing port is opened, and wherein said second opening and closing mechanism moves said fourth shutter member so as to be in a positional relationship in which said fourth shutter member is closer to said first rotatable member than is said third shutter member when said second air blowing port is opened.

11. The image heating apparatus according to claim 7, further comprising a common driving motor configured to move said plurality of shutter members of said first opening and closing mechanism so as to open and to close said first air blowing port and to move said plurality of shutter members of said second opening and closing mechanism so as to open and to close said second air blowing port.

12. The image forming apparatus according to claim 7, wherein said air blowing port includes (i) a first fan, which is positioned on a central portion side with respect to the longitudinal direction of said first rotatable member, and which blows air to said first rotatable member, (ii) a second fan, which is positioned on an end portion side with respect to the longitudinal direction of said first rotatable member, and which blows air to said first duct, (iii) a third fan, which is positioned on a central portion side with respect to the longitudinal direction of said first rotatable member, and which blows air to said second duct, and (iv) a fourth fan, which is positioned on the other end portion side with respect to the longitudinal direction of said first rotatable member, and which blows air to said second duct.

* * * * *